US006155025A

United States Patent [19]

Komiya et al.

[11] Patent Number: 6,155,025

[45] **Date of Patent: *Dec. 5, 2000**

[54] ARTICLE PACKAGING SYSTEM

[75] Inventors: Masao Komiya, Odawara; Kazuhiko Maekawa, Minamiashigara; Shinji Nishizawa, Odawara, all of Japan

[73] Assignee: Fuji Photo Film Co., Ltd., Kanagawa-Ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/081,140

[22] Filed: May 19, 1998

[30] Foreign Application Priority Data

May 19, 1997 [JP] Japan ..... 9-128950

[51] Int. Cl.[7] ..... B65B 21/06

[52] U.S. Cl. ..... 53/147; 53/154; 53/531; 53/544

[58] Field of Search ..... 53/147, 544, 531, 53/154, 150, 202, 237, 55, 443, 446, 171; 198/348, 418; 414/789.6

[56] References Cited

U.S. PATENT DOCUMENTS

| | | | |
|---|---|---|---|
| 4,672,795 | 6/1987 | Alexander et al. | 53/544 |
| 5,241,806 | 9/1993 | Ziegler et al. | 53/237 |
| 5,395,207 | 3/1995 | Hoffman | 53/544 |
| 5,630,309 | 5/1997 | Blidung et al. | 53/147 |
| 5,809,738 | 9/1998 | Stephens et al. | 53/154 |
| 5,822,953 | 10/1998 | Kagawa et al. | 53/544 |

FOREIGN PATENT DOCUMENTS

| | | |
|---|---|---|
| 7120889 | 5/1995 | Japan . |
| 8262648 | 10/1996 | Japan . |
| 9146233 | 6/1997 | Japan . |

*Primary Examiner*—Eugene Kim
*Attorney, Agent, or Firm*—Sughrue, Mion, Zinn, Macpeak & Seas, PLLC

[57] ABSTRACT

An article packaging system has a magazine case charging mechanism for picking up and charging magazine cases one by one to a subsequent stage, a magazine case aligning mechanism for aligning the charged magazine cases in one direction, a small outer shipping package producing mechanism for storing a magazine case into a small package thereby to produce a small outer shipping package, a pack production mechanism for combining packs in a predetermined combining pattern, a large outer shipping package producing mechanism for assembling a plurality of packs in a predetermined assembling pattern into an assembly, and storing the assembly into a corrugated box to produce a large outer shipping package, and a production information management computer for controlling the above mechanisms in a centralized fashion. A complex packaging process of storing magazine cases into small boxes to produce small outer shipping packages, combining small outer shipping packages in any of various combining patterns into a pack, and storing a plurality of packs into a corrugated box to produce a large outer shipping package can easily be automatized.

15 Claims, 26 Drawing Sheets

#1
#2
#3
#4
BAR-CODE READER
FLAP PASTING MECHANISM
PACKAGE ID NUMBER PRINTING MECHANISM
ORIENTATION CORRECTING MECHANISM
SORTING AND DISCHARGING MECHANISM
TO #4
148
140
142
144
146
104

ARTICLE PACKAGING SYSTEM

BACKGROUND OF THE INVENTION

1. Field of the Invention

The present invention relates to an article packaging system for packaging tubular articles, pouch-shaped articles, etc. individually with small boxes, and placing small boxes in various combinations in corrugated boxes under the control of a computer, and more particularly to an article packaging system for packaging cartridges with photographic films housed therein.

2. Detailed description of the Related Art

For shipping a large quantities of small articles, it has been the general practice to place one or more small articles in a small package such as a small box to produce a small outer shipping package, put several small outer shipping packages together into a stack, place several stacks into a large package such as a corrugated box, and ship the corrugated box.

Recently, there have been available various packaging schemes for combining articles of different types or sizes and placing them in a small package such as a small box.

Heretofore, the various packaging schemes have been realized by different methods. According to a first method, only those packaging lines that can easily be automatized are automatized, and remaining packaging lines are manually processed or equipped with semiautomatic processing machines. According to a second method, only those packaging processes which package a large quantity of produced articles in one packaging pattern are specially automatized.

With the first method, since some articles are packaged either manually or by semiautomatic processing machines, workers are required to be highly skilled to package articles in different patterns, and a long period of time is needed until packaged articles are shipped. Therefore, the first method is disadvantageous in that it results in an increased number of packaging steps and an increased packaging cost. With the second method, the number of packaging steps and the packaging cost may be reduced because certain packaging processes are fully automatized. However, since each of the fully automatized packaging processes can package articles in one packaging pattern only, the second method needs to be combined with the first method in order to package articles in different patterns. Consequently, a certain limitation is imposed on efforts to reduce the number of packaging steps and the packaging cost according to the second method.

The applicant has proposed a technology for automatizing a packaging process by combining small packages of different types boxed up by two boxing machines and placing the combination into a corrugated box. The applicant has also proposed a method of managing various mechanisms in an outer shipping package production process up to the shipment of packaged articles with a production information management computer through process controllers and facility computers.

According to the proposed technology, it is possible to fully automatize a packaging process for packaging articles in different patterns. However, the proposed technology does not lend itself to a complex packaging process for placing articles in various combinations in small packages to produce small outer shipping packages, stacking the small outer shipping packages in various combinations into stacks, placing several stacks into a large package to produce a large outer shipping package.

SUMMARY OF THE INVENTION

It is therefore an object of the present invention to provide an article packaging system which is capable of easily automatizing a complex packaging process for placing articles in various combinations in small packages to produce small outer shipping packages, stacking the small outer shipping packages in various combinations into stacks, placing several stacks into a large package to produce a large outer shipping package.

The above and other objects, features, and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
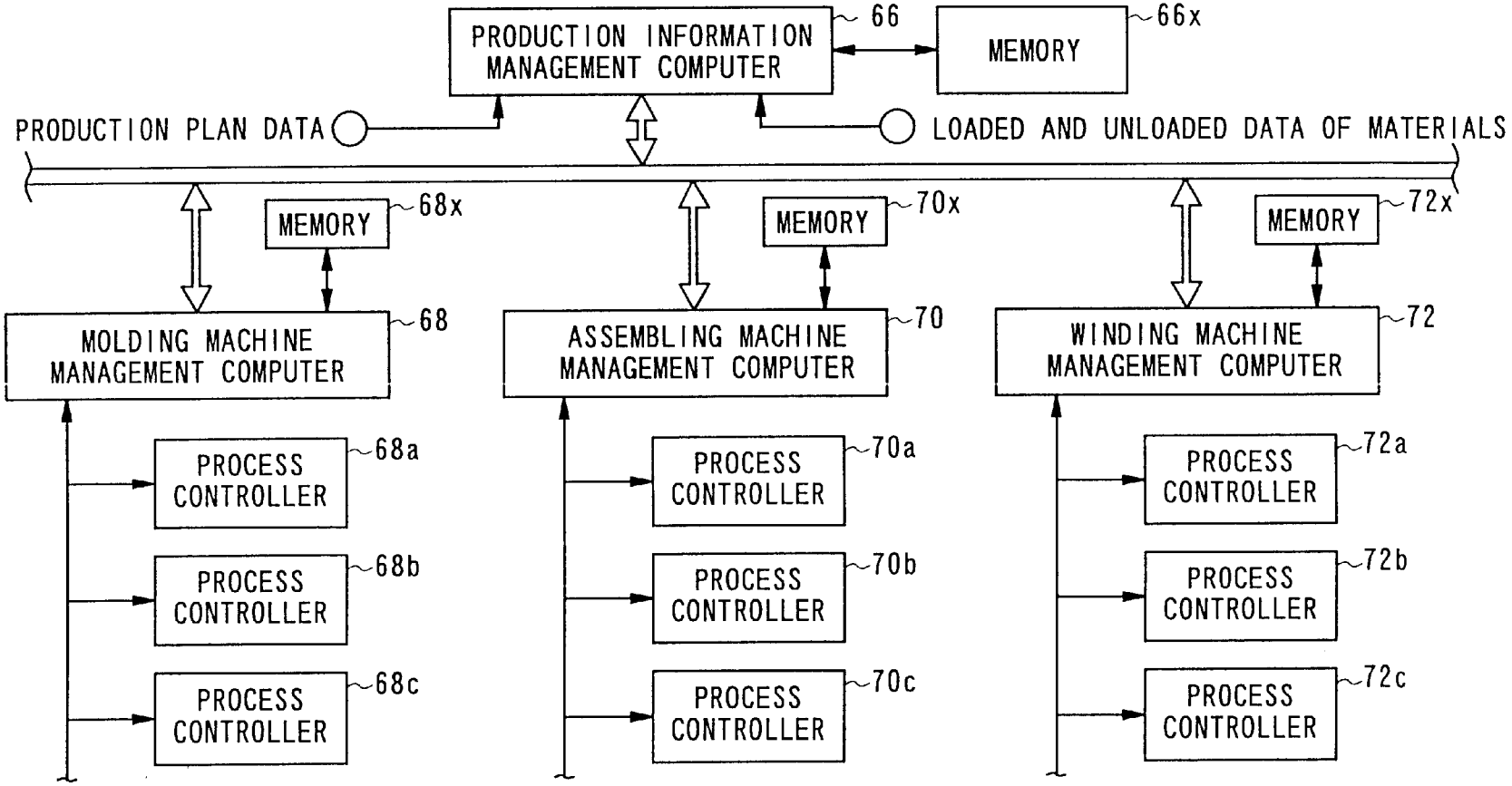
FIG. 1 is a block diagram of a photographic film cartridge production system which incorporates an article packaging system according to the present invention as a packaging system for packaging magazine cases which house photographic film cartridges.

An arrangement and operation of an article packaging system according to the present invention will brief be described below.

An article packaging system according to the present invention comprises an article charging mechanism for storing a plurality of articles, and picking up and charging the articles one by one to a subsequent stage, an article aligning mechanism for aligning the articles charged from the article charging mechanisms in one direction, a small outer shipping package producing mechanism for storing at least one of the articles aligned by the article aligning mechanism in a predetermined pattern into a small package thereby to produce a small outer shipping package, a pack production mechanism for combining a plurality of small outer shipping packages in a predetermined combining pattern into a pack, a large outer shipping package producing mechanism for assembling a plurality of packs in a predetermined assembling pattern into an assembly, and storing the assembly into a large package to produce a large outer shipping package, and a controller for controlling the article charging mechanism, the article aligning mechanism, the small outer shipping package producing mechanism, the pack production mechanism, and the large outer shipping package producing mechanism.

Articles stored in the article charging mechanism are picked up one by one thereby and charged to a subsequent stage. The charged articles are aligned in one direction and delivered by the article aligning mechanism. At least one of the aligned articles is stored into small packages in a predetermined pattern by the small outer shipping package producing mechanism. The predetermined pattern is established by the controller. The small outer shipping package producing mechanism is controlled by the controller to store articles into small packages.

The pattern which is established by the controller may be a pattern in which a desired number of articles of one type and one size are stored into a small package in a desired combination, a pattern in which a desired number of articles of one type and different sizes are stored into a small package in a desired combination, and a pattern in which a desired number of articles of different types and different sizes are stored into a small package in a desired combination.

Produced small outer shipping packages are combined into a pack in a predetermined combining pattern by the pack production mechanism. The combining pattern is established by the controller. The pack production mechanism is controlled by the controller to combine small outer shipping packages.

The combining pattern which is established by the controller may be a pattern in which five small outer shipping packages are vertically arranged or a pattern in which two arrays of five small outer shipping packages that are vertically arranged are juxtaposed.

Produced packs are then assembled into an assembly in a predetermined assembling pattern by the large outer shipping package producing mechanism, and the assembly is stored into a large package by the large outer shipping package producing mechanism, thereby producing a large outer shipping package.

The assembling pattern is established by the controller. The large outer shipping package producing mechanism is controlled by the controller to assemble packs.

The assembling pattern which is established by the controller may be a pattern in which ten packs may be erected and stacked.

Since small outer shipping packages, packs, and large outer shipping packages can be produced on the basis of patterns established by the controller to store articles into small packages, combine small outer shipping packages into packs, and assemble packs, it is possible to easily automatize a complex packaging process of storing articles into small packages in any of various combining patterns thereby to produce small outer shipping packages, combining small outer shipping packages into a pack in any of various combining patterns, and storing a plurality of packs into a large package thereby to produce a large outer shipping package.

The small outer shipping package producing mechanism may comprise an outer shipping package branching mechanism disposed in a final stage thereof for distributing selected small outer shipping packages produced by the small outer shipping package producing mechanism to a different packaging line.

Some of the small outer shipping packages produced by the small outer shipping package producing mechanism may thus be supplied to the different packaging line by the outer shipping package branching mechanism, so that a packaging operation can be carried out simultaneously on various packaging lines.

The small outer shipping package producing mechanism may comprise a main line and a branch line, an article branching mechanism for separating, at a given timing, articles successively charged from the article aligning mechanism along the main line, and distributing the articles to the branch line, and an article combining mechanism for combining articles delivered along the branch line and articles delivered along the main line in a predetermined combining pattern.

Articles from the article aligning mechanism are first charged to the main line of the small outer shipping package producing mechanism. Some of the articles supplied to the main line are distributed to the branch line by the article branching mechanism. The articles delivered along the main line and the articles delivered along the branch line are combined in a predetermined combining pattern by the article combining mechanism. The combining pattern is established by the controller, and the article combining mechanism is controlled by the controller to combine the articles delivered along the main and branch lines.

The combining pattern established by the controller may be a pattern in which the articles from the main and branch lines have axes extending parallel or perpendicularly to each other. If the articles are cylindrical in shape, then the articles are delivered along the main line with their axes aligned with the delivery direction, and the articles are delivered along the branch line with their axes perpendicular to the delivery direction. In this case, the articles from the branch line are changed in orientation by the article combining mechanism to bring their axes into alignment with the delivery direction along the main line. Thereafter, the articles from the branch line and the articles from the main line are combined so as to be positioned adjacent to each other, so that two articles are juxtaposed with respect to each other. In this manner, when articles are stored into small packages by the small outer shipping package producing mechanism, a set of two aligned articles can easily be stored into a small package. By modifying the combining pattern, a set of plural articles can be stored into a small box in any of various combinations.

According to the present invention, there is also provided an article packaging system comprising a plurality of article supply systems each having an article charging mechanism for storing a plurality of articles, and picking up and charging the articles one by one to a subsequent stage, and an article aligning mechanism for aligning the articles charged from the article charging mechanisms in one direction, an article combining mechanism for combining articles supplied from the article aligning mechanism of one of the article supply systems and articles supplied from the article aligning mechanism of another of the article supply systems, a small outer shipping package producing mechanism for storing articles supplied from the article combining mechanism in a predetermined pattern into a small package thereby to produce a small outer shipping package, a pack production mechanism for combining a plurality of small outer shipping packages in a predetermined combining pattern into a pack, a large outer shipping package producing mechanism for assembling a plurality of packs in a predetermined assembling pattern into an assembly, and storing the assembly into a large package to produce a large outer shipping package, and a controller for controlling the article charging mechanism, the article aligning mechanism, the article combining mechanism, the small outer shipping package producing mechanism, the pack production mechanism, and the large outer shipping package producing mechanism.

In each of the article supply systems, articles stored in the article charging mechanism are picked up one by one thereby and charged to a subsequent stage. The charged articles are aligned in one direction and delivered by the article aligning mechanism. The articles aligned by the article aligning mechanism in one of the article supply systems and the articles aligned by the article aligning mechanism in the other article supply system are combined in a predetermined combining pattern by the article combining mechanism. The combining pattern is established by the controller. The small outer shipping package producing mechanism is controlled by the controller to store articles into small packages.

Produced small outer shipping packages are combined into a pack in a predetermined combining pattern by the pack production mechanism. The combining pattern is established by the controller. The pack production mechanism is controlled by the controller to combine small outer shipping packages.

Produced packs are then assembled into an assembly in a predetermined assembling pattern by the large outer shipping package producing mechanism, and the assembly is stored into a large package by the large outer shipping package producing mechanism, thereby producing a large outer shipping package.

The assembling pattern is established by the controller. The large outer shipping package producing mechanism is controlled by the controller to assemble packs.

Since small outer shipping packages, packs, and large outer shipping packages can be produced on the basis of patterns established by the controller to combine articles, store combined articles into small packages, combine small outer shipping packages into a pack, and assemble packs, it is possible to easily automatize a complex packaging process of storing articles into small packages in any of various combining patterns thereby to produce small outer shipping packages, combining small outer shipping packages into a pack in any of various combining patterns, and storing a plurality of packs into a large package thereby to produce a large outer shipping package.

The small outer shipping package producing mechanism may comprise an outer shipping package branching mechanism disposed in a final stage thereof for distributing selected small outer shipping packages produced by the small outer shipping package producing mechanism to a different packaging line.

Some of the small outer shipping packages produced by the small outer shipping package producing mechanism may thus be supplied to the different packaging line by the outer shipping package branching mechanism, so that the packaging operation can be carried out simultaneously on various packaging lines.

At least one of the article supply systems may comprise a main line and a branch line, an article branching mechanism for separating, at a given timing, articles successively charged from the article aligning mechanism along the main line, and distributing the articles to the branch line, and the article combining mechanism comprising means for combining articles delivered from the other article supply system, articles delivered along the branch line in the one article supply system, and articles delivered along the main line in the one article supply system in a predetermined combining pattern.

In the above one of the article supply systems, articles from the article aligning mechanism are first charged to the main line of the small outer shipping package producing mechanism. Some of the articles supplied to the main line are distributed to the branch line by the article branching mechanism. The articles delivered along the main and branch lines of the article supply system, and the articles delivered from the other article supply system are combined in a predetermined combining pattern by the article combining mechanism. The combining pattern is established by the controller, and the article combining mechanism is controlled by the controller to combine the articles delivered along the main and branch lines and from the other article supply system.

The combining pattern established by the controller may be a pattern in which the articles from the main and branch lines have axes extending parallel or perpendicularly to each other. If the articles are cylindrical in shape, then the articles are delivered along the main line with their axes aligned with the delivery direction, and the articles are delivered along the branch line and from the other article supply system with their axes perpendicular to the delivery direction. In this case, the articles from the branch line and the other article supply system are changed in orientation by the article combining mechanism to bring their axes into alignment with the delivery direction along the main line. Thereafter, the articles from the branch line and the other article supply system and the articles from the main line are combined so as to be positioned adjacent to each other, so that three articles are juxtaposed with respect to each other. In this manner, when articles are stored into small packages by the small outer shipping package producing mechanism, a set of three aligned articles can easily be stored into a small package. Alternatively, four or more articles can easily be combined with each other.

By modifying the combining pattern, a set of plural articles can be stored into a small box in any of various combinations.

The other article supply system may comprise a pack production mechanism for combining a plurality of small outer shipping packages charged respectively from a plurality of outer shipping package branching mechanism, in a predetermined combining pattern into a pack, and a large outer shipping package producing mechanism for assembling a plurality of packs in a predetermined assembling pattern into an assembly, and storing the assembly into a large package.

Some of the small outer shipping packages produced by the small outer shipping package producing mechanism in each of the packaging lines are supplied to the other packaging line by the outer shipping package branching mechanism. Thus, small outer shipping packages having various packaging patterns are supplied. In the other packaging line, small outer shipping packages having various packaging patterns are combined into a pack according to a predetermining combining pattern by the pack production mechanism. The combining pattern is established by the controller. The pack production mechanism is controlled by the controller to combine small outer shipping packages having various storing patterns.

The combining pattern which is established by the controller may be a pattern in which five small outer shipping packages are vertically arranged or a pattern in which two arrays of five small outer shipping packages that are vertically arranged are juxtaposed.

Produced packs are then assembled into an assembly in a predetermined assembling pattern by the large outer shipping package producing mechanism, and the assembly is stored into a large package by the large outer shipping package producing mechanism, thereby producing a large outer shipping package.

The assembling pattern is established by the controller. The large outer shipping package producing mechanism is controlled by the controller to assemble packs. The assembling pattern which is established by the controller may be a pattern in which ten packs may be erected and stacked.

The article packaging system according to the present invention is thus capable of combining small outer shipping packages having various storing patterns and storing them into a large package. The article packaging system can thus automatize packaging small outer shipping packages in many storing patterns.

The pack production mechanism may comprise a main packing line and a branch packing line, a small outer shipping package branching mechanism for separating, at a given timing, small outer shipping packages successively delivered from the small outer shipping package producing mechanism along the main packing line, and distributing the articles to the branch packing line, and a pack combining mechanism for combining packs delivered along the branch packing line and packs delivered along the main packing line in a predetermined combining pattern.

The small outer shipping packages produced by the small outer shipping package producing mechanism are first charged to the main packing line of the pack production mechanism. Some of the small outer shipping packages are separated by the small outer shipping package branching mechanism and charged to the branch packing line. The small outer shipping packages charged to the main packing line are combined into a pack (main line pack) according to a predetermining main line combining pattern. The small outer shipping packages charged to the branch packing line are combined into a pack (branch line pack) according to a predetermining branch line combining pattern.

The main and branch line combining patterns are established by the controller. The main and branch packing lines are controlled by the controller to combine small outer shipping packages charged to the main and branch packing lines.

Each of the main and branch line combining patterns which is established by the controller may be a pattern in which five small outer shipping packages are vertically arranged or a pattern in which two arrays of five small outer shipping packages that are vertically arranged are juxtaposed.

Produced main and branch line packs are then assembled into an assembly in a predetermined combining pattern by the pack combining mechanism. The combining pattern is established by the controller. The pack combining mechanism is controlled by the controller to combine main and branch line packs. The combining pattern may be a pattern in which main and branch line packs are arrayed laterally.

Since the article packaging system can combine packs in various combining patterns, it can quickly be arranged to meet a diverse range of packaging patterns. Since the packaging system can be automatized in its entirety, the packaging process carried thereby can be simplified, be composed of a reduced number of steps, and be manufactured relatively inexpensively.

An article packaging system according to the present invention as applied to a packaging system for packaging magazine cases which house photographic film cartridges will be described in detail below with reference to FIGS. 1 through 27.

Prior to describing the packaging system, a photographic film cartridge 12 housed in a magazine case 10 will first be described below with reference to FIG. 2.

The photographic film cartridge 12 comprises a photographic film strip 14 and a cartridge case 16 which stores the photographic film strip 14 in a light-shielded condition.

The photographic film strip 14 is slit at constant intervals according to a certain format, e.g., an APS format, and cut off to a length depending on the number of frames. The photographic film strip 14 has a number of perforations 14*a*, two per frame. For taking a picture on the photographic film strip 14, a frame is exposed at a position indicated by the two-dot-and-dash lines. The photographic film strip 14 also has a locking hole 18 and a pair of engaging holes 20 which are defined in a trailing end thereof.

The cartridge case 16 comprises upper and lower case members 16*a*, 16*b*, each as a plastic molding, which are attached to each other, a spool 22, a light shield lid 24, and a disk 26 which are rotatably disposed in the upper and lower case members 16*a*, 16*b*, and other parts of a film delivery mechanism and a spool lock mechanism which are also disposed in the upper and lower case members 16*a*, 16*b*.

The light shield lid 24 selectively opens and closes 64 a film slot 28 through which the photographic film strip 14 can pass into and out of the cartridge case 16. The photographic film strip 14 is loaded into the cartridge case 16 as follows: The light shield lid 24 is opened in a dark room, and teeth on a thin inserter are put in the engaging holes 20 in the trailing end of the photographic film strip 14. When the inserter is inserted into the film slot 28, the locking hole 18 is fitted over a locking finger on the spool 22. The trailing end of the photographic film strip 14 is now locked on the spool 22. The inserter is removed, and the spool 22 is rotated in the direction indicated by the arrow to wind the photographic film strip 14 into the cartridge case 16.

After the photographic film strip 14 is fully wound in until its leading end is placed in the cartridge case 16, the light shield lid 24 is closed, blocking light against entering the cartridge case 16. Details of the inserter are described in Japanese laid-open patent publication No. 7-120889.

The photographic film cartridge 12 thus manufactured is then housed in the magazine case 10, which is made of plastic and resistant to humidity, and the magazine case 10 is closed by a cap 10*a*. The magazine case 10 housing the photographic film cartridge 12 and closed by the cap 10 is then packaged by a small box 30, and shipped as a product.

A label 32 is applied to an outer surface of the cartridge case 16, and carries an indicia 34 indicative of the type of the photographic film strip 14 housed in the cartridge case 16 and a bar code 36 indicative of an ID number (cartridge ID number) of the cartridge case 16. The cartridge ID number is the same as a film ID number printed in a side print area 14*b* as a latent image on the photographic film strip 14, as described later on. Although not shown, the label 32 is also marked with a string of numerals as a visual indication of the cartridge ID number, parallel to the bar code 36.

The small box 30 is also printed with an indicia 38 indicative of the type of the photographic film strip 14 and a pair of bar codes 40*a*, 40*b*. The indicias 34, 38 allow the user to obtain information of color/monochromatic film, ISO sensitivity, the number of frames available for exposure, etc., necessary to take pictures, when the user purchases or uses the photographic film.

The bar code 40*a* indicates a package ID number which is the same as the cartridge ID number. The small box 30 is also marked with a string of numerals as a visual indication of the package ID number, parallel to the bar code 40*a*.

The bar code 40*b* represents information of color/monochromatic film, ISO sensitivity, the number of frames available for exposure, etc., and can automatically be read at a suitable stage in the production of the photographic film.

Figure 3:
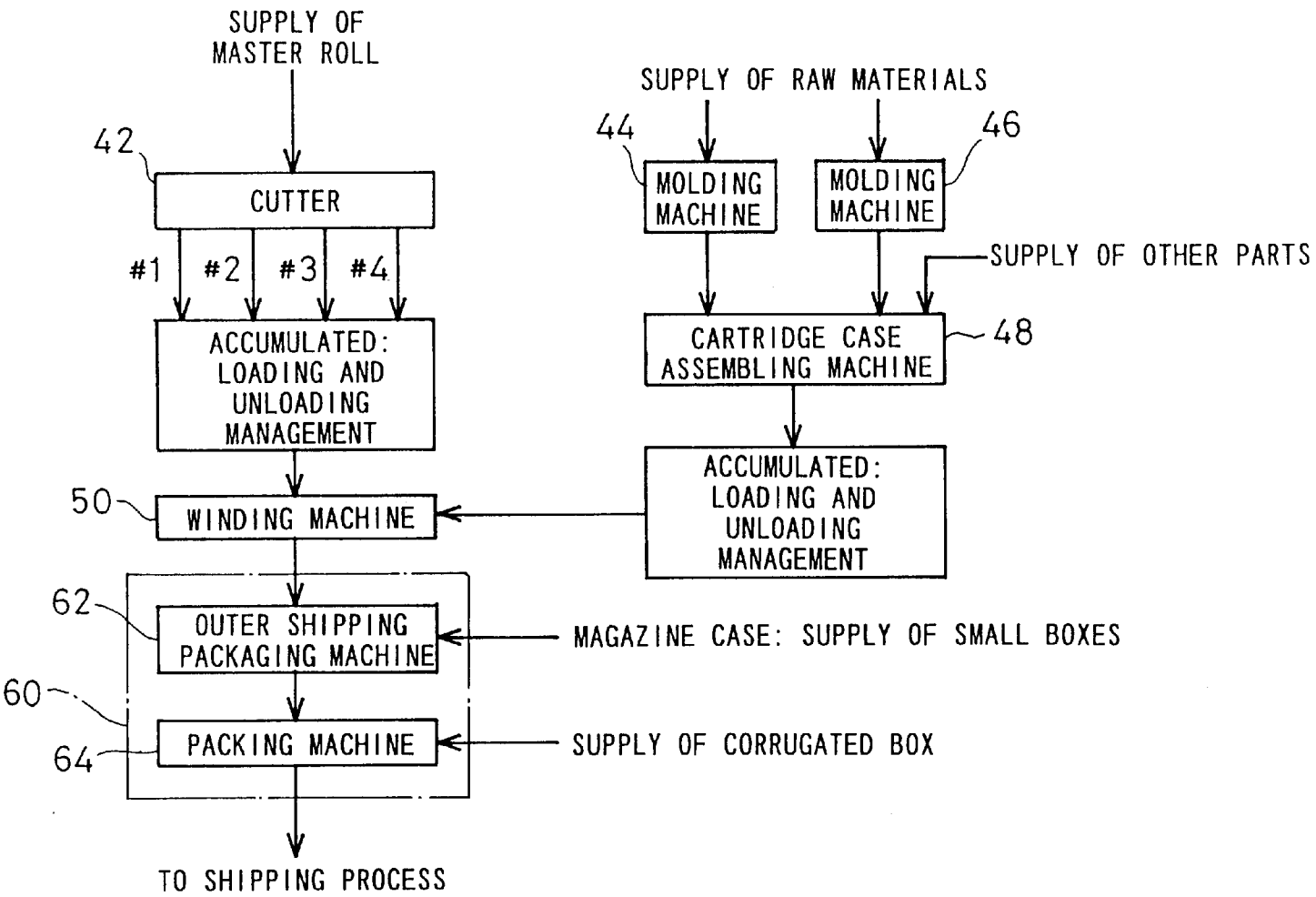
FIG. 3 is a block diagram illustrative of a process for manufacturing a photographic film cartridge.

A production process for producing and shipping the photographic film cartridge 12 will be described below with reference to FIG. 3.

A master roll is manufactured by coating a roll of wide film with a given emulsion. When the master roll is manufactured, information of a master roll lot number and an emulsion number indicative of the emulsion used is applied to the roll core or the leading end of the roll in the form of a bar code or a magnetic recording.

The master roll is supplied to a cutter 42, which slits the master roll to the same width as the photographic film strip 14, producing a plurality of slit rolls.

To the roll core or roll leading end of each of the slit rolls, there is applied a label carrying the master roll lot number, the emulsion number, and a slit number indicative of the transverse position of the slit roll on the master roll, which are magnetically recorded or printed. The slit rolls from the master roll are stored on a light-shielded self-propelled carriage, and stocked in a storage chamber as a dark room.

For manufacturing the cartridge case 16, a raw material in the form of resin pellets is supplied to molding machines 44, 46. The molding machines 44, 46 mold upper and lower case members 16*a*, 16*b*. The molded upper and lower case members 16*a*, 16*b*, spools 22, light shield lids 24, disks 26, labels 32, and other parts are supplied to a cartridge case assembling machine 48, which assemble the supplied parts into cartridge cases 16. A predetermined number of cartridge cases 16 are placed in a dedicated tray, and trays of cartridge cases 16 are stacked.

Each of the trays has its own ID number (tray number). The ID numbers of the trays are managed in association with lot numbers of the parts of the cartridge cases 16. Before photographic film strips 14 are wound into respective cartridge cases 16, therefore, the production history of the cartridge cases 16, indicating lot numbers of the parts which make up the cartridge cases 16, can be managed with respect to each of the trays.

A slit roll and a cartridge case 16 are supplied to a winding machine 50. The winding machine 50 perforates an elongate photographic film unwound from the slit roll to make perforations 14*a*, prints in side print areas 14*b*, and cuts off the photographic film into a photographic film strip 14 having a length depending on the number of frames available for exposure. When the photographic film is cut off into the photographic film strip 14, a locking hole 18 and a pair of engaging holes 20 are defined in its trailing end, and a leading end of the photographic film strip 14 is trimmed.

In the winding machine 50, the trailing end of the photographic film strip 14 is fed toward the cartridge case 16 set in position. An inserter is operated to engage the trailing end of the photographic film strip 14 with the spool 22, and thereafter the spool 22 is actuated to wind the photographic film strip 14 into the cartridge case 16 until its leading end is placed therein. Then, the light shield lid 24 is closed, thereby completing a photographic film cartridge 12.

Then, the photographic film cartridge 12 is delivered to an outer shipping packaging machine 62 of a packaging system 60 according to the present invention. In the outer shipping packaging machine 62, the photographic film cartridge 12 is placed in a magazine case 10, which is packaged in a small box 30. Thereafter, a predetermined number of small boxes 30 each containing a photographic film cartridge 12 housed in a magazine case 10 are packed in a corrugated box by a packing machine 64, and the corrugated box containing the small boxes 30 is shipped. Two or more corrugated boxes each containing the small boxes 30 may be packed and shipped.

The photographic film cartridge 12 is manufactured and shipped in the manner described above. In the above processes, each of the cutter 42, the molding machines 44, 46, the cartridge case assembling machine 48, the winding machine 50, and the packaging system 60 (the outer shipping packaging machine 62 and the packing machine 64), used as production facilities, is managed by a production information management computer 66, as shown in FIG. 1, for efficiently manufacturing film products using appropriate materials according to production instructions and accurately recognizing production histories based on individual ID numbers assigned to the film products after the film products have been manufactured.

Figure 6:
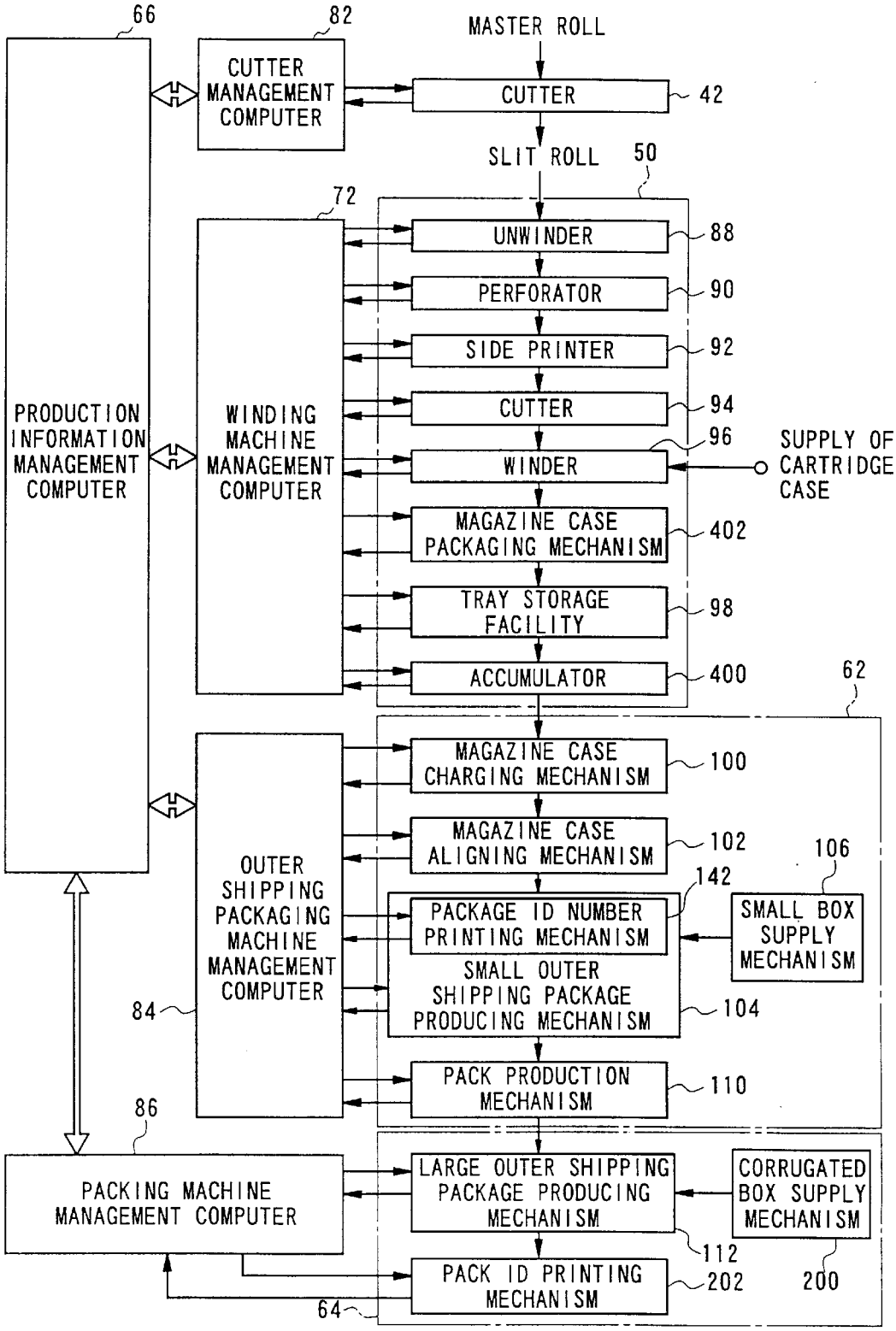
FIG. 6 is a block diagram schematically showing a process for manufacturing a photographic film cartridge.
Figure 7:
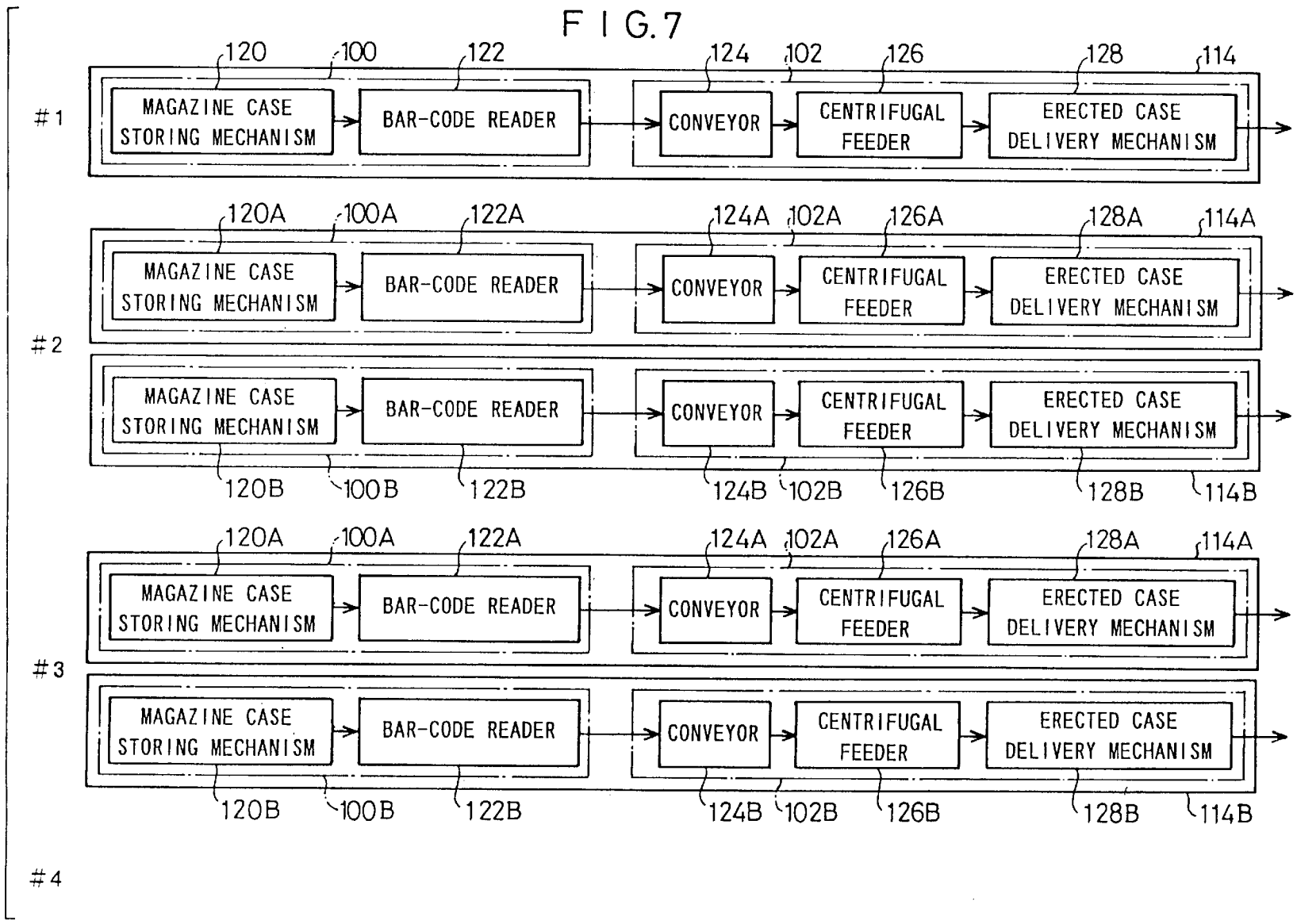
FIG. 7 is a block diagram of outer shipping packaging machines of first through third packaging lines of the packaging system, particularly magazine case supply systems.

A molding machine management computer 68, an assembling machine management computer 70, and a winding machine management computer 72 shown in FIG. 1, and an outer shipping packaging machine management computer 84 and a packing machine management computer 86 shown in FIG. 6 are facility management computers for individually controlling the above production facilities. For example, in order to operate the molding machine 46 (see FIG. 3) used to mold the lower case member 16*b*, it is necessary to successively carry out a plurality of processes of supplying, heating, pouring, and cooling a raw material and removing a molding. Process controllers 68*a*, 68*b*, 68*c*, . . . are used to carry out these processes under appropriate conditions, and the amount of a raw material to be supplied, the temperature of the raw material, the pressure at which the raw material is to be poured, the time for which the raw material is to be cooled, and the speed at which molds are to be moved to remove a molding are controlled in the process controllers 68*a*, 68*b*, 68*c*, . . . under commands from the production information management computer 66.

In the cartridge case assembling machine 48, lower case members 16*b* supplied from the molding machine 46 are placed one by one on respective pallets circulating therein. While the pallets with the lower case members 16*b* placed thereon are circulating, spools 22 and light shield lids 24 are assembled into the lower case members 16*b*, upper case members 16*a* supplied from the molding machine 44 are attached to the lower case members 16*b*, and labels 32 are applied to the cartridge cases 16.

In order to carry out these processes in the cartridge case assembling machine 48, process controllers 70*a*, 70*b*, 70*c*, . . . control the speed at which the pallets are to move, and also control motors, pneumatic cylinders, and hydraulic cylinders used as robot arm actuators under commands from the assembling machine management computer 70.

In the winding machine 50, an elongate photographic film is unwound from the slit roll set in position at a constant speed, and perforated by a perforator. After the elongate photographic film is printed in side print areas 14*b*, the elongate photographic film is cut off into a photographic film strip 14.

Furthermore, the assembled cartridge case 16 is set on a turret, and the inserter is operated to engage the photographic film strip 14 with the spool 22 and wind the photographic film strip 14 on the spool 22. These processes in the winding machine 50 are controlled by process controllers 72*a*, 72*b*, 72*c*, . . . under commands from the winding machine management computer 72.

The facility management computers and the process controllers in the production facilities jointly make up a process network for performing various processes in the production facilities. Production data obtained from the process controllers, e.g., data indicative of the numbers of products and intermediate products, data indicative of the numbers of acceptable and defective products, and inspection data from process controllers for inspection processes are fed back to the corresponding facility management computers, and stored in memories 68*x*, 70*x*, 72*x* associated therewith. Therefore, when the facility management computers are accessed, it is possible to obtain information indicative of conditions under which the various processes in the production facilities are carried out.

The facility management computers associated with the respective production facilities, e.g., the molding machine management computer 68, the assembling machine management computer 70, and the winding machine management computer 72, are managed altogether by the production information management computer 66, making up an in-factory network.

The production information management computer 66 issues production instruction information individually to the facility management computers, and gives instructions for setting up conditions for processing or inspecting processes in the production facilities, to the facility management computers. The production information management computer 66 is therefore supplied with production plan data, and data of loading and unloading plans or loaded and unloaded data of materials (raw materials and parts).

The production plan data is supplied to the production information management computer 66 through a keyboard thereof or a recording medium such as a magnetic disk or the like, and stored in a memory 66*x*. The data of loading and unloading plans or loaded and unloaded data of materials may be supplied to the production information management computer 66 through a keyboard thereof or a recording medium such as a magnetic disk or the like, and may also be supplied from the facility management computers.

The memory 66*x* of the production information management computer 66 stores as many tables as the number of types of photographic film cartridges 12 to be manufactured. Each of these tables is allotted an abbreviated product name indicative of the type of a product, and contains prescription data indicative of types of materials necessary to manufacture the photographic film cartridges 12 of the type, manufacturing conditions, and inspecting conditions.

Figure 4:
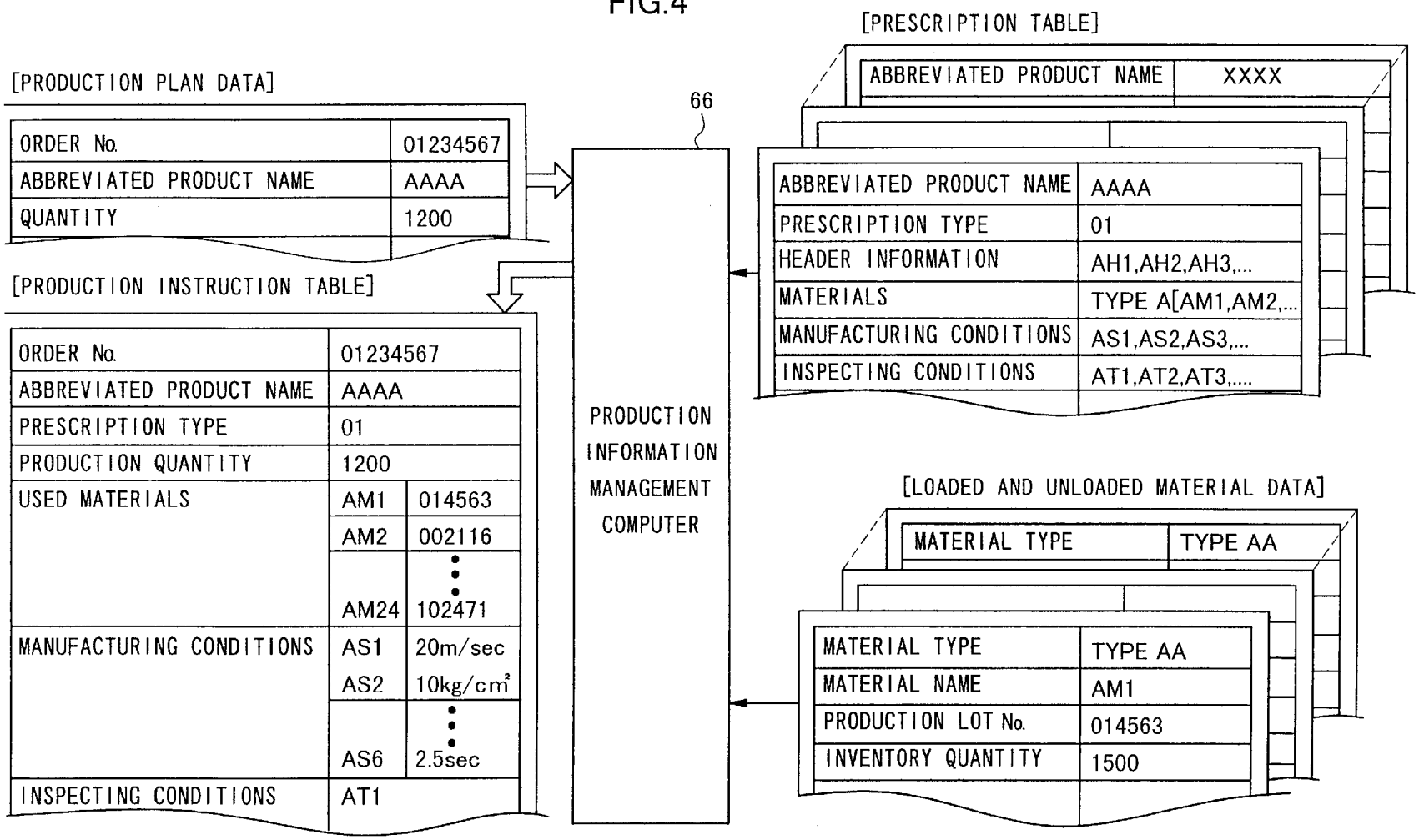
FIG. 4 is a diagram of data inputted to and outputted from a production information management computer.

When supplied with the production plan data is, the production information management computer 66 generates a production instruction table in a manner as shown in FIG. 4.

The production plan data comprise an order number, an abbreviated product name indicative of the type of a product to be manufactured, a planned number of products, etc. Based on the abbreviated product name contained in the production plan data, the production information management computer 66 searches the prescription tables, and reads all prescription data from the prescription table to which the abbreviated product name is assigned. The production information management computer 66 can now recognize a prescription type, a material type, material names, manufacturing conditions for operating the production facilities, and inspecting conditions for manufacturing products having an abbreviated product name "AAAA", for example.

When a material type and material names necessary for the production of the product are recognized, the production information management computer 66 accesses the loaded and unloaded data of materials, displays inventory data on a monitor display screen, and confirms whether kinds and quantities of materials sufficient to manufacture the planned number of products are stocked in inventory or not.

If the stocked quantity of either one of the materials is not sufficient, then the production information management computer 66 displays on its monitor display screen the production plan data, the number of products that can presently be manufactured, and how much the material is insufficient with respect to the planned number of products. Header information in the prescription tables represents auxiliary information of products, and includes additional data indicative of how many more products should be manufactured than the planned number of products in the production plan data in view of the percentage of defective products and business coefficients.

If the stocked quantities of the materials are sufficient, then the production information management computer 66 generates a production instruction table as shown in FIG. 4. The production instruction table contains a prescription type, the number of products, the names of materials to be used, manufacturing conditions, and inspecting conditions which are assigned with respect to the order number and the abbreviated product name. The items of the production instruction table include fixed items that are uniquely determined once a product type is determined and arbitrary items that can be changed.

The fixed items include material names and numbers that are differently used depending on the product type, and these are automatically established. The arbitrary items include lot numbers of materials, and some manufacturing conditions and inspecting conditions. Therefore, materials of suitable lot numbers may be selected and used for production, in view of production histories of the materials, so that flexible production approaches can be made for stable product quantity.

The arbitrary items may also be set up by the facility management computers. When the arbitrary items are set up by the facility management computers, the setup data are fed back to the production information management computer 66.

The production instruction table thus generated is stored altogether in the memory 66*x* of the production information management computer 66. Data of the names of materials used, their lot numbers, the manufacturing conditions, and the inspecting conditions in the production instruction table are classified for the respective production facilities by the production information management computer 66, and transmitted, together with the order number, the abbreviated product name, the prescription type, and the number of products, to the facility management computers which manage the production facilities.

For example, the assembling machine management computer 70 which manages operation of the cartridge case assembling machine 48 is supplied with the names of materials used to manufacture cartridge cases 16, their lot numbers, the manufacturing conditions and the inspecting conditions for operating the cartridge case assembling machine 48, as an individual production instruction table. The individual production instruction table is displayed on a monitor display screen of the assembling machine management computer 70, which sends instructions to various parts of the cartridge case assembling machine 48 in order to satisfy the manufacturing conditions and the inspecting conditions.

As described above, the production information management computer 66 controls the facility management computers installed respectively in combination with the production facilities through the in-factory network, generates and stores production instruction data depending on production plan data, generates individual production instruction tables for the respective production facilities, and transmits the individual production instruction tables to the corresponding facility management computers. After the production facilities have started to operate, the production information management computer 66 receives production data fed back from the respective production facilities, and stores the received production data together with the projection instruction table.

Since the facility management computers for the respective production facilities are functionally distributed and controlled by the common production information management computer 66, no undue burden is imposed on any particular computers, and reliable high-speed data processing is made possible. This network arrangement can easily handle the addition of a production facility.

Because the facility management computers can communicate with the process controllers in the production facilities in real time, they can quickly handle local condition changes without posing undue burdens on the production information management computer 66, and can display data conveniently on their monitor display screens for the respective production facilities. If a terminal machine is connected to the in-factory network for accessing the production information management computer 66, then the operator can easily confirm production details and plan details at present as well as past production data.

The production facilities are operated under commands from the production information management computer 66, and the production history data such as the types of materials used in processing and assembling processes, their lot numbers, etc. are fed back to the production information management computer 66. Therefore, operation of the production facilities can be managed altogether by a production management department, which can easily recognize production data of all the production facilities.

Inasmuch as the packaging system is constructed such that the production information management computer 66 can be accessed from the facility management computers, facility conditions and inspecting conditions may be set up so to as reflect know-hows and experiences in a production facility department.

Furthermore, because individual production instruction tables are transmitted from the production information management computer 66 to the facility management computers and fixed items in the individual production instruction tables are automatically specified on the basis of the production plan data, manual labors required to enter items may be much less than if the manufacturing conditions were set up and entered individually for the facility management computers, and hence human errors with respect to the setting up of items may be minimized.

An information management function for managing information between the molding machine management computer 68 and the assembling machine management computer 70 and their production facilities will be described below.

Of the data of the production instruction table generated by the production information management computer 66, individual production instruction tables with respect to the molding machines 44, 46 are transmitted to the molding machine management computer 68, and displayed on its monitor display screen. The individual production instruction tables contain the amounts of raw materials to be supplied to the molding machines 44, 46 and their lot numbers. According to the amounts of raw materials and their lot numbers, the raw materials are automatically or semiautomatically charged into hoppers of the molding machines 44, 46. Bar codes that are applied to containers which store raw materials contain data indicative of the lot numbers of the raw materials and type codes of resin materials. When the raw materials are charged into hoppers of the molding machines 44, 46, the bar codes on the containers are read by bar-code readers, and the bar-code data are entered into the molding machine management computer 68.

The molding machine management computer 68 recognizes the lot numbers from the bar codes, and compares the recognized lot numbers with indicated lot numbers. After the molding process, the compared results are transmitted as molded data, together with the type codes of resin materials, to the production information management computer 66 and stored therein.

The molding machines 44, 46 operate under molding conditions indicated in the individual production instruction table to mold required numbers of upper and lower case members 16*a*, 16*b*. Certain numbers of molded upper and lower case members 16*a*, 16*b* are arrayed in respective trays. Individual tray ID numbers are applied as bar-code labels or magnetic information to the trays. When certain numbers of molded upper and lower case members 16*a*, 16*b* are stored in the trays and the trays are sent to an accumulator 74 (see FIG. 5), the tray ID numbers are read and entered into the molding machine management computer 68.

The molding machine management computer 68 associates the tray ID numbers with data indicative of production dates of the upper and lower case members 16*a*, 16*b* stored in the trays, lot numbers of the raw materials used, resin material type codes, and manufacturing conditions. To data thus obtained, there is added the order number of the production plan data. Thereafter, the data are transmitted to the production information management computer 66 and stored therein.

Figure 5:
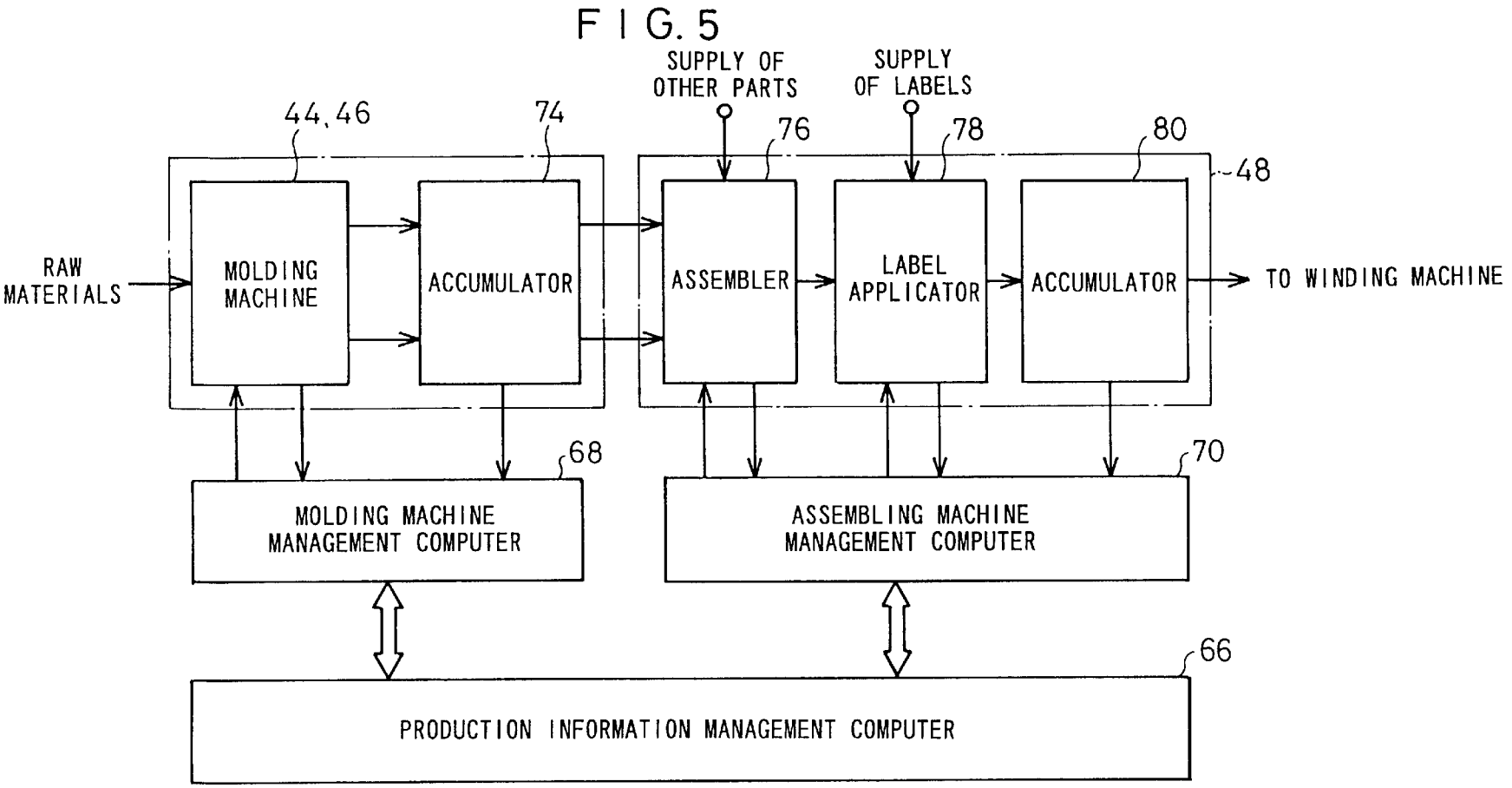
FIG. 5 is a block diagram schematically showing a process for manufacturing a cartridge case.

As shown in FIG. 5, the assembling machine management computer 70 manages a process carried out by the cartridge case assembling machine 48 which includes an assembler 76, a label applicator 78, and an accumulator 80 that are combined with the process controllers 70*a*, 70*b*, 70*c*, . . .

The production information management computer 66 supplies an individual production instruction table to the assembling machine management computer 70, receives tray ID numbers from the accumulator 74, and enters a tray ID number of a next tray to be delivered to the assembler 76.

The assembling machine management computer 70 enters a tray request signal containing the tray ID number into the assembler 76. The assembly 76 gives the tray request signal to a self-propelled carriage, which removes a tray having the indicated tray ID number from the accumulator 74 and delivers the tray to the assembler 76.

The assembler 76 picks up upper and lower case members 16*a*, 16*b* one by one from the delivered tray to start assembling cartridge cases 16. For delivering and picking up upper and lower case members 16*a*, 16*b*, there are employed a self-propelled carriage and a robot arm as disclosed in Japanese laid-open patent publication No. 9-146223.

The assembler 76 is also supplied with other parts including spools 22 and light shield lids 24. in addition to upper and lower case members 16*a*, 16*b*, from respective parts supply machines. These supplied other parts are also confirmed for their lot numbers and supplied quantities. The lot numbers of the supplied other parts are transmitted via the assembler 76 to the assembling machine management computer 70.

The assembler 76 assembles the supplied parts into cartridge cases 16 under the manufacturing conditions indicated by the individual production instruction table. The manufactured cartridge cases 16 are inspected for their appearance by an image inspector in the assembler 76, and any defective cartridge cases 16 are rejected.

Appearance inspecting conditions, e.g., whether all cartridge cases 16 or sampled cartridge cases 16 are to be inspected, sampling conditions if sampled cartridge cases 16 are to be inspected, and a threshold value used to determine acceptable and defective cartridge cases 16 are automatically determined by the individual production instruction table from the production information management computer 66.

Inspected data indicative of the percentage of defective cartridge cases 16 and measured values are fed back via the assembling machine management computer 70 to the production information management computer 66.

The label applicator 78 may comprise a device as disclosed in Japanese laid-open patent publication No. 8-262648, for example. The label applicator 78 serves to apply a label 32 to each of cartridge case 16 delivered from the assembler 76.

Figure 2:
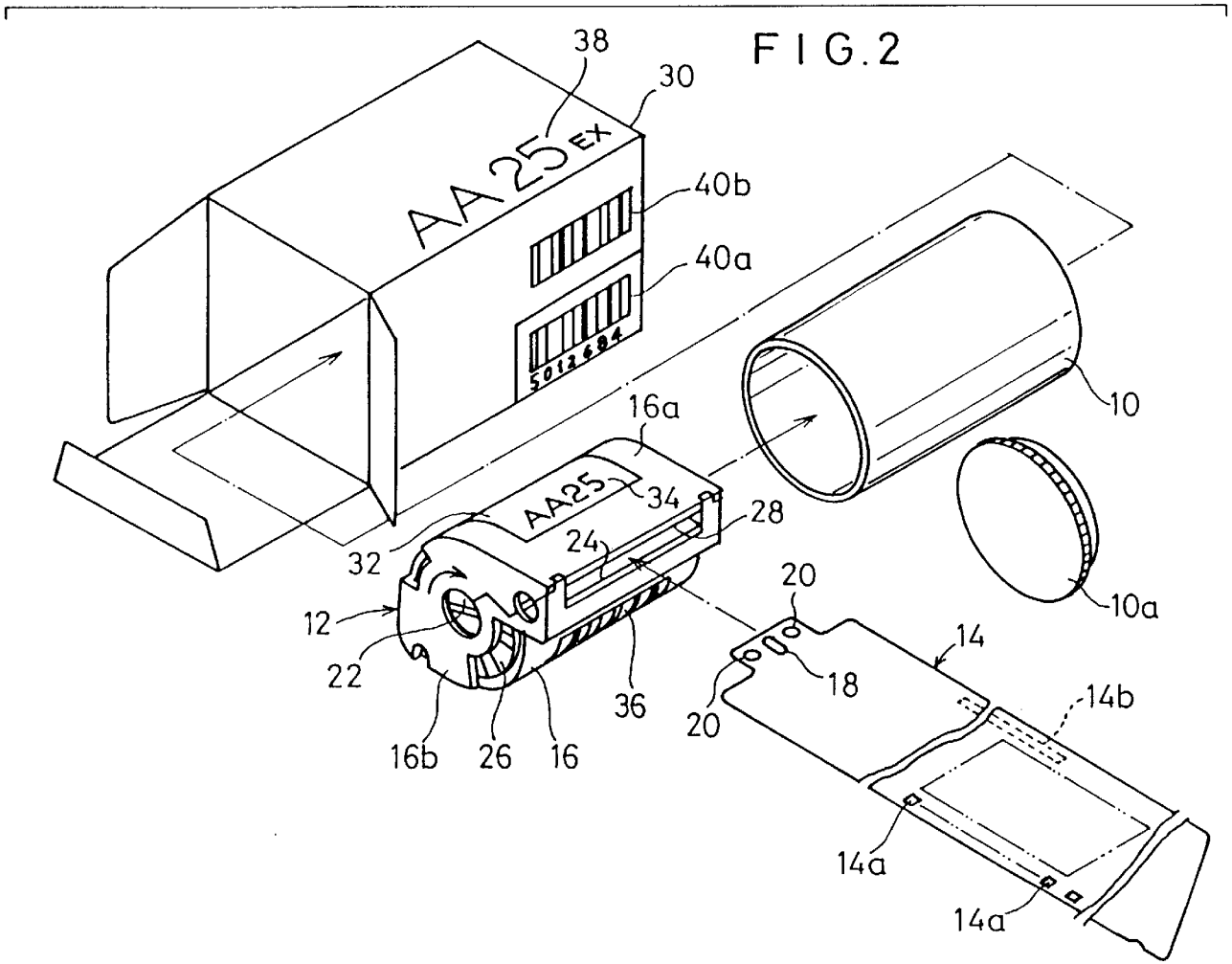
FIG. 2 is an exploded perspective view of a photographic film cartridge, and a magazine case and a small box which are used to package the photographic film cartridge.

As shown in FIG. 2, the label 32 has a bar code 36 indicative of a cartridge ID number in addition to the type of the photographic film, and also a string of numerals, e.g., 10 numerals, as a visual indication of the cartridge ID number, parallel to the bar code 36. The label 32 which has been printed is supplied from a label roll of paper which carries a series of labels, to the label applicator 78. Cartridge ID numbers on labels are sequential in the order in which the labels 32 are successively applied to cartridge cases 16. Each time a cartridge case 16 is delivered, a label 32 is applied to the cartridge case 16. Therefore, cartridge cases 16 are allotted cartridge ID numbers either sequentially or according to given rules in the order in which the cartridge cases 16 are assembled.

The range of cartridge ID numbers to be assigned to cartridge cases 16 being manufactured at present is managed by the production information management computer 66. Therefore, the individual production instruction table transmitted from the production information management computer 66 to the assembling machine management computer 70 contains data of lot numbers of label rolls and the range of cartridge ID numbers to be used so that labels 32 printed with cartridge ID numbers in the range will be supplied to the label applicator 78.

When applying a label 32 to a cartridge case 16, the cartridge ID number read from the label 32 and the cartridge ID number indicated in the individual production instruction table are compared with each other.

After a label 32 is applied to a cartridge case 16, the applied condition is inspected to optically confirm the position in which the label 32 is applied to the cartridge case 16 and to read the cartridge ID number from the bar code 36. When a label application failure is detected, the cartridge case 16 is rejected, and the cartridge ID number assigned to the cartridge case 16 is handled as an unavailable number. Information indicative of the inspected results is fed back via the assembling machine management computer 70 to the production information management computer 66.

Completed cartridge cases 16 are stored in a tray in the order in which their labels 32 have been applied, and the tray is sent to and stored in an accumulator 80. The number of cartridge cases 16 stored in the tray is the same as the number of upper and lower case members 16*a*, 16*b* stored in a tray. Therefore, if defective cartridge cases 16 are detected due to a label application failure, then the tray storing completed cartridge cases 16 lacks the number of those defective cartridge cases 16. The tray storing upper and lower case members 16*a*, 16*b* and the tray storing completed cartridge cases 16 may be of the same shape.

When the tray is delivered to the accumulator 80, the tray ID number of the tray is read, and entered into the assembling machine management computer 70. The assembling machine management computer 70 refers to the tray request signal given to the assembler 76 when the cartridge cases 16 stored in the tray were assembled, and associates the tray request signal with the tray ID number which housed the upper and lower case members 16*a*, 16*b*.

The tray ID number of the tray stored in the accumulator 80 is further associated with the lot numbers of other parts supplied to the assembler 76, the lot number of labels 32 supplied to the label applicator 78, the range of cartridge ID numbers used for acceptable cartridge cases 16, and cartridge ID numbers of rejected defective cartridge cases 16. After data of the type number of the cartridge case assembling machine 48, the production date, the manufacturing conditions, the inspecting conditions, the order number, and the abbreviated product name have been added, the tray ID number is transmitted from the assembling machine management computer 70 to the production information management computer 66 and stored therein.

Based on the above information management, the production information management computer 66 holds all the tray ID numbers of trays stored in the accumulator 80, recognizes the types and production histories of cartridge cases 16 stored in the trays with those tray ID numbers, and is capable of accurately identifying production plan data with order numbers based on which, and manufacturing conditions according to which, the cartridge cases 16 were manufactured.

FIG. 6 schematically shows an information management system for processes ranging from a process of manufacturing a photographic film strip 14 to a process of packaging photographic films in a corrugated box.

The production information management computer 66 manages a cutter management computer 82, the winding machine management computer 72, the outer shipping packaging machine management computer 84, and the packing machine management computer 86, which are used as facility management computers for the respective production facilities.

An individual production instruction table is transmitted from the production information management computer 66 to the cutter management computer 82, and displayed on a monitor display screen of the cutter management computer 82. The individual production instruction table contains the lot number of a master roll which matches the type of a product indicated in the production instruction data. The master roll with the lot number is selected from master rolls stored in a storage chamber is set on the cutter 42 by a robot arm and a self-propelled carriage.

The cutter management computer 82 transmits slitting conditions for the cutter 42, e.g., the speed of feed of the master roll, and set-up data of inspecting conditions for a surface inspecting device in the cutter 42, to give operating conditions for the cutter 42. The cutter 42 is now operated to cut the master roll into a width which is the same as the width of a photographic film strip 14, producing slit rolls.

At this time, a plurality of slit rolls are produced from one master roll. In order to identify these slit rolls, when each of the slit rolls is completed, labels each carrying a bar code representative of an emulsion number, the lot number of the master roll, and a slit number are applied to the core and the leader of each slit roll.

The bar code is automatically read by a bar-code reader or a handy bar-code reader operated by the operator, and the read bar-code data are entered into the cutter management computer 82.

An individual production instruction table transmitted to the winding machine management computer 72 contains the emulsion number of a slit roll to be used, the lot number of the master roll, and a slit number. An indicated slit roll is removed from the slit roll storage chamber by a handling device such as a robot arm, and set on an unwinder 88 in the winding machine 50.

If an elongate photographic film unwound from the preceding slit roll exists in the winding machine 50, the leading end of the elongate photographic film unwound from the newly set slit roll is spliced to the trailing end of the existing elongate photographic film. The bar code on the newly set slit roll is read to confirm whether the slit roll is the indicated slit roll or not. The used data of the existing slit roll is transmitted via the winding machine management computer 72 to the production information management computer 66.

The winding machine management computer 72 operates the winding machine 50 under conditions indicated by the individual production instruction table from the production information management computer 66. A perforator 90 forms perforations 14*a* in the elongate photographic film according to the format shown in FIG. 2. The number of perforations 14*a* is determined uniquely depending on the number of frames available for exposure of a photographic film cartridge 12 as a product. Data of the number of perforations 14*a* is contained in the individual production instruction table transmitted to the winding machine management computer 72. The perforator 90 perforates the elongate photographic film based on the data of the number of perforations 14*a* contained in the individual production instruction table.

The elongate photographic film which has been perforated by the perforator 90 is sent to a side printer 92, which prints, as a latent image, a bar code indicative of an ID number (film ID number) which is peculiar to a photographic film strip 14, a string of numerals as a visual indication of the film ID number, frame numbers, an abbreviated product name, and a manufacturer's name.

Of the above printed data, those data other than the film ID number may be specified in relation to the abbreviated product name when the production plan data are entered into the production information management computer 66. However, the film ID number needs to be the same as the cartridge ID number.

Therefore, at the stage in which the production information management computer 66 generates the production instruction table, the range of cartridge ID numbers used for labels 32 to be applied to cartridge cases 16 is confirmed, and the range of film ID numbers to be used is determined. It is also possible to determine the range of film ID numbers to be used at first and then use labels 32 that are allotted cartridge ID numbers in the range.

Film ID numbers thus determined are stored together with the order number of the production plan data in the production information management computer 66, and written in the individual production instruction table transmitted to the winding machine management computer 72. The side printer 92 prints in the side print area 14*b* according to the individual production instruction table transmitted to the winding machine management computer 72.

When the side printer 92 has printed a film ID number, the film ID number and other side print information are fed back to the winding machine management computer 72, which confirms whether the film ID number agrees with the film ID number indicated in the individual production instruction table or not.

The winding machine management computer 72 transmits other information obtained so far, i.e., the emulsion number, the lot number of the master roll, and the slit number, in association with the film ID number, to the production information management computer 66, which stores the transmitted information.

After the side printing process, a cutter 94 operates to cut off the elongate photographic film to a length depending on the number of frames available for exposure, thus producing a photographic film strip 14. In the winding machine 54, the elongate photographic film is fed at a predetermined speed, and the length fed is monitored by a rotary encoder. Therefore, the cutter 94 is actuated when the length of the elongate photographic film determined depending on the number of frames available for exposure is detected by the rotary encoder. Manufacturing conditions for operating the cutter 94 are contained in the individual production instruction table transmitted to the winding machine management computer 72.

When the elongate photographic film is cut off into the photographic film strip 14 by the cutter 94, a locking hole 18 and a pair of engaging holes 20 are formed in the trailing end of the photographic film strip 14, which is then fed, with the trailing end ahead, in the winding machine 50. A winder 96 is positioned downstream along a feed path for the photographic film strip 14, and supplied with a tray of assembled cartridge cases 16 from the accumulator 80 (see FIG. 5). At this time, the tray ID number given to the tray is read and entered via the winding machine management computer 72 into the production information management computer 66.

Since the production information management computer 66 stores cartridge ID numbers and production history information of the cartridge cases 16 stored in the tray in association with the tray ID number, the production information management computer 66 can confirm the range of cartridge ID numbers to be supplied to the winder 96, the order number based on which the cartridge cases 16 have been manufactured, and the lot numbers of parts which have been assembled into the cartridge cases 16.

When the cartridge cases 16 are successively supplied to the winder 96, the cartridge ID numbers are read from the bar codes on the labels 32. The read cartridge ID numbers are immediately entered into the winding machine management computer 72. The cartridge case 16 in the reading position is a cartridge case 16 to be combined with a photographic film strip 14 on which the side printer 92 is going to print. Therefore, the winding machine management computer 72 confirms the cartridge ID number immediately before the side printer 92 prints on the photographic film strip 14.

The cartridge ID number thus read is entered into the production information management computer 66, which compares the cartridge ID number with a film ID number to be assigned to the photographic film strip 14 by the side printer 92. Since the production information management computer 66 stores film ID numbers and cartridge ID numbers which are allotted to products to be manufactured when the production plan data are entered, as described above, the production information management computer 66 can decide whether the cartridge ID number of the cartridge case 16 supplied to the winder 96 is appropriate or not.

If the cartridge ID number is determined as appropriate by the production information management computer 66, the side printer 92 prints side print data entered from the production information management computer 66 via the winding machine management computer 72. Because the cartridge ID number and the film ID number are compared with each other immediately before the photographic film strip 14 and the cartridge case 16 are combined with each other, any disagreement between cartridge ID number and the film ID number is reliably prevented from happening.

Since cartridge ID numbers are sequentially assigned, if there is a cartridge case 16 which has been rejected as a defective cartridge case by an inspection carried out in the cartridge case assembling machine 48, then the cartridge ID number of the rejected cartridge case 16 is an unavailable cartridge ID number. Accordingly, if a cartridge ID number "100,002" to be read after a cartridge ID number "100,001" is not available, then a cartridge ID number "100,003" is entered into the production information management computer 66.

At this time, the production information management computer 66 detects a cartridge ID number problem. However, the production information management computer 66 has stored the cartridge ID number "100,002" of the cartridge case 16 which has been rejected as a defective cartridge case 16 in the cartridge case assembling machine 48, as an unavailable cartridge ID number. Therefore, when there is a cartridge ID number discontinuity, the production information management computer 66 refers to stored unavailable cartridge ID numbers to confirm the cartridge ID number discontinuity. In this case, a film ID number "100,002" is also processed as an unavailable film ID number, and will not be used. Processed data of such unavailable ID numbers are stored in production information management computer 66.

The winder 96 operates to engage the trailing end of the photographic film strip 14 with the spool 22 in the cartridge case 16. The spool 22 is actuated to wind the photographic film strip 14 into the cartridge case 16, after which the light shield lid 24 is closed to complete a photographic film cartridge 12.

Since the production history information of the photographic film strip 14 indicating the emulsion number, the lot number of the master roll, and the slit number is already known, the production history information of the cartridge case 16 and the photographic film strip 14 is stored in association with the cartridge ID number or the film ID number in the production information management computer 66.

The produced photographic film cartridge 12 is inserted into a magazine case 10 by a magazine case packaging mechanism 402 in the winding machine 50. A certain number of photographic film cartridges 12 inserted in magazine cases 10 are placed in a tray, which is stored in a tray storage facility 98. A number of such trays are stacked and stored in an accumulator 400.

At this time, tray ID numbers on the trays are read and entered into the winding machine management computer 72. The winding machine management computer 72 feeds used ID numbers and unavailable ID numbers (cartridge ID numbers or film ID numbers) of photographic film cartridges 12 in the trays, in association with the production history information, back to the production information management computer 66. The production information management computer 66 can thus recognize the ID numbers of the photographic film cartridges 12 stored in the tray storage facility 98, product types, and information such as production histories of the photographic film strips 14 and the cartridge cases 16, in association with the tray ID numbers.

The stacked trays are then delivered to the outer shipping packaging machine 62 where they are temporarily stored. Thereafter, a number of magazine cases 10 are removed one by one by a magazine case charging mechanism 100 and charged to a subsequent stage. The charged magazine cases 10 are aligned in one direction by a magazine case aligning mechanism 102 and packaged in small boxes 30 by a small outer shipping package producing mechanism 104. The outer shipping packaging machine 62 is managed by the outer shipping packaging machine management computer 84, which is in turn managed by the production information management computer 66 as with the other facility management computers.

The magazine cases 10 are of a common shape irrespective of the product types. However, a lot number of magazine cases 10 is indicated by the individual production instruction table from the production information management computer 66. The magazine case charging mechanism 100 transmits the lot number of used magazine cases 10 via the shipping packaging machine management computer 84 to the production information management computer 66.

As shown in FIG. 2, each small box 30 is printed with an indicia 38 indicative of the product type and a pair of bar codes 40*a*, 40*b*. The bar code 40*b* representative of the product type is printed when the small box 30 is manufactured. The bar code 40*a* representative of the package ID number is printed by a package ID number printing mechanism 142 after the small box 30 is supplied from a small box supply mechanism 106 to the small outer shipping package producing mechanism 104 and the magazine case 10 is inserted into the small box 30. The package ID number printing mechanism 142 may comprise an ink jet printer, a laser beam printer, or a heat transfer printer using an ink ribbon.

A package ID number to be printed by the package ID number printing mechanism 142 is determined by the production information management computer 66 when the production plan data is entered. As with the side printer 92 which prints film ID numbers, the package ID number printing mechanism 142 operates to print a package ID number after agreement between the cartridge ID number of the photographic film cartridge 12 to be packaged in the small box 30 and the transmitted package ID number is confirmed.

If the bar code 40*a* is printed in advance on the small box 30, then the range of package ID numbers to be used may be confirmed depending on the lot number of the small box 30 and stored in the production information management computer 66, so that a bar-code reader may be employed in place of the package ID number printing mechanism 142 and the production information management computer 66 may compare the cartridge ID number and the package ID number with each other when photographic film cartridge 12 is packaged in the small box 30.

With the package ID number assigned to the small box 30, the production history data of the photographic film cartridge 12 stored in the small box 30 can all be confirmed simply by reading the package ID number from the small box 30 after the photographic film cartridge 12 is shipped as a product.

If some quality failure is found in a photographic film cartridge 12 after it has been sold, then those photographic film cartridges 12 having the same production history can be recalled while being packaged in the small boxes 30. Package ID numbers may not necessarily be the same as cartridge ID numbers. If they are different, then data of correspondence between package ID numbers printed by the package ID number printing mechanism 142 and cartridge ID numbers applied to the photographic film cartridges 12 packaged in the small boxes 30 may be stored in the production information management computer 66. Small boxes 30 which store magazine cases 10 are put together into a pack of 5 small boxes, for example, and 10 packs are wrapped by a cellophane sheet in a pack production mechanism 110. Thereafter, the wrapped packs are delivered by a robot arm or the like to the packing machine 64 of the packaging system 60.

The packing machine 64 comprises a large outer shipping package producing mechanism 112, a corrugated box supply mechanism 200, and a pack ID printing mechanism 202. The packing machine 64 operates to pack 100 sets each of 10 packs of small boxes into a corrugated box. At this time, the corrugated box is printed on its surface with a bar code indicative of a pack ID number by the pack ID printing mechanism 202 which may comprise an ink jet printer, a laser beam printer, or a heat transfer printer.

As with the package ID number, the pack ID number is determined by the production information management computer 66. One pack ID number is assigned to the 100 sets packed in the corrugated box with respect to the range of package ID numbers printed by the package ID number printing mechanism 142. The relationship between pack ID numbers and package ID numbers is stored in the production information management computer 66.

Therefore, when the pack ID number is read from a corrugated box, the range of package ID numbers used on the products packed in the corrugated box can be recognized. Conversely, when a package ID number is specified, the corrugated box which stores the product with the specified package ID number can be recognized. As a result, any product can be traced while in distribution based on a package ID number, a cartridge ID number, or a film ID number.

The packaging system 60 according to the present invention will be described below with reference to FIGS. 7 through 17.

As shown in FIGS. 7 through 15, the packaging system 60 is basically four packaging lines (first through fourth packaging lines #1–#4). Each of the first through fourth packaging lines #1–#4 has the outer shipping packaging machine 62 and the packing machine 64.

The outer shipping packaging machine 62 in the first Am packaging line #1 comprises a magazine case charging mechanism 100 for storing magazine cases 10 to be charged into the first packaging line #1, of those magazine cases 10 supplied from the winding machine 50, picking up and charging the stored magazine cases 10 one by one to a subsequent stage, a magazine case aligning mechanism 102 for aligning a magazine case 10 charged by the magazine case charging mechanism 100 in one orientation, a small outer shipping package producing mechanism 104 (see FIGS. 8 and 10) for storing the magazine case 10 aligned by the magazine case aligning mechanism 102 in a predetermined pattern into a small box 30 thereby to produce a small outer shipping package, a small box supply mechanism 106 for supplying a small box 30 to the small outer shipping package producing mechanism 104, a manual supply mechanism 108 for supplying a manual to the small outer shipping package producing mechanism 104, a pack production mechanism 110 (see FIG. 11) for packing produced small outer shipping packages in a predetermined packing pattern and wrapping them with a transparent film thereby to produce a wrapped set of packs, and a large outer shipping package producing mechanism 112 (see FIG. 13) for collecting wrapped sets of packs in a predetermined collecting pattern into an assembly, and storing the assembly into a corrugated box there to produce a large outer shipping package. The magazine case charging mechanism 100 and the magazine case aligning mechanism 102 jointly constitute a magazine case supply system 114.

The magazine case charging mechanism 100 has a magazine case storing mechanism 120 in which a container or silo containing stored magazine cases 10 supplied from the winding machine 50 is detachably set, and a bar-code reader 122 for reading a bar code applied to the container or the silo set in the magazine case storing mechanism 120. Magazine cases 10 may directly be stored in a container or a silo, or stored in arrays in a container. A container or a silo stores magazine cases 10 of a single type, size, and lot packed by a preceding magazine case packaging mechanism.

The bar-code reader 122 reads a bar code applied to the container or the silo set in the magazine case storing mechanism 120, and transmits read bar-code data to the outer shipping packaging machine management computer 84 (see FIG. 6). The bar-code data transmitted to the outer shipping packaging machine management computer 84 is transmitted in its own data format or a converted data format to the production information management computer 66. The production information management computer 66 checks the bar-code data transmitted from the outer shipping packaging machine management computer 84 to decide whether a container or a silo containing a proper product type, size, and lot has been set in the magazine case storing mechanism 120. Bar-code information representative of such product type, size, and lot has been entered in advance into the production information management computer 66.

If a container or a silo containing a proper product type, size, and lot has been set in the magazine case storing mechanism 120, then the magazine cases 10 stored in the container or the silo are charged into the magazine case aligning mechanism 102. If a container or a silo containing a proper product type, size, and lot has not been set in the magazine case storing mechanism 120, then an error message is displayed on the monitor display screen of a terminal machine connected to the outer shipping packaging machine management computer 84 or the production information management computer 66, indicating to the operator that the container or the silo which has been set is inappropriate.

The operator can thus confirm that a wrong container or silo has been set in the first packaging line #1 before a packaging process begins, can avoid an unwanted packaging process, and can also quickly set a proper container or silo. Therefore, the time required to package products can be shortened, resulting in an increased throughput.

The magazine case aligning mechanism 102 comprises a conveyor 124 for delivering magazine cases 10 removed from a container or silo to a subsequent mechanism, a centrifugal feeder 126 for aligning a number of magazine cases 10 delivered by the conveyor 124 under centrifugal forces and discharging the magazine cases 10 one by one, and an erected case delivery mechanism 128 for delivering magazine cases 10 discharged one by one from the centrifugal feeder 126 in an erected condition, i.e., with the magazine case axis extending vertically.

When magazine cases 10 delivered by the conveyor 124 are aligned by the magazine case aligning mechanism 102, the magazine cases 10 are erected. The erected magazine cases 10 are delivered in an array to a subsequent mechanism. It is therefore possible to change the orientation of magazine cases 10 from the erected condition into various patterns, so that magazine cases 10 can easily be changed in orientation depending on the various shapes of small boxes 30 and placed into small boxes 30 in a subsequent packaging process.

Magazine cases 10 and caps 10a may be aligned vertically in one direction or at random. Magazine cases 10 may be aligned by being discharged from the centrifugal feeder 126, or being picked up directly from a container in which the magazine cases 10 are stored in arrays, or being picked up from a container by a scraping conveyor.

Figure 8:
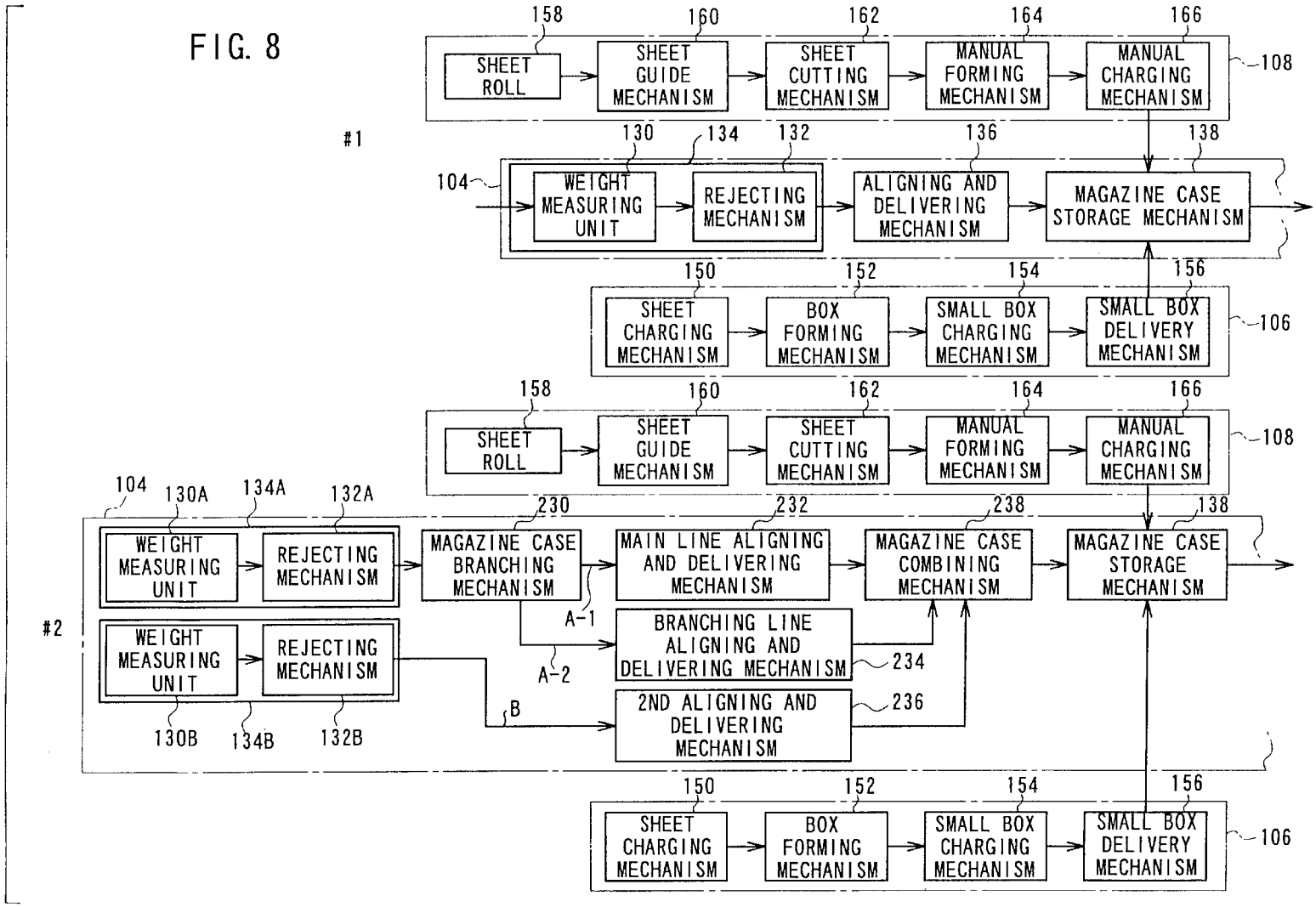
FIG. 8 is a block diagram of the outer shipping packaging machines of the first and second packaging lines of the packaging system, particularly, front halves of small outer shipping package production mechanisms.
Figure 9:
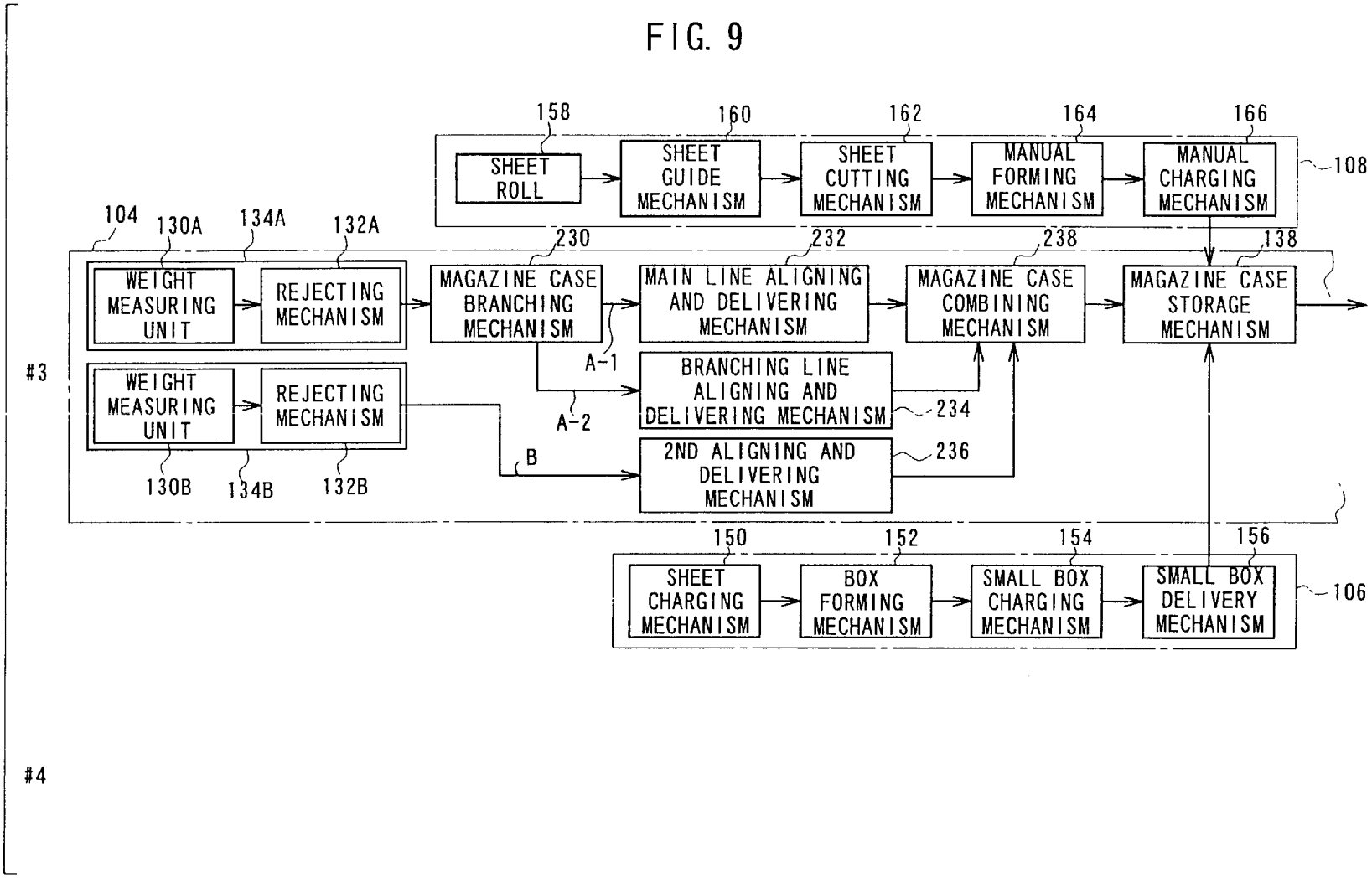
FIG. 9 is a block diagram of the outer shipping packaging machine of the third packaging line of the packaging system, particularly, front halves of small outer shipping package production mechanisms.
Figure 10:
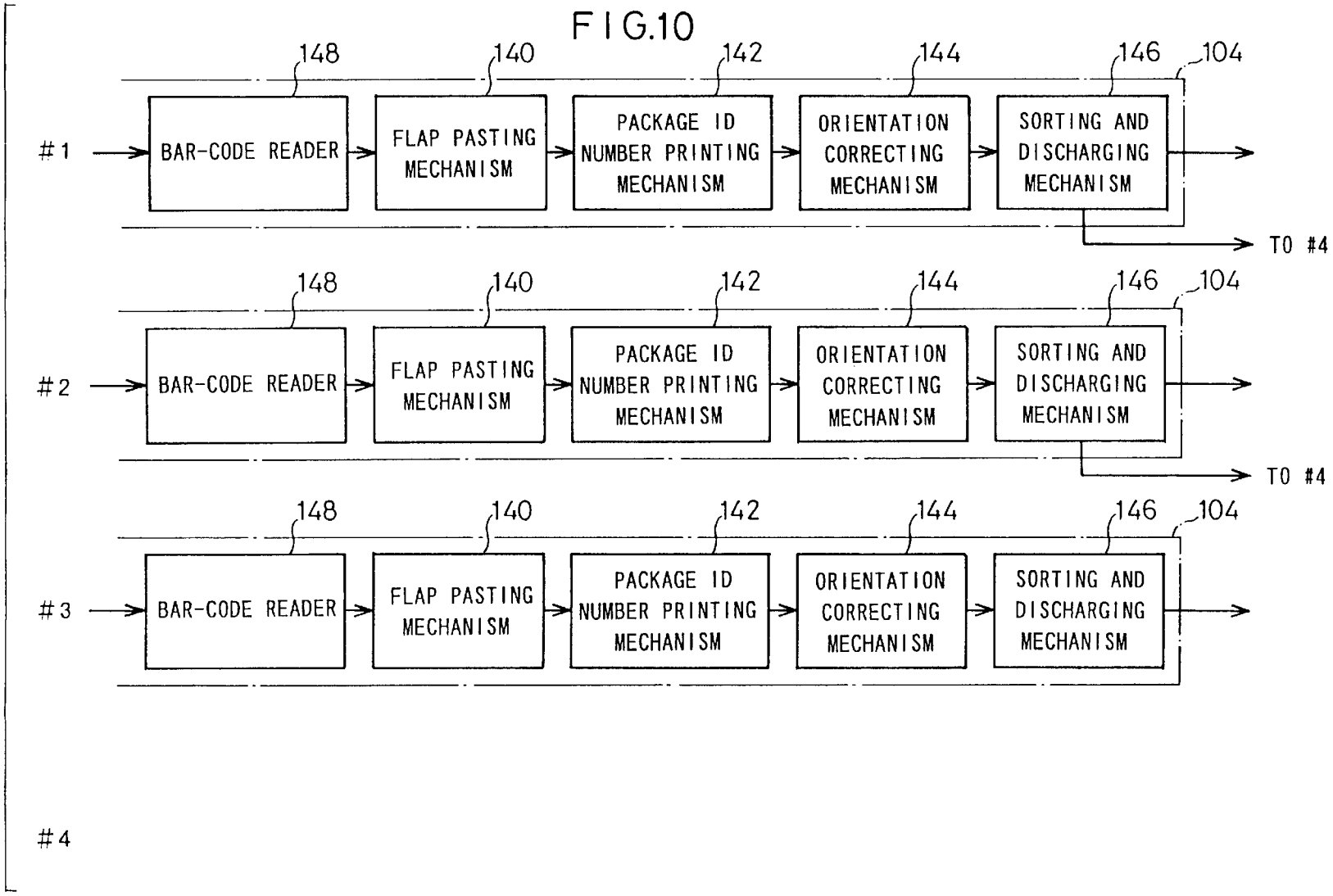
FIG. 10 is a block diagram of the outer shipping packaging machines of the first through third packaging lines of the packaging system, particularly, rear halves of the small outer shipping package production mechanisms.

The small outer shipping package producing mechanism 104 shown in FIGS. 8 and 10 has a size inspecting mechanism 134 which comprises a weight measuring unit 130 for measuring the weight of magazine cases 10 successively delivered from the magazine case aligning mechanism 102, and a rejecting mechanism 132 for rejecting a magazine case 10 being measured when an error signal is supplied from the outer shipping packaging machine management computer 84.

The weight measuring unit 130 measures the weight of each magazine case 10 and transmits measured data to the outer shipping packaging machine management computer 84. The outer shipping packaging machine management computer 84 identifies a size from the measured data from the weight measuring unit 130, decides whether the identified size matches a size set up in a preceding process, outputs a normal signal if the sizes match each other, and outputs an error signal if the sizes do not match each other. The normal signal or the error signal is supplied to the rejecting mechanism 132. If an error signal is issued from the outer shipping packaging machine management computer 84, then the rejecting mechanism 132 rejects a magazine case 10 being measured. If a normal signal is issued from the outer shipping packaging machine management computer 84, then the rejecting mechanism 132 does not reject a magazine case 10 being measured, but charges it into a subsequent mechanism.

The small outer shipping package producing mechanism 104 also has, in addition to the size inspecting mechanism 134, an aligning and delivering mechanism 136 for adjusting the number and orientation of magazine cases 10 depending on the number and storage pattern of small boxes 30 supplied from the small box supply mechanism 106, and delivering the magazine cases 10, a magazine case storage mechanism 138 for storing a plurality of magazine cases 10 or a single magazine 10 aligned by the aligning and delivering mechanism 136, in a predetermined storage pattern into small boxes 30 being delivered by a small box delivery mechanism 156 (described later on), a flap pasting mechanism 140 for applying an adhesive to flaps of a small box 30 in which a magazine case 30 has been stored, and pasting the flaps, a package ID number printing mechanism 142 for printing a package ID number in a predetermined position on a small box 30 with pasted flaps, an orientation correcting mechanism 144 for correcting the orientation of a small box 30 printed with package ID number through a predetermined angle of 90°, for example, and a sorting and discharging mechanism 146 for sorting and discharging orientation-corrected small boxes 30 to the first packaging line #1 and another packaging line such as the fourth packaging line #4.

The small outer shipping package producing mechanism 104 further includes a bar-code reader 148 positioned between the magazine case storage mechanism 138 and the flap pasting mechanism 140, for reading the bar code 40*a* on the surface of a small box 30.

The bar-code reader 148 reads a bar code 40*a* applied to the surface of a small box 30 which houses a magazine case 10, i.e., a small outer shipping package, and transmits read bar-code data to the outer shipping packaging machine management computer 84. The bar-code data transmitted to the outer shipping packaging machine management computer 84 is transmitted in its own data format or a converted data format to the production information management computer 66. The production information management computer 66 checks the bar-code data transmitted from the outer shipping packaging machine management computer 84 to decide whether the small box 30 matches an indicated type and size. Bar-code information representative of such product type and size has been entered in advance into the production information management computer 66.

If the small box 30 matches an indicated type and size, then the small outer shipping package is charged to the flap pasting mechanism 140. If the small box 30 does not match an indicated type and size, then the outer shipping packaging machine management computer 84 stops delivering the small outer shipping package. An error message is displayed on the monitor display screen of a terminal machine connected to the outer shipping packaging machine management computer 84 or the production information management computer 66, indicating to the operator that the small box 30 is not appropriate.

The operator can thus confirm that a wrong small box 30 has been charged to the first packaging line #1 before it starts being packed into a corrugated box, can avoid an unwanted packing process, and can also quickly set a proper small box 30. Therefore, the time required to pack products can be shortened, resulting in an increased throughput.

The aligning and delivering mechanism 136 aligns and delivers magazine cases 10 of a type and size established in advance by the production information management computer 66.

The package ID number printing mechanism 142 prints a film validity term and a lot number in a given position on a small box 30 based on a print command supplied from the production information management computer 66 via the outer shipping packaging machine management computer 84. The package ID number printing mechanism 142 may comprise a laser beam printer, an ink jet printer, a PC coder, or the like.

The orientation correcting mechanism 144 is a mechanism for orienting a small outer shipping package discharged from the package ID number printing mechanism 142 in the direction in which small boxes 30 will be packed in the pack production mechanism 110. The orientation correcting mechanism 144 serves to correct the orientation of a small outer shipping package based on an orientation correction angle indicated by orientation correction angle data supplied from the outer shipping packaging machine management computer 84. The orientation correction angle data is established on the basis of the type and size of a supplied small outer shipping package by the production information management computer 66, and supplied to the outer shipping packaging machine management computer 84.

For example, if the orientation of a small outer shipping package discharged from the package ID number printing mechanism 142 is the same as the direction in which small boxes 30 will be packed in the pack production mechanism 110, then the orientation correction angle is set to 0°. If the orientation of a small outer shipping package discharged from the package ID number printing mechanism 142 differs 90° from the direction in which small boxes 30 will be packed in the pack production mechanism 110, then the orientation correction angle is set to 90°. If a small outer shipping package needs to be reversed, then the orientation correction angle is set to 180°.

The sorting and discharging mechanism 146 may discharge one or more small boxes 30 at each time to the first and fourth packaging lines #1, #4, and may sort a small box 30 based on a discharge command signal from the first packaging line #1 and a discharge command signal from the fourth packaging line #4.

The small box supply mechanism 106 comprises a sheet charging mechanism 150 for storing a number of small box blank sheets and charging the small box blank sheets one by one, a box forming mechanism 152 for picking up a charged small box blank sheet and folding it into a small box 30, a small box charging mechanism 154 for charging the formed small box 30 to a subsequent mechanism, and a small box delivery mechanism 156 for delivering the small box 30 charged by the small box charging mechanism 154 in one direction.

The bar-code reader 148 has been illustrated as being positioned between the magazine case storage mechanism 138 and the flap pasting mechanism 140. However, the bar-code reader 148 may be positioned between the sheet charging mechanism 150 and the box forming mechanism 152, or between the box forming mechanism 152 and the small box charging mechanism 154, or between the small box charging mechanism 154 and the small box delivery mechanism 156. With the above alternative, since it is possible to reject an improper small box 30 before a magazine case 10 is placed into the small box 30, a proper small box 30 can be set quickly. Therefore, the time required to pack products can be shortened, resulting in an increased throughput.

The first packaging line #1 has the manual supply mechanism 108 for supplying a manual to be supplied together with a magazine case 10 into a small box 30. The manual supply mechanism 108 comprises a sheet guide mechanism 160 for unreeling an elongate paper sheet printed with successive instruction descriptions for photographic film from a sheet roll 158 and guiding the elongate paper sheet to a predetermined position, a sheet cutting mechanism 162 for cutting off the elongate paper sheet guided by the sheet guide mechanism 160 into a predetermined length, a manual forming mechanism 164 for folding the cut length according to a predetermined procedure into an instruction manual, and a manual charging mechanism 166 for charging the instruction manual between a magazine case 10 and a small box 30 which are being delivered. The manual charging mechanism 166 is arranged to charge the instruction manual between a magazine case 10 and a small box 30 which are being delivered. As the magazine case 10 moves toward the small box 30, the charged instruction manual is bent around the magazine case 10 and inserted with the magazine case 10 into the small box 30.

Figure 11:
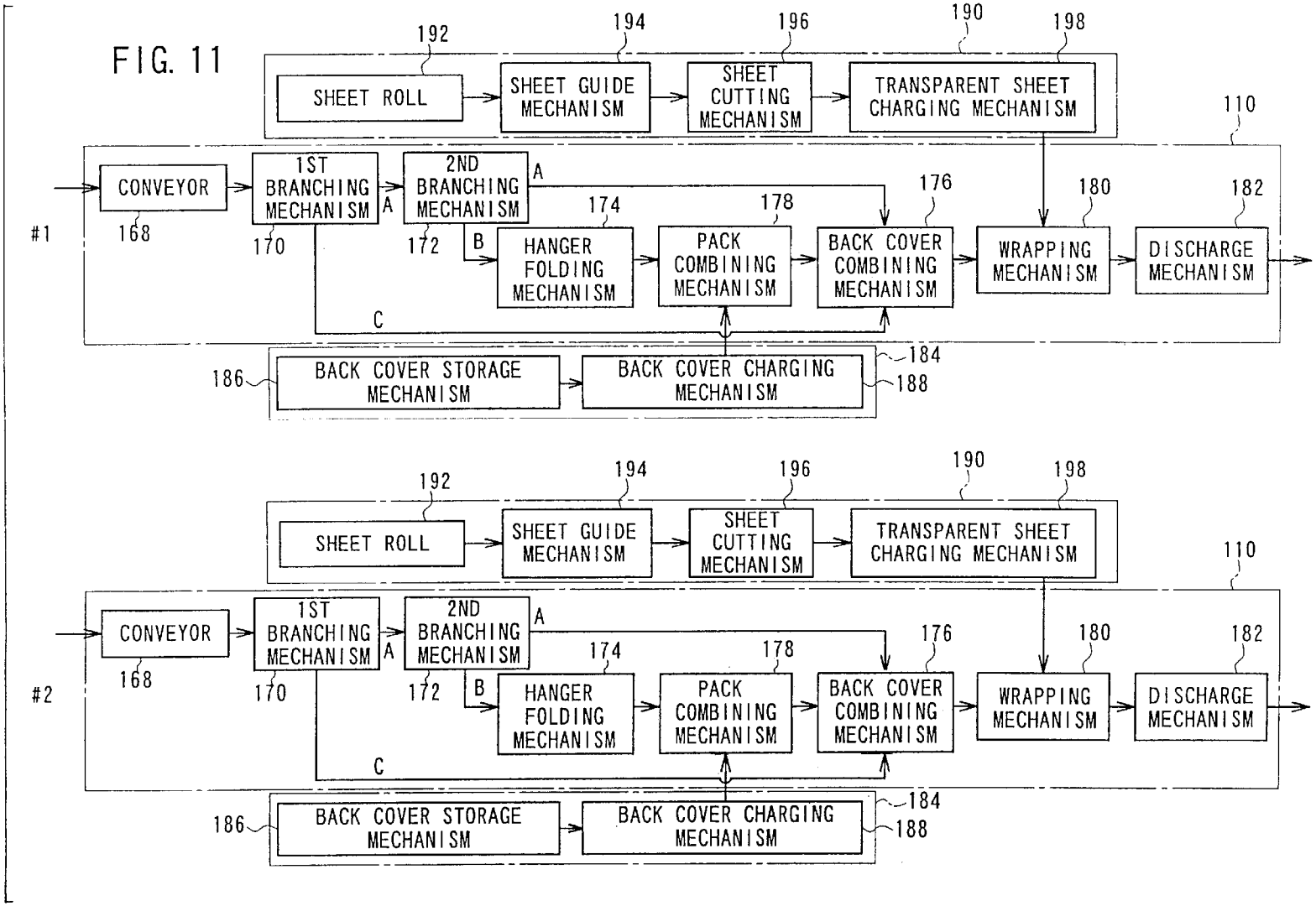
FIG. 11 is a block diagram of the outer shipping packaging machines of the first and second packaging lines of the packaging system, particularly, pack production mechanisms.

As shown in FIG. 11, the pack production mechanism 110 comprises a conveyor 168 for delivering small outer shipping packages charged from the sorting and discharging mechanism 146 to a subsequent mechanism, a first branching mechanism 170 for reversing, by 180°, a certain number of small outer shipping packages (one or more small outer shipping packages) of those small outer shipping packages which are successively delivered from the conveyor 168 and distributing the reversed small outer shipping packages to a branch line C (see FIG. 17), a second branching mechanism 172 for distributing all or some of the small outer shipping packages distributed to a main line A by the first branching mechanism 170, laterally to a branch line B, a hanger folding mechanism 174 for folding hangers projecting an end of a pack if a pack of small outer shipping packages delivered along the branch line B comprises a pack of small boxes with hangers, a pack combining mechanism 178 for combining packs delivered along the main line A and the branch lines B. C with each other according to a pattern which has been established in advance by the production information management computer 66, a back cover combining mechanism 176 for combining the back of a pack with a back cover, a wrapping mechanism 180 for wrapping the combined packs from the pack combining mechanism 178 with a transparent film, and a discharge mechanism 182 for discharging the wrapped packs to a subsequent mechanism. Packs delivered along the branch line A are vertically inverted by a command from the outer shipping packaging machine management computer while the packs are being delivered.

The back cover is supplied from a back cover supply mechanism 184 to the back cover combining mechanism 176. The back cover supply mechanism 184 has a back cover storage mechanism 186 for storing a number of back covers, and a back cover charging mechanism 188 for removing back covers one by one from the back covers stored by the back cover storage mechanism 186 and charging removed back covers to the back cover combining mechanism 176.

The transparent film is supplied from a transparent film supply mechanism 190 to the wrapping mechanism 180. The transparent film supply mechanism 190 comprises a sheet guide mechanism 194 for unreeling an elongate transparent film sheet from a sheet roll 192 and guiding the elongate transparent film sheet to a predetermined position, a sheet cutting mechanism 196 for cutting off the transparent film sheet guided by the sheet guide mechanism 194 into a predetermined length, and a transparent sheet charging mechanism 198 for charging a cut transparent sheet to the wrapping mechanism 180.

Figure 13:
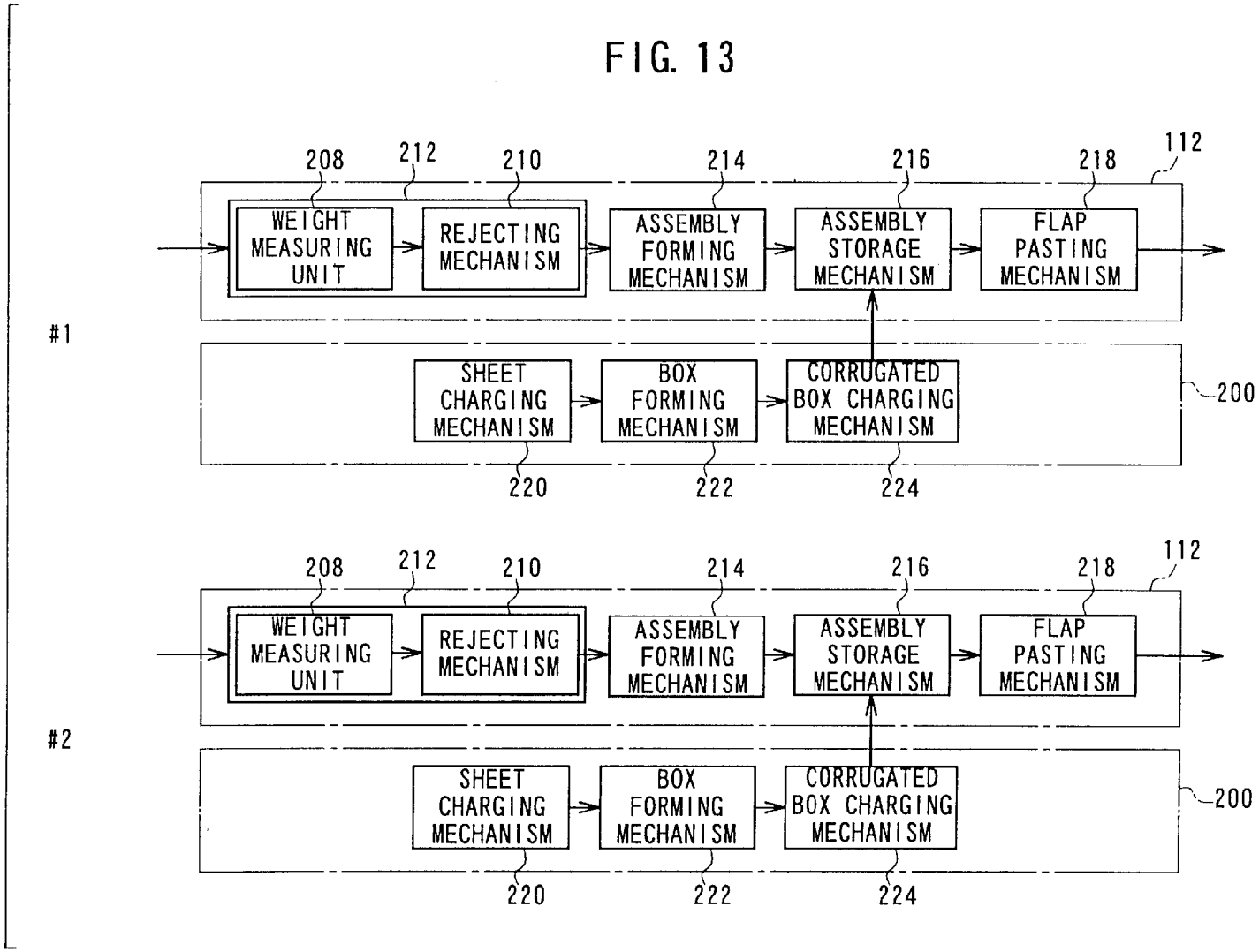
FIG. 13 is a block diagram of packing machines of the first and second packaging lines of the packaging system, particularly, large outer shipping package producing mechanisms.

As shown in FIG. 13, the packing machine 64 in the first packaging line #1 comprises a large outer shipping package producing mechanism 112 for collecting wrapped sets of packs charged from the preceding outer shipping packaging machine 62, in a predetermined collecting pattern into an assembly and then placing the assembly in a corrugated box thereby to produce a large outer shipping package, a corrugated box supply mechanism 200 for supplying a corrugated box to the large outer shipping package producing mechanism 112, a pack ID printing mechanism 202 (see FIG. 15) for printing a pack ID number on the surface of a large outer shipping package, and a large outer shipping package delivery mechanism 204 for delivering a large outer shipping package printed with a pack ID number to a final pallet stacking process 206.

The large outer shipping package producing mechanism 112 has a number inspecting mechanism 212 which comprises a weight measuring unit 203 for measuring the weight of packs successively delivered from the discharge mechanism 182 of the outer shipping packaging machine 62, and a rejecting mechanism 210 for rejecting a pack being measured when an error signal is supplied from the outer shipping packaging machine management computer 84.

The weight measuring unit 208 measures the weight of each pack and transmits measured data to the outer shipping packaging machine management computer 84. The outer shipping packaging machine management computer 84 identifies the number of small outer shipping packages from the weight measuring unit 208, decides whether the identified number matches a number set up in a preceding process, outputs a normal signal if the numbers match each other, and outputs an error signal if the numbers do not match each other. The normal signal or the error signal is supplied to the rejecting mechanism 210. If an error signal is issued from the outer shipping packaging machine management computer 84, then the rejecting mechanism 210 rejects a pack being measured. If a normal signal is issued from the outer shipping packaging machine management computer 84, then the rejecting mechanism 210 does not reject a pack being measured, but charges it into a subsequent mechanism.

The large outer shipping package producing mechanism 112 also has an assembly forming mechanism 214 for collecting packs judged as normal by the number inspecting mechanism 212 into an assembly according to a collecting pattern established in advance by the production information management computer 66, an assembly storage mechanism 216 for storing the assembly in a predetermined storing pattern into a corrugated box, and a flap pasting mechanism 218 for applying an adhesive to flaps of the corrugated box in which an assembly has been stored, and pasting the flaps thereby to form a large outer shipping package.

The corrugated box supply mechanism 200 comprises a sheet charging mechanism 220 for storing a number of corrugated box blank sheets and charging the corrugated box blank sheets one by one, a box forming mechanism 222 for picking up a discharged corrugated box blank sheet and folding it into a corrugated box, and a corrugated box charging mechanism 224 for charging the formed corrugated box to the assembly storage mechanism 216 of the large outer shipping package producing mechanism 112.

The second packaging line #2 will be described below. The second packaging line #2 is of substantially the same arrangement as the first packaging line #1, but differs therefrom in that the outer shipping packaging machine 62 has two magazine case supply systems 114A, 114B. Therefore, the small outer shipping package producing mechanism 104 of the second packaging line #2 has two size inspecting mechanism, i.e., first and second size inspecting mechanism 134A, 134B. Those parts of the second packaging line #2 which are identical to those of the first packaging line #1 are denoted by identical reference characters, and will not be described below.

As shown in FIG. 8, the second packaging line #2 has, between the first and second size inspecting mechanism 134A, 134B and the magazine case storage mechanism 138 of the small outer shipping package producing mechanism 104, a magazine case branching mechanism 230 for distributing magazine cases 10 successively delivered from the first size inspecting mechanism 134A, one by one between a main line A-1 and a branch line A-2 (see FIG. 16), a main line aligning and delivering mechanism 232 for aligning magazine cases 10 distributed to the main line A-1 and delivering the magazine cases 10 to a subsequent mechanism, a branch line aligning and delivering mechanism 234 for aligning magazine cases 10 distributed to the branch line A-2 and delivering the magazine cases 10 to a subsequent mechanism, a second aligning and delivering mechanism 236 for aligning magazine cases 10 successively delivered from the second size inspecting mechanism 134B to an auxiliary line B (see FIG. 16) and delivering the magazine cases 10 to a subsequent mechanism, and a magazine case combining mechanism 238 for combining magazine cases 10 delivered by the main line aligning and delivering mechanism 232 and the branch line aligning and delivering mechanism 234 and magazine cases 10 delivered by the second aligning and delivering mechanism 236 according to a combining pattern established in advance by the production information management computer 66.

The sorting and discharging mechanism 146 in the second packaging line #2 shown in FIG. 10 may discharge one or more small boxes 30 at each time to the second and fourth packaging lines #1, #4, and may sort a small box 30 based on a discharge command signal from the second packaging line #2 and a discharge command signal from the fourth packaging line #4.

As shown in FIG. 11, the pack production mechanism 110 in the second packaging line #2 is of the same structure as the pack production mechanism 110 in the first packaging line #1, and will not be described in detail below.

The third packaging line #3 will be described below. The third packaging line #3 is of substantially the same arrangement as the second packaging line #2, but differs therefrom in that the third packaging line #3 does not sort and discharge (branch) small boxes 30 to the fourth packaging line #4. Those parts of the third packaging line #3 which are identical to those of the second packaging line #2 are denoted by identical reference characters, and will not be described below.

Figure 12:
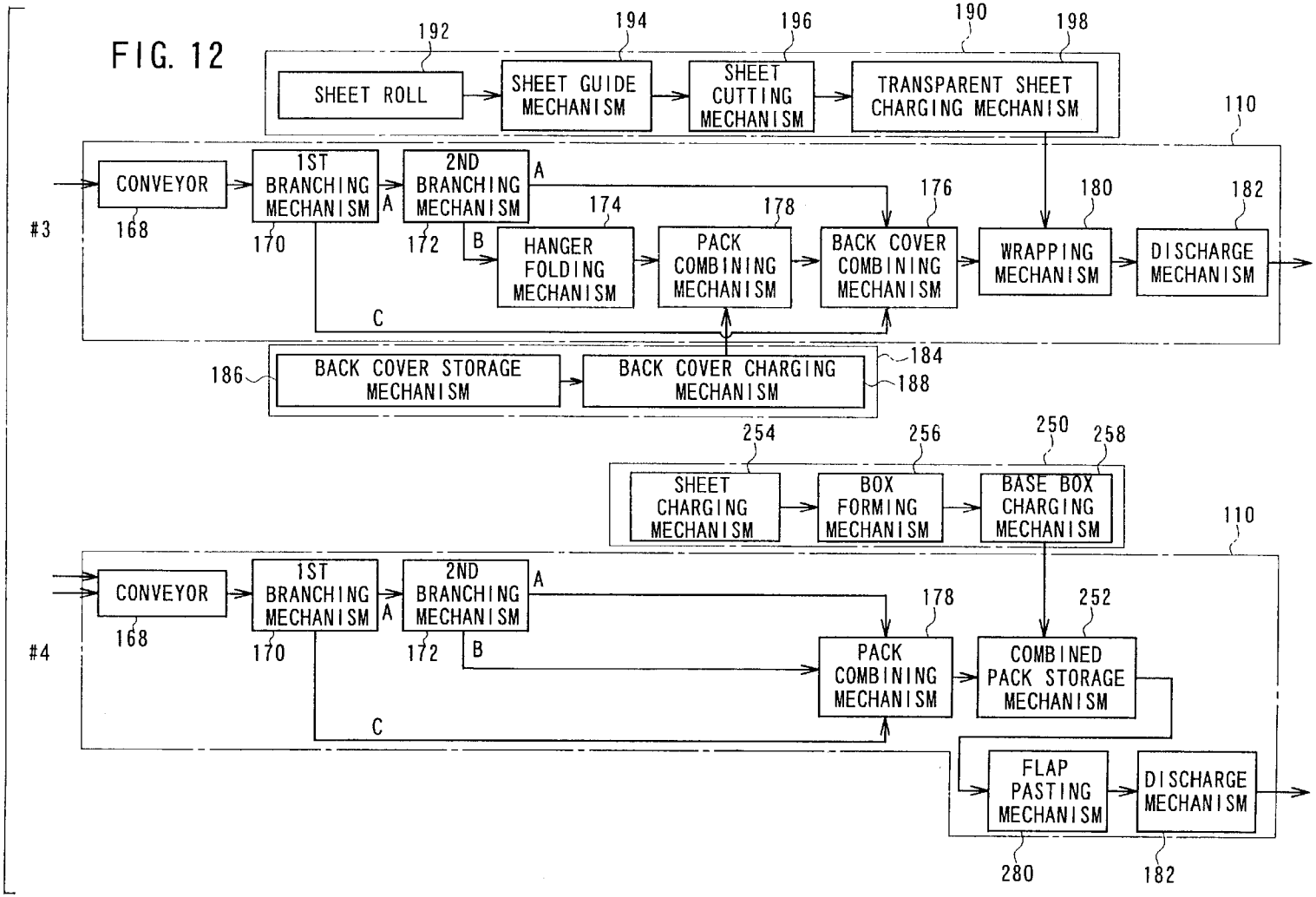
FIG. 12 is a block diagram of the outer shipping packaging machines of the third and fourth packaging lines of the packaging system, particularly, pack production mechanisms.

The fourth packaging line #4 will be described below. The fourth packaging line #4 has a line structure different from the first through third packaging lines #1–190 3. As shown in FIG. 12, the fourth packaging line #4 largely differs from the first through third packaging lines #1–#3 in that the fourth packaging line #4 begins with a mechanism (pack production mechanism) 110 for packing small outer shipping packages selectively discharged from the first packaging line #1 and small outer shipping packages selectively discharged from the second packaging line #2.

Specifically, the fourth packaging line #4 has a pack production mechanism 110 for packing small outer shipping packages selectively discharged from the sorting and discharging mechanism 146 (see FIG. 10) of the small outer shipping package producing mechanism 104 in the first packaging line #1 and small outer shipping packages selectively discharged from the sorting and discharging mechanism 146 of the small outer shipping package producing mechanism 104 in the second packaging line #2, according to a packing pattern established in advance by the production information management computer 66, and storing the packed small outer shipping packages in a base box thereby to produce a pack, and a base box supply mechanism 250 for supplying a base box to the pack production mechanism 110.

As shown in FIG. 12, the pack production mechanism 110 comprises a conveyor 168 for delivering small outer shipping packages from the first packaging line #1 and small outer shipping packages from the second packaging line #2 to a subsequent mechanism, a first branching mechanism 170 for reversing, by 180°, a certain number of small outer shipping packages (one or more small outer shipping packages) of those small outer shipping packages which are successively delivered from the conveyor 168 and distributing the reversed small outer shipping packages to a branch line C, a second branching mechanism 172 for distributing all or some of the small outer shipping packages distributed to a main line A by the first branching mechanism 170, laterally to a branch line B, a pack combining mechanism 178 for combining packs delivered along the main line A and the branch lines B, C with each other according to a pattern which has been established in advance by the production information management computer 66, a combined pack storage mechanism 252 for storing a combined pack into a base box supplied from the base box supply mechanism 250, a flap pasting mechanism 280 for applying an adhesive to flaps of the base box in which the combined pack has been stored, and pasting the flaps, and a discharge mechanism 182 for discharging the combined pack stored in the base box to a subsequent mechanism.

The base box supply mechanism 250 comprises a sheet charging mechanism 254 for storing a number of base box blank sheets and charging the base box blank sheets one by one, a box forming mechanism 256 for picking up a charged base box blank sheet and folding it into a base box, and a base box charging mechanism 258 for charging the formed base box to the combined pack storage mechanism 252 of the pack production mechanism 110.

Figure 14:
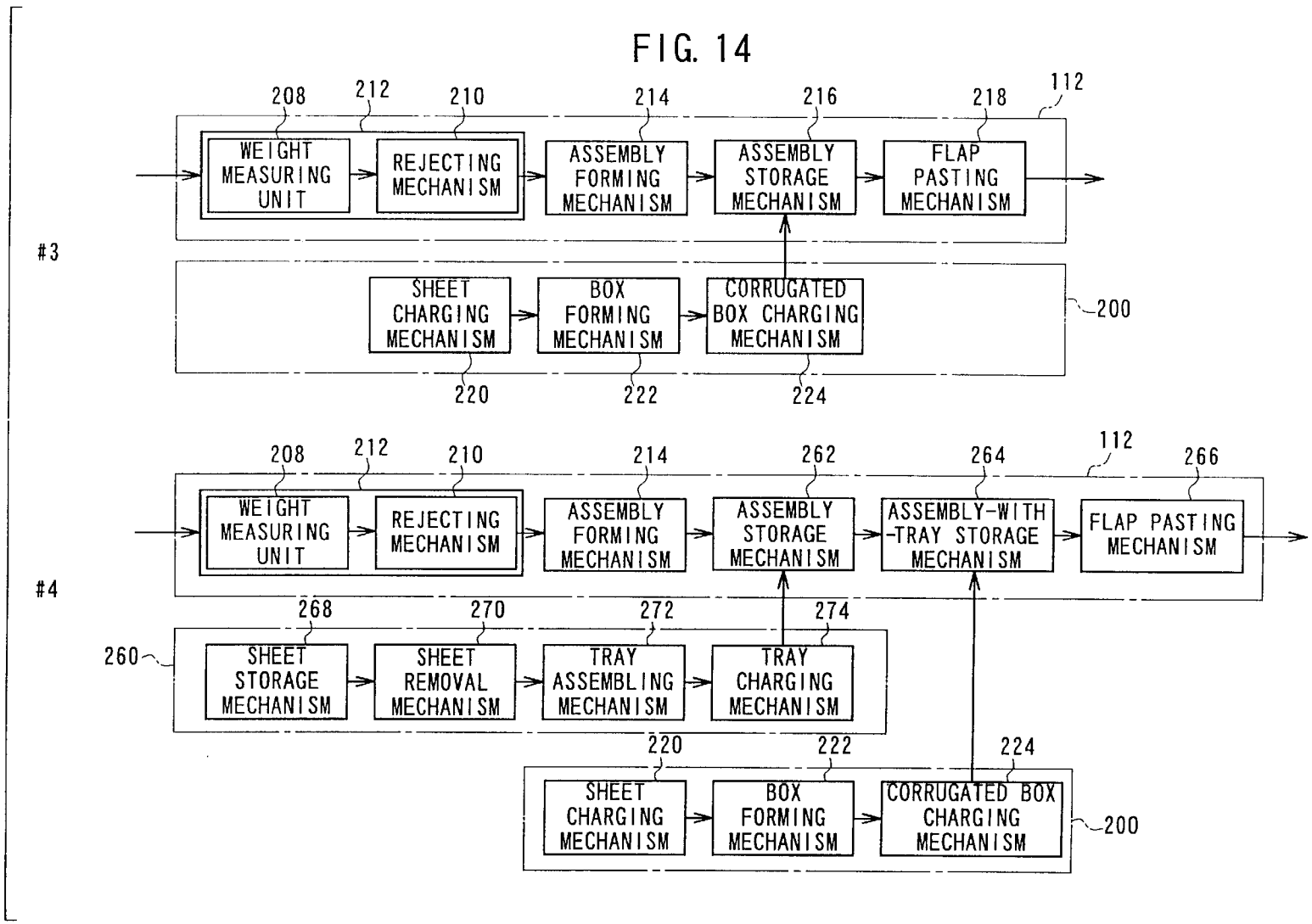
FIG. 14 is a block diagram of packing machines of the third and fourth packaging lines of the packaging system, particularly, large outer shipping package producing mechanisms.
Figure 15:
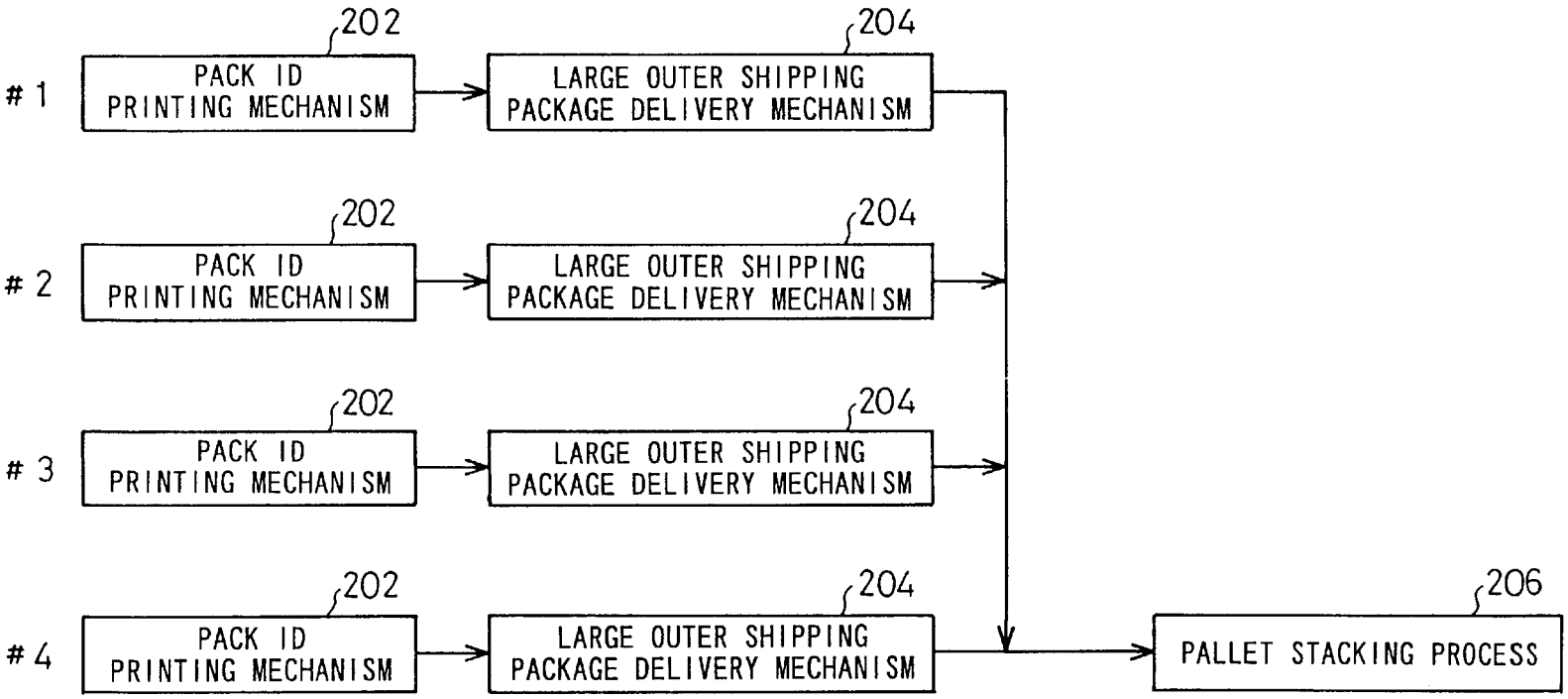
FIG. 15 is a block diagram of the packing machines of the first through fourth packaging lines of the packaging system, particularly, pack ID printing mechanisms and large outer shipping package feed mechanisms.
Figure 16:
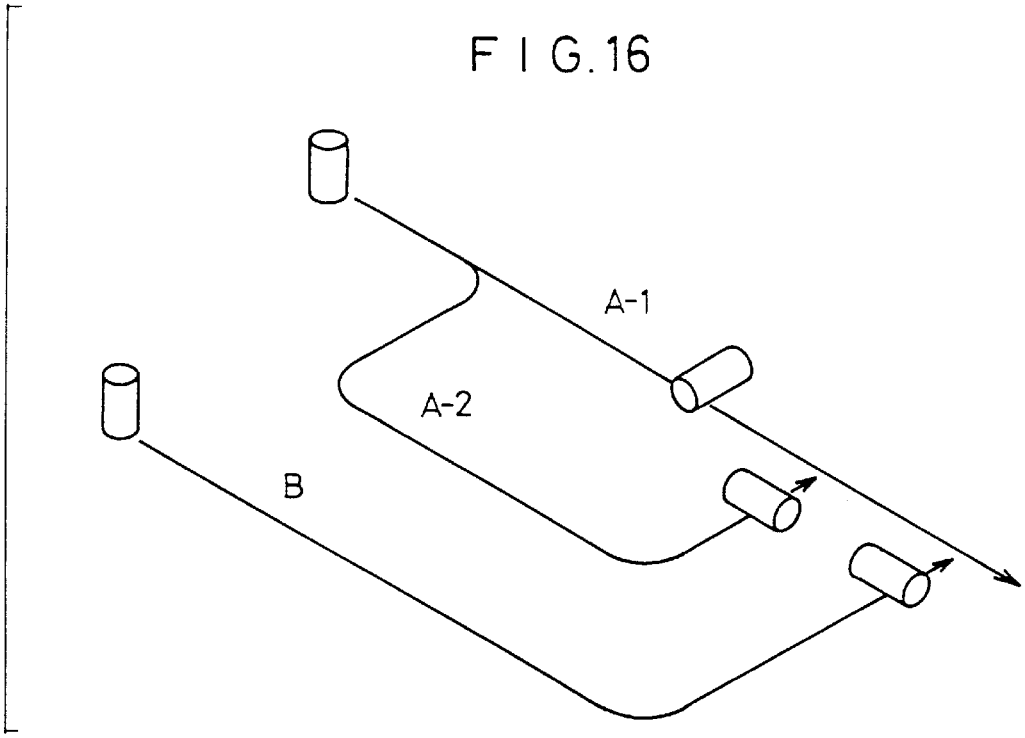
FIG. 16 is a schematic perspective view showing branched and combined flows at mechanisms in the second and third packaging lines.
Figure 17:
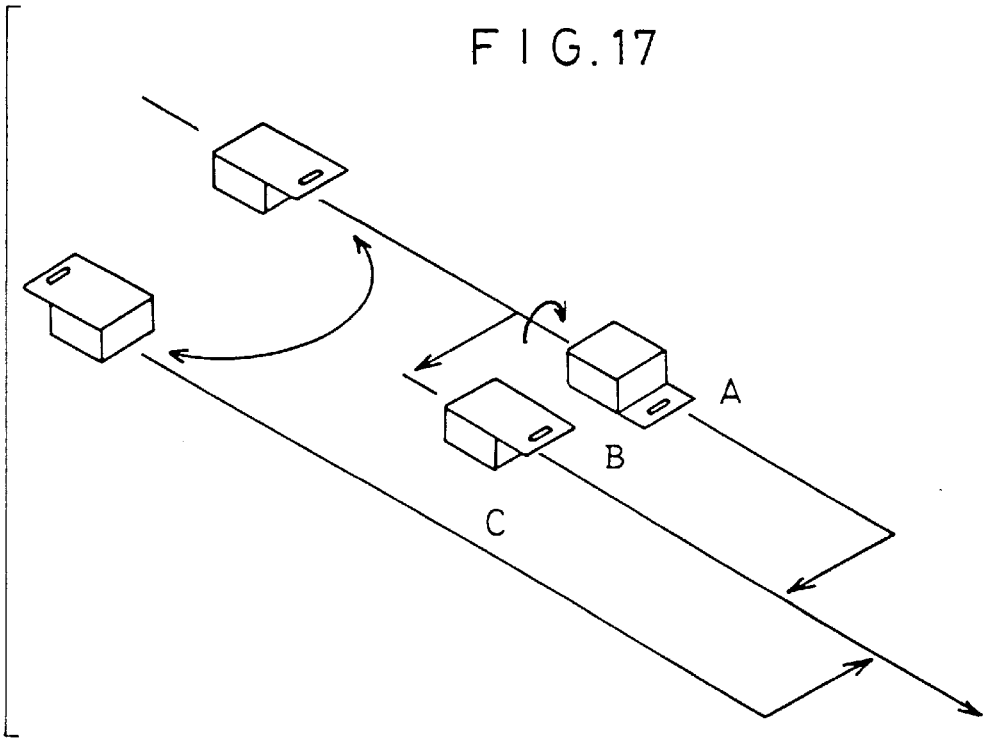
FIG. 17 is a schematic perspective view showing branched flows at pack forming mechanisms in the first through fourth packaging lines.

As shown in FIG. 14, the packing machine 64 in the fourth packaging line #4 comprises a large outer shipping package producing mechanism 112 for collecting wrapped sets of packs charged from the preceding outer shipping packaging machine 62, in a predetermined collecting pattern into an assembly and then placing the assembly in a corrugated box thereby to produce a large outer shipping package, a corrugated box supply mechanism 200 for supplying a corrugated box to the large outer shipping package producing mechanism 112, a tray supply mechanism 260 for supplying a tray to the large outer shipping package producing mechanism 112, a pack ID printing mechanism 202 (see FIG. 15) for printing a pack ID number on the surface of a large outer shipping package, and a large outer shipping package delivery mechanism 204 for delivering a large outer shipping package printed with a pack ID number to the final pallet stacking process 206.

As shown in FIG. 14, the large outer shipping package producing mechanism 112 has a number inspecting mechanism 212 which is of the same structure as the number inspecting mechanism 212 of the packing machine 64 in the first packaging line #1, an assembly forming mechanism 214 for collecting packs judged as normal by the number inspecting mechanism 212 into an assembly according to a collecting pattern established in advance by the production information management computer 66, an assembly storage mechanism 262 for storing the assembly into a tray supplied from the tray supply mechanism 260, an assembly-with-tray storage mechanism 264 for storing an assembly with a tray in a predetermined storage pattern into a corrugated box, and a flap pasting mechanism 266 for applying an adhesive to flaps of the corrugated box in which an assembly with a tray has been stored, and pasting the flaps thereby to form a large outer shipping package.

The corrugated box supply mechanism 200 is of the same structure as the corrugated box supply mechanism 200 in the first packaging line #1. The tray supply mechanism 260 comprises a sheet storage mechanism 268 for storing a number of tray blank sheets, a sheet removal mechanism 270 for picking up tray blank sheets one by one from the tray blank sheets stored by the sheet storage mechanism 268, a tray assembling mechanism 272 for assembling a tray blank sheet into a tray, and a tray charging mechanism 274 for charging an assembled tray to the assembly storage mechanism 262 of the large outer shipping package producing mechanism 112.

Packaging operation in the first through fourth packaging lines #1–#4 will be described below with reference to FIGS. 18 through 27.

Figure 18:
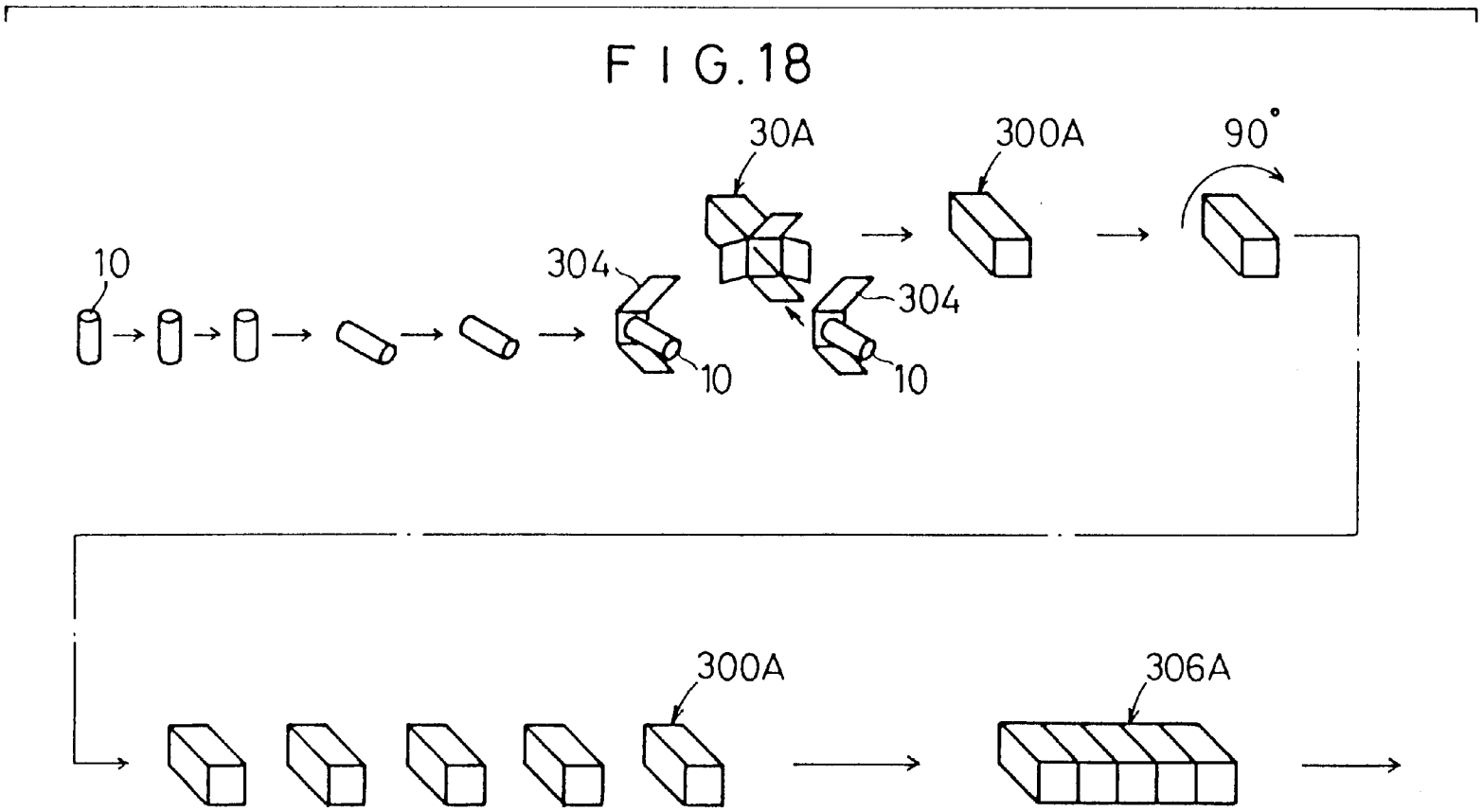
FIG. 18 is a schematic perspective view illustrative of a packaging process in a first packaging line for horizontally storing a magazine case into a small box free of a hanger (ordinary small box) to produce a small outer shipping package and combining a plurality of small outer shipping packages into a pack.

First, packaging operation in the first packaging line #1 for horizontally placing a magazine case 10 into a small box 30A free of a hanger (ordinary small box) thereby to produce a small outer shipping package 300A and packing a number of small outer shipping packages 300A into a corrugated box, will be described below with reference to FIGS. 18 and 19.

A container or silo storing a number of magazine cases 10 to be charged to the first packaging line #1 is set on the magazine case storing mechanism 120, and simultaneously it is decided whether a container or silo of a proper product type, size, and lot has been set, through the bar-code reader 122.

If a container or silo of a proper product type, size, and lot has been set, then magazine cases 10 are removed from the container or silo by the magazine case storing mechanism 120. The removed magazine cases 10 are then delivered by the conveyor 124 to the centrifugal feeder 126, which aligns the magazine cases 10 into an array and charges them to the erected case delivery mechanism 128. The erected case delivery mechanism 128 erects magazine cases 10 charged one by one, and delivers the erected magazine cases 10 to the size inspecting mechanism 134 of the small outer shipping package producing mechanism 104.

The magazine cases 10 charged to the size inspecting mechanism 134 are inspected for size by the weight measuring unit 130. Only those magazine cases 10 which have matched a desired size are charged to the aligning and delivering mechanism 136. The magazine cases 10 charged to the aligning and delivering mechanism 136 are changed in orientation by the aligning and delivering mechanism 136, and delivered to the magazine case storage mechanism 138. Specifically, the magazine cases 10 are changed from the erected orientation (with the axes extending vertically) to an orientation in which their axes extend parallel to the horizontal direction and perpendicularly to the delivery direction, after which the magazine cases 10 are delivered to the magazine case storage mechanism 138.

To the magazine case storage mechanism 138, there are also supplied small boxes 30A from the small box supply mechanism 106 and manuals 304 from the manual supply mechanism 108. The small box charging mechanism 154 of the small box supply mechanism 106 charges small boxes 30A produced by the box forming mechanism 152 into the small box delivery mechanism 156 such that the longitudinal axis of each of the small boxes 30A, which extends from an open flap end to a closed bottom end thereof, is aligned with the axial direction of one of the magazine cases 10, with flaps being open. The small box delivery mechanism 156 delivers the charged small boxes 30A in their charged orientation in synchronism with the delivery of the magazine cases 10 by the aligning and delivering mechanism 136. The open flap end of small boxes 30 will hereinafter referred to as an open end, and a hypothetical line extending through the center of the open end toward the closed bottom end of the small boxes 30 will hereinafter referred to as a central axis of the small boxes 30.

When the central axis of a small box 30A and the central axis of a magazine case 10 are aligned with each other, the magazine case storage mechanism 138 pushes the magazine case 10 into the small box 30A to store the magazine case 10 in the small box 30A. A manual 304 is supplied from the manual supply mechanism 108 immediately before the magazine case 10 is pushed into the small box 30A. Therefore, the magazine case 10 and the manual 304 are stored in the small box 30A.

The small box 30A in which the magazine case 10 has been stored is checked to ascertain whether it is of a proper type, size, and lot through the bar-code reader 148. If the small box 30A is of a proper type, size, and lot, then the open flaps are pasted by the flap pasting mechanism 140, thus producing a small outer shipping package 300A. Thereafter, the small outer shipping package 300A is printed with a package ID number by the package ID number printing mechanism 142, and its orientation is corrected by the orientation correcting mechanism 144. In FIG. 18, the orientation correction angle is 90° as indicated by the arrow.

Thereafter, the small outer shipping package 300A is supplied to the pack production mechanism 110. Several small outer shipping packages 300A are packed in a predetermined packing pattern by the conveyor 168 in the pack production mechanism 110. In FIG. 18, five small outer shipping packages 300A are packed into a pack 306A without changing their orientation.

Figure 19:
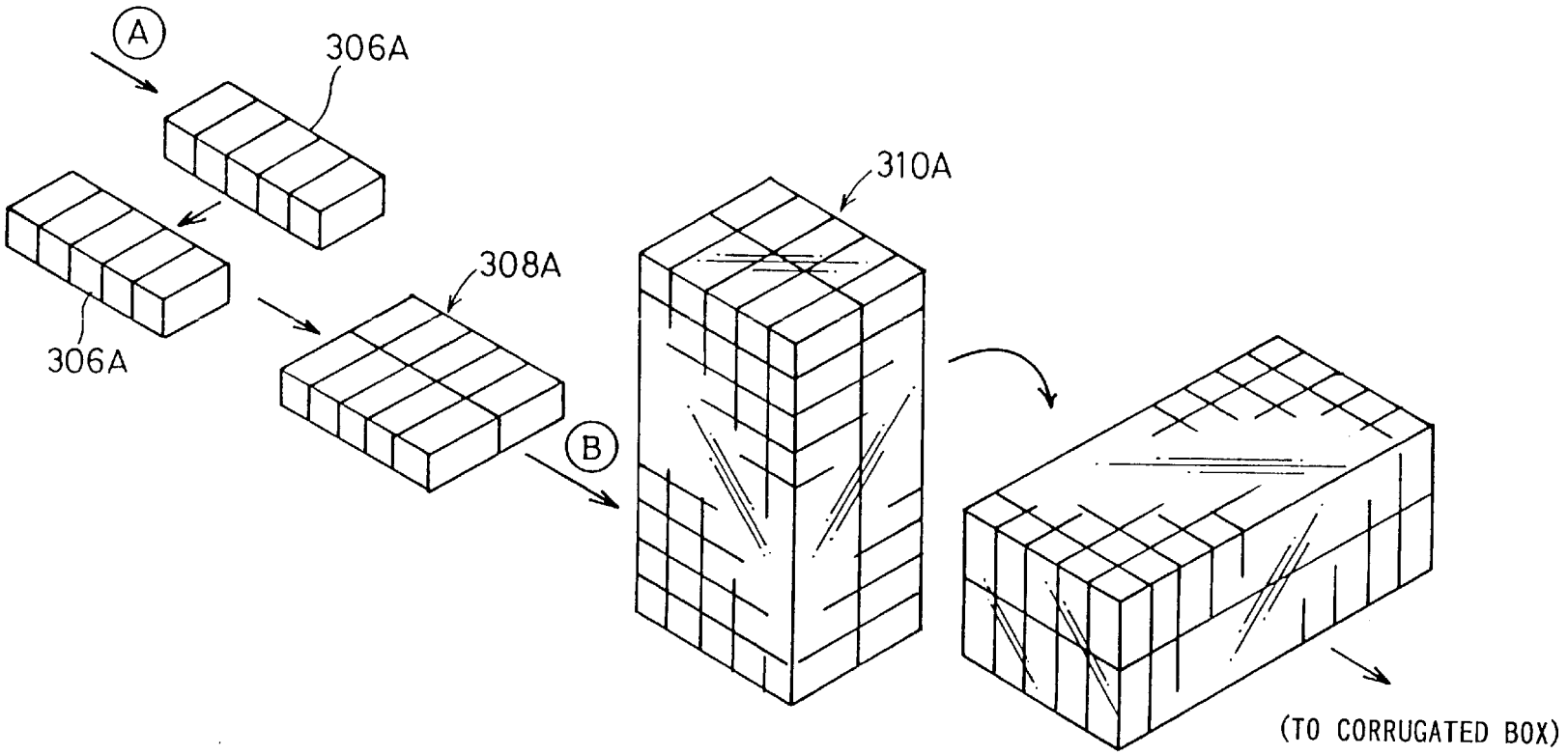
FIG. 19 is a schematic perspective view illustrative of a packaging process in the first packaging line for assembling packs shown in FIG. 18 into an assembly and storing the assembly in a corrugated box to produce a large outer shipping package.

All packs 306A each composed of five small outer shipping packages 300A are delivered to the main line A by the first branching mechanism 170, as shown in FIG. 19, and then successively laterally delivered to the branch line B by the second branching mechanism 172. Two parallel packs 306A are combined with each other into a pack combination 308A by the pack combining mechanism 178 on the branch line B. and the pack combination 308A is then discharged from the pack combining mechanism 178. The pack combination 308A is delivered to the wrapping mechanism 176.

The pack combination 308A supplied to the wrapping mechanism 176 is wrapped by a transparent film supplied from the transparent film supply mechanism 190 in the wrapping mechanism 176, and then discharged to the packing machine 64 by the discharge mechanism 182.

In the packing machine 64, pack combinations 308A are supplied to the large outer shipping package producing mechanism 112. The pack combinations 308A are checked for the number of packed small outer shipping packages 300A by the weight measuring unit 208 in the number inspecting mechanism 212. Only those pack combinations 308A which have a desired number of packed small outer shipping packages 300A are delivered to the assembly forming mechanism 214. In the assembly forming mechanism 214, pack combinations 308A delivered one by one are successively stacked. For example, 10 pack combinations 308A are stacked into an assembly 310A, which is delivered to the assembly storage mechanism 216.

The assembly storage mechanism 216 is supplied with a corrugated box from the corrugated box supply mechanism 200 as well as the assembly 310A. The corrugated box charging mechanism 224 of the corrugated box supply mechanism 200 charges a corrugated box produced by the box forming mechanism 222 to the assembly storage mechanism 216 with flaps being open. The assembly storage mechanism 216 changes the orientation of the assembly 310A by 90°, and pushes the assembly 310A into the corrugated box when the central axis of the corrugated box is aligned with the central axis of the assembly 310A.

Open flaps of the corrugated box in which the assembly 310A has been stored are pasted by the flap pasting mechanism 218, producing a large outer shipping package. Thereafter, the large outer shipping package is printed with a pack ID number by the pack ID printing mechanism 202, and then delivered to the final pallet stacking process 206 by the large outer shipping package delivery mechanism 204.

Figure 20:
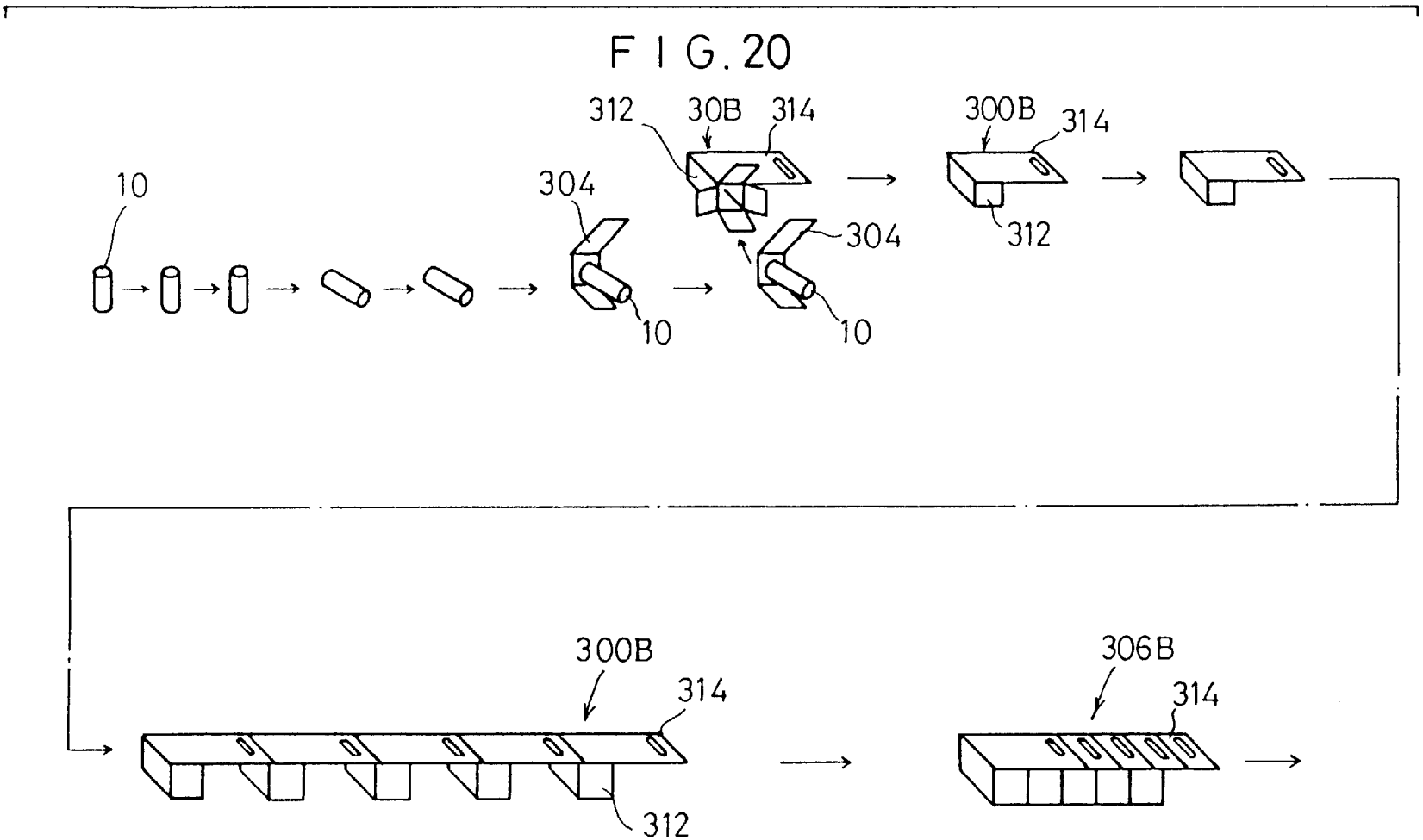
FIG. 20 is a schematic perspective view illustrative of a packaging process in the first packaging line for horizontally storing a magazine case into a small box with a hanger to produce a small outer shipping package and combining a plurality of small outer shipping packages into a pack.
Figure 21:
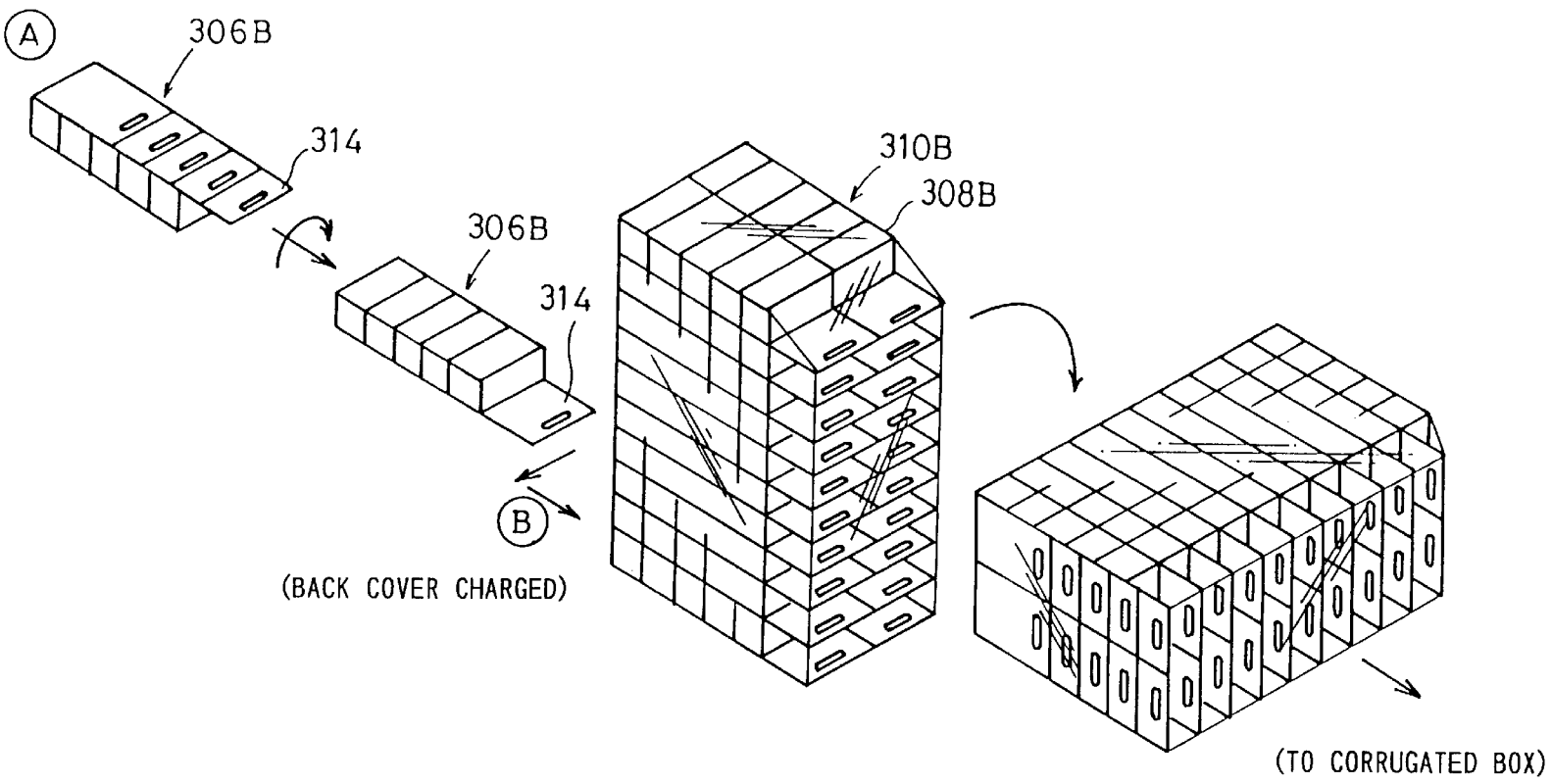
FIG. 21 is a schematic perspective view illustrative of a packaging process in the first packaging line for assembling packs shown in FIG. 20 into an assembly and storing the assembly in a corrugated box to produce a large outer shipping package.

Packaging operation in the first packaging line #1 for horizontally placing a magazine case 10 into a small box 30B with a hanger thereby to produce a small outer shipping package 300B and packing a number of small outer shipping packages 300B into a corrugated box, will be described below with reference to FIGS. 20 and 21.

A number of magazine cases 10 charged by the magazine case charging mechanism 100 are erected and aligned by the magazine case aligning mechanism 102, and delivered to a subsequent mechanism. The magazine cases 10 are then changed in orientation by the aligning and delivering mechanism 136 of the small outer shipping package producing mechanism 104, and delivered to the magazine case storage mechanism 138.

To the magazine case storage mechanism 138, there are also supplied small boxes 30B with hangers from the small box supply mechanism 106 and manuals 304 from the manual supply mechanism 108. The small box charging mechanism 154 of the small box supply mechanism 106 charges small boxes 30B with hangers produced by the box forming mechanism 152 into the small box delivery mechanism 156 such that the longitudinal axis of each of the small boxes 30B, which extends from an open flap end to a closed bottom end thereof, is aligned with the axial direction of one of the magazine cases 10, with flaps being open. The small box delivery mechanism 156 delivers the charged small boxes 30A in their charged orientation in synchronism with the delivery of the magazine cases 10 by the aligning and delivering mechanism 136. At this time, each of the small boxes 30B is delivered with its hanger 314 up.

When the central axis of a small box 30B and the central axis of a magazine case 10 are aligned with each other, the magazine case storage mechanism 138 pushes the magazine case 10 into the small box 30B to store the magazine case 10 in the small box 30B. A manual 304 is supplied from the manual supply mechanism 108 immediately before the magazine case 10 is pushed into the small box 30B. Therefore, the magazine case 10 and the manual 304 are stored in the small box 30B.

Open flaps of the small box 30B with the magazine case 10 stored therein are pasted by the flap pasting mechanism 140, thus producing a small outer shipping package 300B with a hanger in which the magazine case 10 has been stored. Thereafter, the small outer shipping package 300B is printed with a package ID number by the package ID number printing mechanism 142, and its orientation is corrected by the orientation correcting mechanism 144. In FIG. 20, the orientation correction angle is 0°.

Thereafter, small outer shipping packages 300B with hangers are put together into a pack in a predetermined packing pattern by the conveyor 168 of the pack production mechanism 110, and then delivered to a subsequent mechanism. In FIG. 20, five small outer shipping packages 300B with hangers are combined into a pack 306B without changing their orientation. When the small outer shipping packages 300B are combined into a pack 306B, their hangers 314 are overlapped.

The pack 306B, which is composed of five small outer shipping packages 300B, is delivered to the main line A by the first branching mechanism 170, and inverted vertically while being delivered along the main line A. Specifically, the pack 306B is turned upside down 180° with the hangers 314 down. Vertically inverted packs 306B are successively delivered to the branch line B by the second branching mechanism 172. While each of the packs 306B is being delivered along the branch line B, a back cover supplied from the back cover supply mechanism 184 is inserted below the hanger 314 and combined therewith, producing a pack combination 308B. The pack combination 308B is then delivered to the wrapping mechanism 180.

The pack combination 308B is then wrapped by a transparent film supplied from the transparent film supply mechanism 190, and discharged to the packing machine 64 by the discharge mechanism 182. The assembly forming mechanism 214 of the large outer shipping package producing mechanism 112 successively stacks pack combinations 308B charged one by one, producing an assembly 310B composed of two arrays of 10 pack combinations 308B. The assembly 310B is delivered to the assembly storage mechanism 216, and stored into a corrugated box thereby. Flaps of the corrugated box are pasted, producing a large outer shipping package. The produced large outer shipping package is delivered to the final pallet stacking process 206 by the large outer shipping package delivery mechanism 204.

Figure 22:
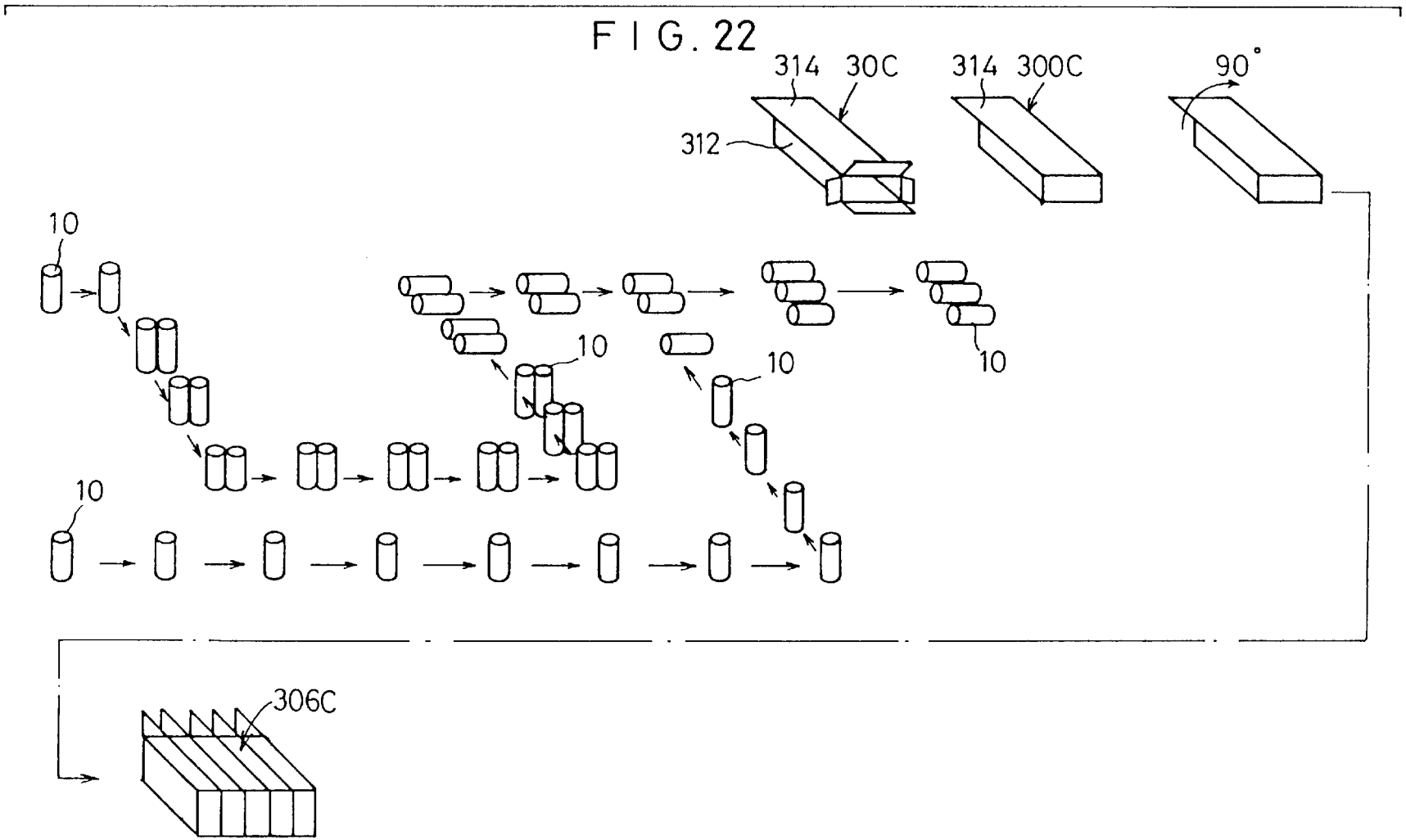
FIG. 22 is a schematic perspective view illustrative of a packaging process in a second packaging line for horizontally storing three magazine cases into a small box with a hanger to produce a small outer shipping package and combining a plurality of small outer shipping packages into a pack.

Packaging operation in the second packaging line #2 for horizontally placing three magazine cases 10 into a small box 30C with a hanger thereby to produce a small outer shipping package 300C and packing a number of small outer shipping packages 300C into a corrugated box, will be described below with reference to FIGS. 22 and 23.

Based on a command from the production information management computer 66, a first magazine case charging mechanism 100A, a first magazine case aligning mechanism 102A, and a size inspecting mechanism 134A of the small outer shipping package producing mechanism 104 are energized by the outer shipping packaging machine management computer 84, and a second magazine case charging mechanism 10B, a second magazine case aligning mechanism 102B, and a size inspecting mechanism 134B of the small outer shipping package producing mechanism 104 are also energized by the outer shipping packaging machine management computer 84.

A number of magazine cases 10 supplied from the first magazine case charging mechanism 100A are erected and aligned by the first magazine case aligning mechanism 102A, and delivered to the first size inspecting mechanism 134A. The magazine cases 10 delivered to the first size inspecting mechanism 134A are inspected for a desired size by a weight measuring unit 130A of the size inspecting mechanism 134A, and only those magazine cases 10 which have the desired size are charged to the magazine case branching mechanism 230.

The magazine cases 10 charged to the magazine case branching mechanism 230 are distributed, two at a time, to the branch line A-2 only. The magazine cases 10 supplied to the branch line aligning and delivering mechanism 234 are changed in orientation thereby, and delivered to the magazine case combining mechanism 238. Specifically, the magazine cases 10 change their orientation from the erected state in which their axes extend vertically, to a state in which their axes extend parallel to the horizontal direction and along the delivery direction, and are delivered in the changed orientation to the magazine case combining mechanism 238.

A number of magazine cases 10 supplied from the second magazine case charging mechanism 100B are erected and aligned by the second magazine case aligning mechanism 102B, and delivered to the second size inspecting mechanism 134B. The magazine cases 10 delivered to the second size inspecting mechanism 134B are inspected for a desired size by a weight measuring unit 130B of the size inspecting mechanism 134B, and only those magazine cases 10 which have the desired size are charged to the second aligning and delivering mechanism 236 via the auxiliary line B.

The magazine cases 10 charged to the second aligning and delivering mechanism 236 are changed in orientation thereby and delivered to the magazine case combining mechanism 238. Specifically, the magazine cases 10 change their orientation from the erected state in which their axes extend vertically, to a state in which their axes extend parallel to the horizontal direction and along the delivery direction, and are delivered in the changed orientation to the magazine case combining mechanism 238.

The magazine cases 10 supplied to the magazine case combining mechanism 238 and the magazine cases 10 supplied from the second aligning and delivering mechanism 236 are superposed on each other by the magazine case combining mechanism 238, into a lateral array of three magazine cases 10 which is then delivered to the magazine case storage mechanism 138.

The magazine case storage mechanism 138 is also supplied with small boxes 30C with hangers from the small box supply mechanism 106. In a packaging process effected by the magazine case storage mechanism 138, the manual supply mechanism 108 is inactivated by the outer shipping packaging machine management computer 84 under a command from the production information management computer 66. The small box charging mechanism 154 of the small box supply mechanism 106 charges small boxes 30C with hangers manufactured by the box forming mechanism 152 to the small box delivery mechanism 156 such that the longitudinal axes of box bodies 312 are aligned with the array of magazine cases 10, with flaps thereof being open. The small box delivery mechanism 156 delivers the charged small boxes 30C in the charged orientation in synchronism with the delivery of the magazine cases 10 in the magazine case combining mechanism 238. At this time, the small boxes 30C are delivered with their hangers 314 up.

When the open end of the box body 312 of a small box 30C is aligned with the projected plane of an array of three magazine cases 10, the magazine case storage mechanism 138 pushes the array of magazine cases 10 into the small box 30C to store the array of magazine cases 10 in the small box 30C. The small box 30C which stores the three magazine cases 10 therein is turned into a small outer shipping package 300C after flaps are pasted and a package ID number is printed. Thereafter, the small outer shipping package 300C is printed with a package ID number by the package ID number printing mechanism 142, and its orientation is corrected by the orientation correcting mechanism 144. In FIG. 22, the orientation correction angle is 90° as indicated by the arrow.

Thereafter, the small outer shipping package 300C is supplied to the pack production mechanism 110. Several small outer shipping packages 300B are packed in a predetermined packing pattern by the conveyor 168 in the pack production mechanism 110. In FIG. 22, five small outer shipping packages 300C are packed into a pack 306C without changing their orientation.

Figure 23:
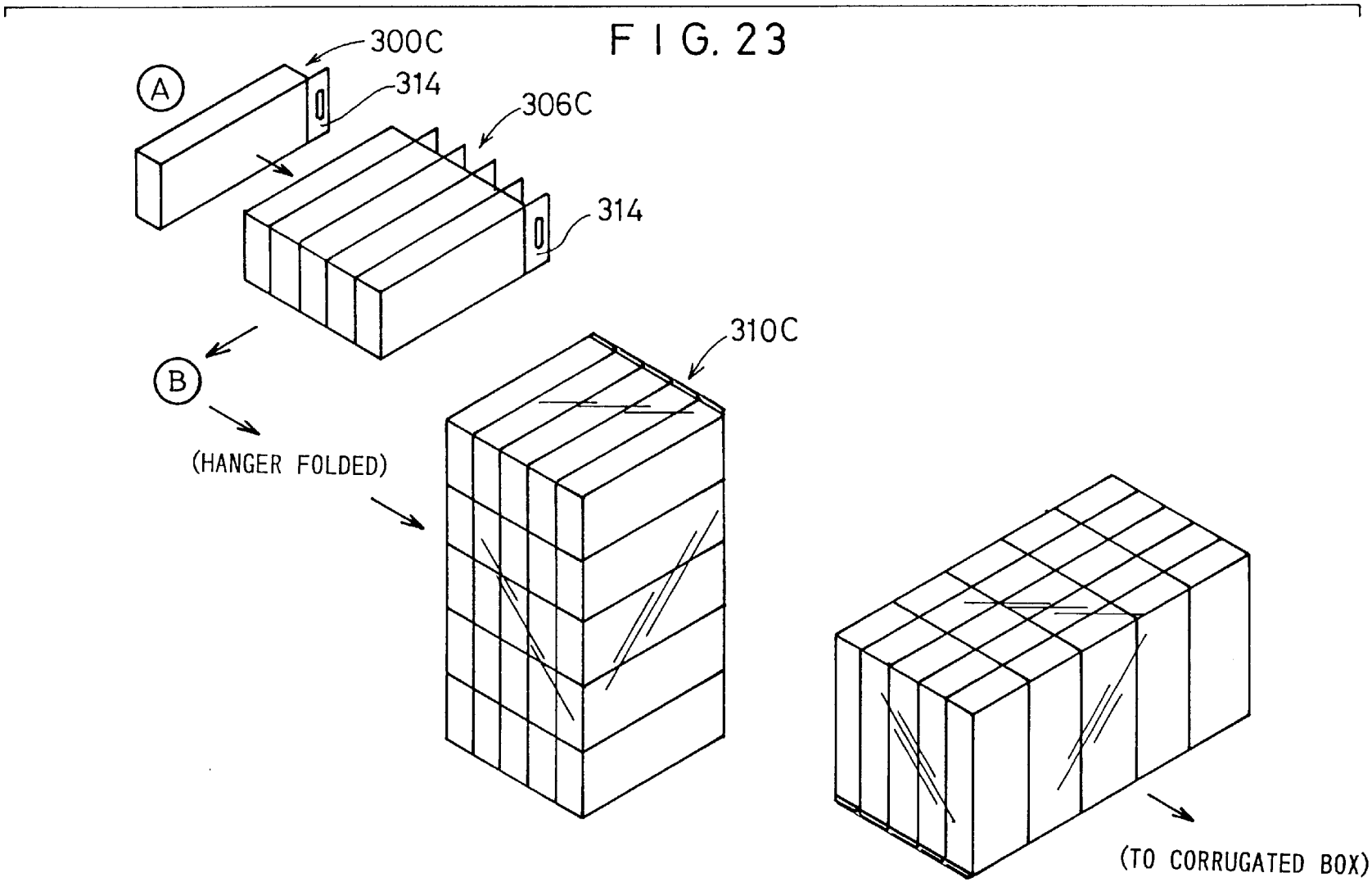
FIG. 23 is a schematic perspective view illustrative of a packaging process in the second packaging line for assembling packs shown in FIG. 22 into an assembly and storing the assembly in a corrugated box to produce a large outer shipping package.

All packs 306C each composed of five small outer shipping packages 300C are delivered to the main line A by the first branching mechanism 170, as shown in FIG. 23, and then successively laterally delivered to the branch line B by the second branching mechanism 172. The laterally projecting hangers 314 of the packs 306C which are delivered along the branch line B are folded by the hanger folding mechanism 174, after which the packs 306C are delivered to the wrapping mechanism 180 and wrapped thereby. The wrapped packs 306C are then delivered to the packing machine 64.

In the assembly forming mechanism 214 of the large outer shipping package producing mechanism 112 in the packing machine 64, packs 306C delivered one by one are successively stacked. For example, 10 packs 306C are stacked into an assembly 310C, which is delivered to the assembly storage mechanism 216, and stored into a corrugated box thereby. Flaps of the corrugated box are pasted, producing a large outer shipping package. The produced large outer shipping package is delivered to the final pallet stacking process 206 by the large outer shipping package delivery mechanism 204.

Figure 24:
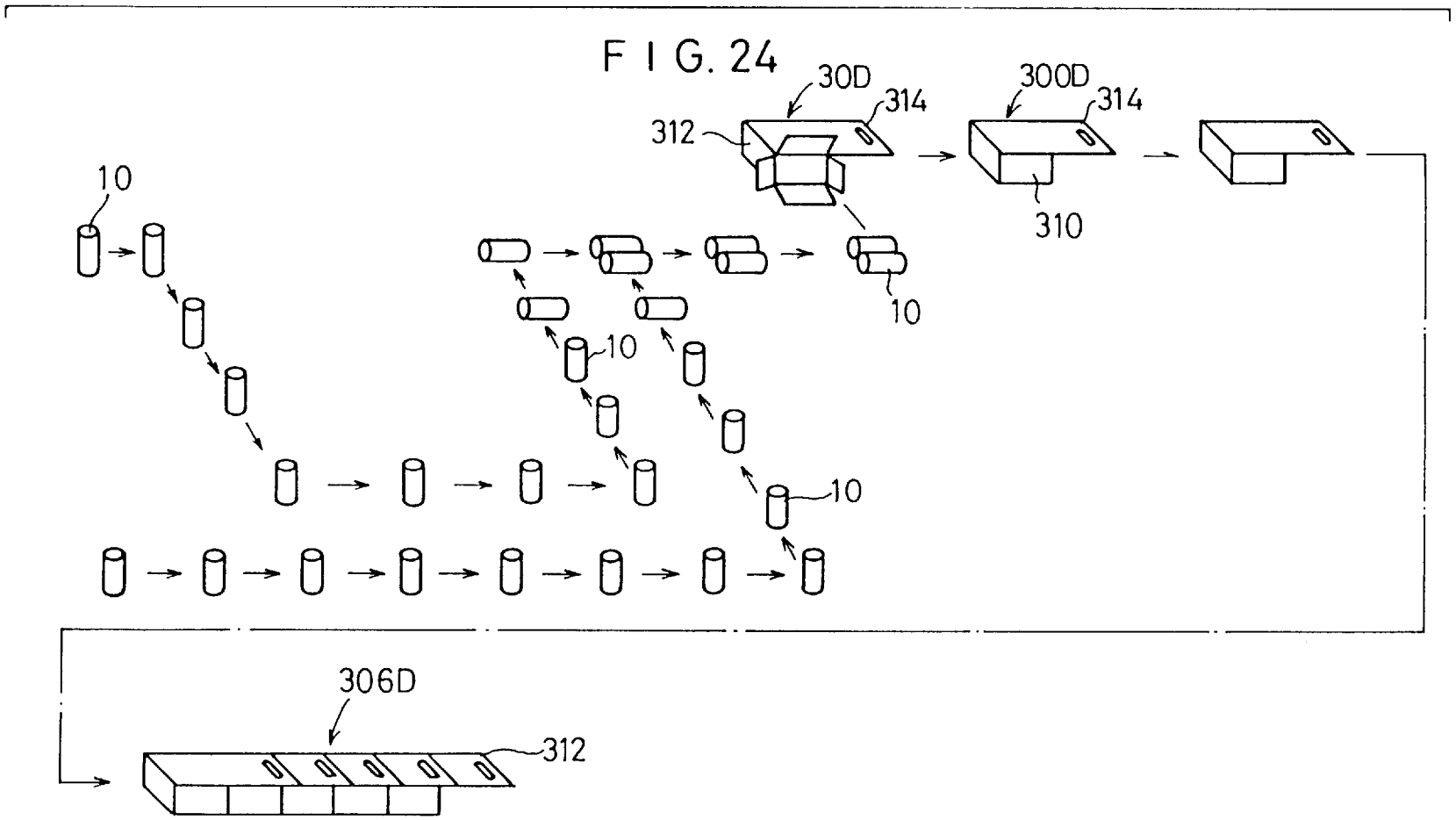
FIG. 24 is a schematic perspective view illustrative of a packaging process in a third packaging line for vertically storing two magazine cases into a small box with a hanger to produce a small outer shipping package and combining a plurality of small outer shipping packages into a pack.

Packaging operation in the third packaging line #3 for vertically placing two magazine cases 10 into a small box 30D with a hanger thereby to produce a small outer shipping package 300D and packing a number of small outer shipping packages 300D into a corrugated box, will be described below with reference to FIGS. 24 and 25.

A number of magazine cases 10 supplied from the first magazine case charging mechanism 100A are erected and aligned by the first magazine case aligning mechanism 102A, and delivered to the first size inspecting mechanism 134A. The magazine cases 10 delivered to the first size inspecting mechanism 134A are inspected for a desired size by a weight measuring unit 130A of the size inspecting mechanism 134A, and only those magazine cases 10 which have the desired size are charged to the magazine case branching mechanism 230.

Magazine cases 10 charged to the magazine case branching mechanism 230 are distributed, one at a time, to the branch line A-2 only. The magazine cases 10 are changed in orientation by the branch line aligning and delivering mechanism 234, and delivered to the magazine case combining mechanism 238. Magazine cases 10 supplied from the second magazine case charging mechanism 100B are charged along the auxiliary line B to the second aligning and delivering mechanism 236. The magazine cases 10 are then changed in orientation by the second aligning and delivering mechanism 236, and delivered to the magazine case combining mechanism 238.

The magazine cases 10 supplied to the magazine case combining mechanism 238 and the magazine cases 10 supplied from the second aligning and delivering mechanism 236 are superposed on each other by the magazine case combining mechanism 238, into a lateral array of two magazine cases 10 which is then delivered to the magazine case storage mechanism 138.

The magazine case storage mechanism 138 is also supplied with small boxes 30D with hangers from the small box supply mechanism 106. The small box charging mechanism 154 of the small box supply mechanism 106 charges small boxes 30D with hangers manufactured by the box forming mechanism 152 to the small box delivery mechanism 156 such that the longitudinal axes of box bodies 312 are aligned with the array of magazine cases 10, with flaps thereof being open. The small box delivery mechanism 156 delivers the charged small boxes 30D in the charged orientation in synchronism with the delivery of the magazine cases 10 in the magazine case combining mechanism 238. At this time, the small boxes 30C are delivered with their hangers 314 up.

When the open end of the box body 312 of a small box 30D is aligned with the projected plane of an array of two magazine cases 10, the magazine case storage mechanism 138 pushes the array of magazine cases 10 into the small box 30D to store the array of magazine cases 10 in the small box 30d. The small box 30D which stores the two magazine cases 10 therein Is turned into a small outer shipping package 300D after flaps are pasted and a package ID number is printed. Thereafter, the small outer shipping package 300D is printed with a package ID number by the package ID number printing mechanism 142, and its orientation is corrected by the orientation correcting mechanism 144. In FIG. 24, the orientation correction angle is 0°.

Thereafter, small outer shipping packages 300D are put together into a pack in a predetermined packing pattern by the conveyor 168 of the pack production mechanism 110, and then delivered to a subsequent mechanism. In FIG. 24, five small outer shipping packages 300D are combined into a pack 306D without changing their orientation.

Figure 25:
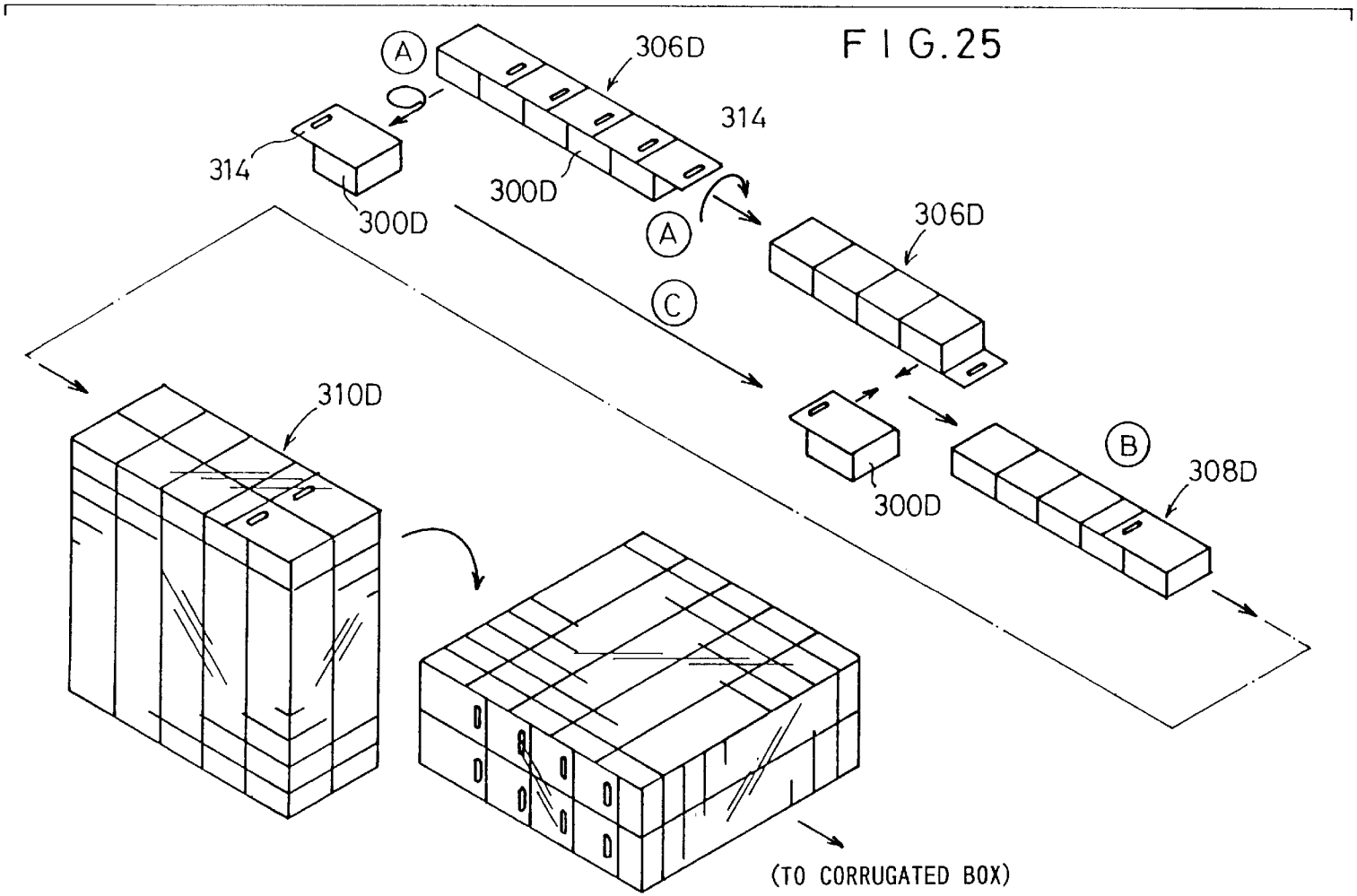
FIG. 25 is a schematic perspective view illustrative of a packaging process in the third packaging line for assembling packs shown in FIG. 24 into an assembly and storing the assembly in a corrugated box to produce a large outer shipping package.

As shown in FIG. 25, only the small outer shipping package 300D at the trailing end of the pack 306D is removed by the first branching mechanism 170, reversed 180°, and delivered to the branch line C. That is, the small outer shipping package 300D is delivered to the branch line C with its hanger 314 directed downstream in the delivery direction, and delivered along the branch line C while maintaining its orientation.

The remaining small outer shipping packages 300D of the pack 306D are all delivered to the main line A by the second branching mechanism 172, and turned upside down while being delivered along the main line A. Specifically, the pack 306D is turned upside down 180° with the hangers 314 down. The vertically inverted pack 306D and the small outer shipping package 300D delivered along the branch line C are delivered to the branch line B, and then combined into a pack combination 308D in a predetermined combining pattern by the pack combining mechanism 178. The pack combination 308D is then delivered as a pack 308D to the wrapping mechanism 180. In FIG. 25, the small outer shipping package 300D is combined with the leading end of the pack 306D.

The pack 308D delivered to the wrapping mechanism 180 is wrapped thereby, and then delivered to the packing machine 64.

In the assembly forming mechanism 214 of the large outer shipping package producing mechanism 112 in the packing machine 64, packs 308D delivered one by one are successively stacked. For example, 10 packs 308D are stacked into an assembly 310D, which is delivered to the assembly storage mechanism 216, and stored into a corrugated box thereby. Flaps of the corrugated box are pasted, producing a large outer shipping package. The produced large outer shipping package is delivered to the final pallet stacking process 206 by the large outer shipping package delivery mechanism 204.

Figure 26:
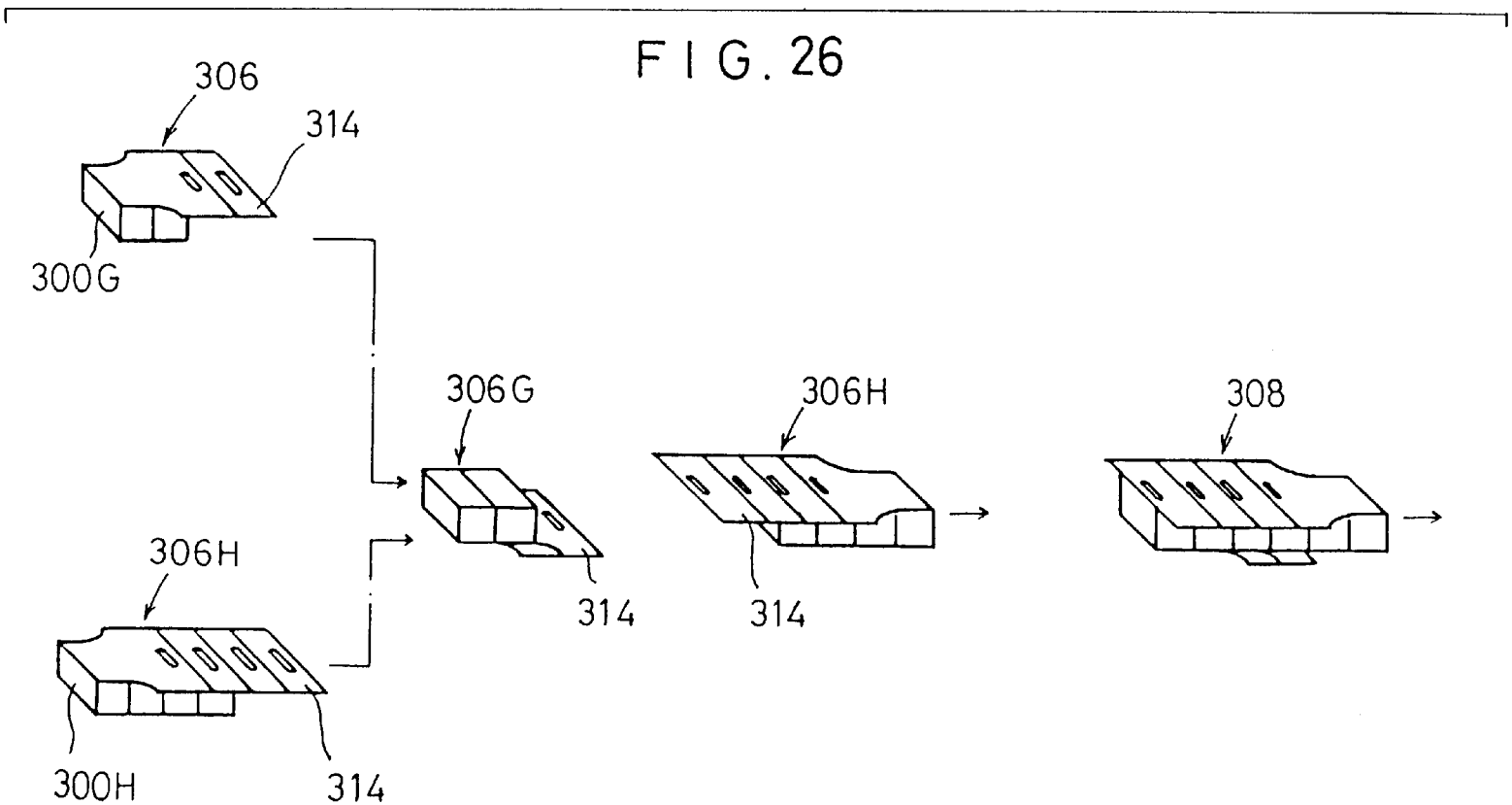
FIG. 26 is a schematic perspective view illustrative of a packaging process in a fourth packaging line for combining a first pack of first small outer shipping packages from the first packaging line and a second pack of second small outer shipping packages from the second packaging line into a pack combination.

Packing operation in the fourth packaging line #4 will be described below with reference to FIGS. 26 and 27.

First small outer shipping packages 300G sorted and discharged by the sorting and discharging mechanism 146 of the small outer shipping package producing mechanism 104 in the first packaging line #1 and second small outer shipping packages 300H sorted and discharged by the sorting and discharging mechanism 146 of the small outer shipping package producing mechanism 104 in the second packaging line #2 are charged to the pack production mechanism 110 in the fourth packaging line #4, and delivered to a subsequent mechanism by the conveyor 168 of the pack production mechanism 110.

The conveyor 168 combines two first small outer shipping packages 300G, for example, into a first pack 306G, and at the same time, combines three second small outer shipping packages 300H, for example, into a second pack 306H.

The second pack 306H is reversed 180° and delivered to the branch line C by the first branching mechanism 170. That is, the second pack 306H is delivered to the branch line C with their hangers 314 directed downstream in the delivery direction, and delivered along the branch line C while maintaining its orientation.

The first pack 306G is delivered to the main line A by the second branching mechanism 172, and inverted vertically while being delivered along the main line A. Specifically, the first pack 306G is turned upside down 180° with the hangers 314 down. The inverted first pack 306G and the second pack 306H delivered along the branch line C are delivered to the branch line B, and then combined into a pack combination 308 in a predetermined combining pattern by the pack combining mechanism 178. The pack combination 308 is then delivered to the combined pack storage mechanism 252. In FIG. 26, the rear surface of the second pack 306H where the hangers 314 project is held in contact with the front surface of the first pack 306G where the hangers 314 project.

Figure 27:
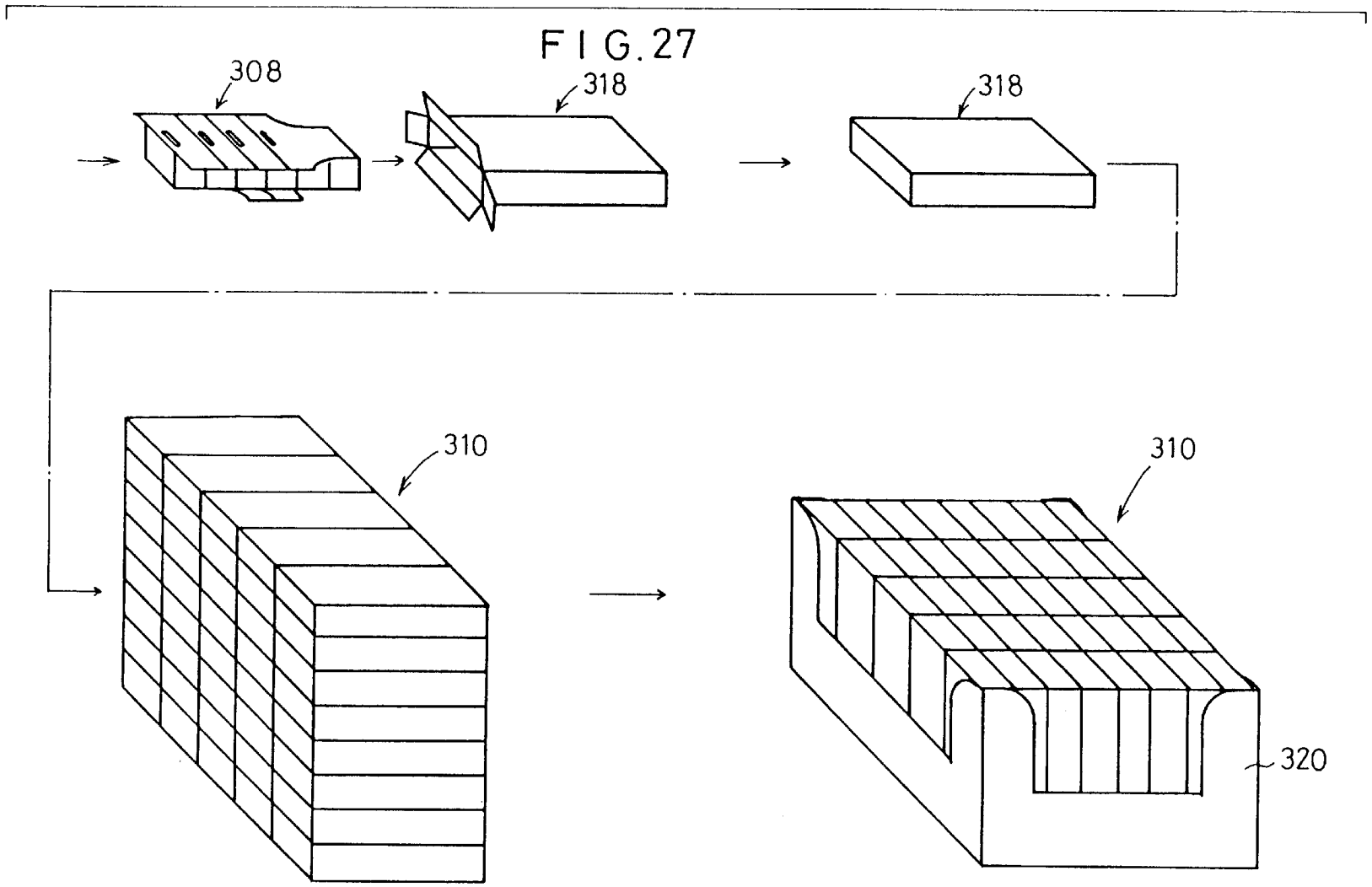
FIG. 27 is a schematic perspective view illustrative of a packaging process in the fourth packaging line for stacking a number of base boxes each housing the pack combination shown in FIG. 26 and storing the stack of base boxes into a tray.

The combined pack storage mechanism 252 is also supplied with a base box 318 from the base box supply mechanism 250, as shown in FIG. 27. The base box charging mechanism 258 of the base box supply mechanism 250 charges the base box 318 into the combined pack C) storage mechanism 252 such that the longitudinal axis of the base box 318 extending from an open flap end to a closed bottom end thereof is aligned with the array of the small outer shipping packages 300G, 300H in the pack combination 308.

When the central axis of the base box 318, which is a hypothetical line passing through the center of the opening of the base box 318 and extending toward the closed bottom end of the base box 318, is aligned with the central axis of the pack combination 308, the combined pack storage mechanism 252 pushes the pack combination 308 into the base box 318 to store the pack combination 308 in the base box 318. Open flaps of the base box 318 with the pack combination 308 stored therein are pasted by the flap pasting mechanism 280, after which the base box 318 is discharged to the packing machine 64 by the discharge mechanism 182.

The base box 318 with the pack combination 308 stored therein is supplied to the large outer shipping package producing mechanism 112 of the packing machine 64. The base box 318 with the pack combination 308 stored therein is inspected for the number of small outer shipping packages by the weight measuring unit 208 of the number inspecting mechanism 212. Only those base boxes 318 which contain a desired number of small outer shipping packages are delivered to the assembly forming mechanism 214. The assembly forming mechanism 214 stacks base boxes 318 each with the pack combination 308 stored therein into a matrix of five horizontal columns and eight vertical rows, thus producing an assembly or block 310. The assembly 310 is delivered to the assembly storage mechanism 262.

The assembly storage mechanism 262 is also supplied with a tray 320 from the tray supply mechanism 260. The tray charging mechanism 274 of the tray supply mechanism 260 supplies an upwardly open tray 320 produced by the tray assembling mechanism 272 to the assembly storage mechanism 262. When the center of the upper opening of the tray 320 is aligned with the vertical central axis of the assembly 310, the assembly storage mechanism 262 pushes the assembly 310 into the tray 320 thereby to place the assembly 310 in the tray 320. The assembly 310 stored in the tray 320, or the assembly 310 with the tray 320, is then delivered to the assembly-with-tray storage mechanism 264.

The assembly-with-tray storage mechanism 264 is also supplied with a corrugated box from the corrugated box supply mechanism 200. The corrugated box charging mechanism 224 of the corrugated box supply mechanism 200 charges a corrugated box produced by the box forming mechanism 222 to the assembly-with-tray storage mechanism 264 with flaps being open. When the central axis of the corrugated box is aligned with the central axis of the assembly 310 with the tray 320, the assembly-with-tray C) storage mechanism 264 pushes the assembly 310 with the tray 320 into the corrugated box, thereby storing the assembly 310 with the tray 320 in the corrugated box.

Open flaps of the corrugated box in which the assembly 310 with the tray 320 has been stored are pasted by the flap pasting mechanism 266, thus producing a large outer shipping package. Thereafter, the large outer shipping package is printed with a pack ID number by the pack ID printing mechanism 202, and then delivered to the final pallet stacking process 206 by the large outer shipping package delivery mechanism 204.

The above various packaging operation sequences are illustrative only, and may be modified in various ways. For example, small outer shipping packages 300 with hangers and small outer shipping packages 300 free of hangers may be combined into a pack 306, and a plurality of packs 306 may be put into a corrugated box, or a small outer shipping package 300 with a hanger in which a plurality of magazine cases 10 are horizontally stored and a small outer shipping package 300 with a hanger in which a plurality of magazine cases 10 are vertically stored may be combined. The present invention is thus applicable to various packaging patterns.

The packaging system according to the present invention is capable of producing small outer shipping packages 300, packs 306, and large outer shipping packages based on a pattern in which magazine cases 10 are stored in small boxes 30, a pattern in which small outer shipping packages 300 are packed, and a pattern in which packs 306 are combined, as established in advance by the production information management computer 66. Therefore, it is possible to easily automatize a complex packaging process of storing magazine cases 10 into small boxes 30 in any of various combining patterns thereby to produce small outer shipping packages 300, combining small outer shipping packages 300 into a pack 306 in any of various combining patterns, and storing a plurality of packs 306 into a corrugated box thereby to produce a large outer shipping package.

In the packaging system, the small outer shipping package producing mechanism 104 in each of the first and second packaging lines #1, #2 has at its final stage the sorting and discharging mechanism 146 for sorting and discharging some of the small outer shipping packages 300 produced by the small outer shipping package producing mechanism 104 to another packaging line such as the fourth packaging line #4. Therefore, some of the small outer shipping packages 300 produced by the small outer shipping package producing mechanism 104 in each of the first and second packaging lines #1, #2 may be supplied to the fourth packaging line #4 by the sorting and discharging mechanism 146. Therefore, small outer shipping packages 300 may be packaged simultaneously on the first and second packaging lines #1, #2 and the fourth packaging line #4. As a result, small outer shipping packages 300 can quickly be packaged in special patterns within a reduced period of time.

Furthermore, the small outer shipping package producing mechanism 104 in each of the second and third packaging lines #2, #3 has the main and branch lines, the magazine case branching mechanism 230 for separating, at given timing, magazine cases 10 successively charged from the first magazine case aligning mechanism 102A, and distributing magazine cases 10 to the branch line, and the magazine case combining mechanism 238 for combining magazine cases 10 delivered along the main line and magazine cases 10 delivered along the branch line. Therefore, when magazine cases 10 are stored into small boxes 30 by the small outer shipping package producing mechanism 104, it is possible to store a set of two magazine cases 10 into a small box 30. By modifying the combining pattern, a set of two magazine cases 10 may be stored into a small box 30 in any of various patterns.

The second and third packaging lines #2, #3 have the two magazine case charging mechanisms 10A, 100B, the two magazine case aligning mechanisms 102A, 102B, and the two size inspecting mechanism 134A, 134B. Magazine cases 10 accepted by the two size inspecting mechanism 134A, 134B are combined by the magazine case combining mechanism 238. Therefore, when magazine cases 10 are stored into small boxes 30 by the small outer shipping package producing mechanism 104, it is possible to store a set of three or more arrayed magazine cases 10 into a small box 30. By modifying the combining pattern, a set of three or more magazine cases 10 may be stored into a small box 30 in any of various patterns.

The fourth packaging line #4 has the pack production mechanism 110 for producing first and second packs 306 composed of first and second small outer shipping packages 300 charged from the first and second packaging lines #1, #2 and combined in a predetermined packing pattern, and the large outer shipping package producing mechanism 112 for assembling the first and second packs 306 in a predetermined assembling pattern into an assembly 310, placing the assembly 310 in a tray and storing the assembly 310 with the tray into a corrugated box thereby to produce a large outer shipping package. Therefore, a plurality of small outer shipping packages 300 having a plurality of various storage patterns may be combined and stored into a large package. The packaging system is thus capable of automatizing various packaging patterns.

Furthermore, in the second packaging line #2, the pack production mechanism 110 has the main line A and the two branch lines B, C, the first and second branching mechanisms 170 for selectively branching small outer shipping packages 300 successively delivered from the small outer shipping package producing mechanism 104 to the main lines A and the branch lines B, C, and the pack combining mechanism 178 for combining packs 306 delivered along the branch lines B, C and packs 306 delivered along the main line A in a predetermined combining pattern. Therefore, packs 306 may be combined in any of various combining patterns. The packaging system can therefore quickly be arranged to meet a diverse range of packaging patterns. Since the packaging system can be automatized in its entirety, the packaging process carried thereby can be simplified, be composed of a reduced number of steps, and be manufactured relatively inexpensively.

While the present invention is illustrated as being applied to magazine cases 10 in the above embodiment, the principles of the invention are also applicable to other cylindrical and prismatic articles. In the above embodiment, small boxes 30 are described as small packages and corrugated boxes are large packages. However, each of small and large packages may be bag-shaped packages.

As described above, the packaging system according to the present invention has an article charging mechanism for storing a plurality of articles, and picking up and charging the articles one by one to a subsequent stage, an article aligning mechanism for aligning the articles charged from the article charging mechanisms in one direction, a small outer shipping package producing mechanism for storing at least one of the articles aligned by the article aligning mechanism in a predetermined pattern into a small package thereby to produce a small outer shipping package, a pack production mechanism for combining a plurality of small outer shipping packages in a predetermined combining pattern into a pack, a large outer shipping package producing mechanism for assembling a plurality of packs in a predetermined assembling pattern into an assembly, and storing the assembly into a large package, and a controller for controlling the article charging mechanism, the article aligning mechanism, the small outer shipping package producing mechanism, the pack production mechanism, and the large outer shipping package producing mechanism.

Consequently, a complex packaging process of storing an article or articles into a small package to produce a small outer shipping package, combining small outer shipping packages in any of various combining patterns into a pack, and storing a plurality of packs into a large package to produce a large outer shipping package can easily be automatized. For example, a packaging system for packaging cartridges which house photographic film pieces, as articles, can fully be automatized.

Although a certain preferred embodiment of the present invention has been shown and described in detail, it should be understood that various changes and modifications may be made therein without departing form the scope of the appended claims.

What is claimed is:

1. An article packaging system comprising:

an article charging mechanism for storing a plurality of articles, and picking up and charging the articles one by one to a subsequent stage;

an article aligning mechanism for aligning the articles charged from said article charging mechanism in one direction;

a small outer shipping package producing mechanism for storing at least one of the articles aligned by said article aligning mechanism in a predetermined pattern into a small package using small boxes supplied from a small box supply mechanism, thereby to produce a small outer shipping package, a pack production mechanism for combining a plurality of small outer shipping packages in a predetermined combining pattern into a pack;

a large outer shipping package producing mechanism for assembling a plurality of packs in a predetermined assembling pattern into an assembly, and storing the assembly into a large package to produce a large outer shipping package; and a controller for controlling said article charging mechanism, said article aligning mechanism, said small outer shipping package producing mechanism, said pack production mechanism, and said large outer shipping package producing mechanism, wherein said small outer shipping package producing mechanism includes article orientation changing means for changing each orientation of the articles during delivery; and wherein at least a storage pattern of said small boxes supplied from said small box supply mechanism determines a number and an orientation of said articles adjusted by said article aligning mechanism.

2. An article packaging system according to claim 1, wherein said small outer shipping package producing mechanism comprises:

an outer shipping package branching mechanism disposed in a final stage of said small outer shipping package producing mechanism for distributing selected small outer shipping packages produces by said small outer shipping package producing mechanism to a branch packaging line.

3. An article packaging system according to claim 2, wherein said different packaging line comprises:

a pack production mechanism for combining a plurality of small outer shipping packages charged respectively from a plurality of outer shipping package branching mechanism, in a predetermined combining pattern into a pack; and a large outer shipping package producing mechanism for assembling a plurality of packs in a predetermined assembling pattern into an assembly, and storing the assembly into a large package.

4. An article packaging system according to claim 1, wherein said small outer shipping package producing mechanism comprises:

a plurality of delivering lines, and wherein said article orientation changing means changes each orientation of the articles on at least one delivering line selected from said plurality of delivering lines.

5. An article packaging system according to claim 4, further comprising:

an article combining mechanism for combining articles delivered along said delivering lines in a predetermined combining pattern when a plurality of delivering lines are selected, and wherein said article orientation changing means changes each orientation of the articles delivered along said delivering lines to be adjusted depending on said predetermined combining pattern of the articles.

6. An article packaging system according to claim 1, wherein said pack production mechanism comprises:

outer shipping package orientation changing means for changing each orientation of the small outer shipping packages during delivery.

7. An article packaging system according to claim 6, wherein said pack production mechanism comprises:

a plurality of delivering lines for delivering one of the small outer shipping packages and the packs of small outer shipping packages, and wherein said outer shipping package orientation changing means is provided on at least one of the delivering lines on which each orientation of one of the small outer shipping packages and the packs of small outer shipping packages needs to be changed.

8. An article packaging system comprising:

a plurality of article supply systems each having an article charging mechanism for storing a plurality of articles, and picking up and charging the articles one by one to a subsequent stage, and an article aligning mechanism for aligning the articles charged from said article charging mechanisms in one direction;

an article combining mechanism for combining articles supplied from the article aligning mechanism of one of said article supply systems and articles supplied from the article aligning mechanism of another of said article supply systems;

a small outer shipping package producing mechanism for storing articles supplied from said article combining mechanism in a predetermined storage pattern into a small package thereby to produce a small outer shipping package;

a pack production mechanism for combining a plurality of small outer shipping packages in a predetermined combining pattern into a pack;

a large outer shipping package producing mechanism for assembling a plurality of packs in a predetermined assembling pattern into an assembly, and storing the assembly into a large package to produce a large outer shipping package; and a controller for controlling said article charging mechanism, said article aligning mechanism, said article combining mechanism, said small outer shipping package producing mechanism, said pack production mechanism, and said large outer shipping package producing mechanism;

wherein a number and a storage pattern of said articles from said another of said article supply systems determines the combining of said articles by said article combining system.

9. An article packaging system according to claim 8, wherein said small outer shipping package producing mechanism comprises:

an outer shipping package branching mechanism disposed in a final stage of said small outer shipping package producing mechanism for distributing selected small outer shipping packages produces by said small outer shipping package producing mechanism to a branch packaging line.

10. An article packaging system according to claim 9, wherein said other article supply system comprises:

a pack production mechanism for combining a plurality of small outer shipping packages charged respectively from a plurality of outer shipping package branching mechanism, in a predetermined combining pattern into a pack; and a large outer shipping package producing mechanism for assembling a plurality of packs in a predetermined assembling pattern into an assembly, and storing the assembly into a large package.

11. An article packaging system according to claim 7, wherein said pack production mechanism comprises a combining mechanism for combining one of the small outer shipping packages and the packs delivered along said delivering lines in a predetermined combining pattern when a plurality of delivering lines are selected, and wherein said outer shipping package orientation changing means changes each orientation of one of the small outer shipping packages and the packs delivered along said delivering lines to be adjusted depending on said predetermined combining pattern of one of the small outer shipping packages and the packs.

12. An article packaging system according to claim 8, further comprising article orientation changing means which changes each orientation of the articles delivered along said delivering lines to be adjusted depending on said predetermined combining pattern of the articles.

13. An article packaging system according to claim 8, wherein said pack production mechanism comprises:

outer shipping package orientation changing means for changing each orientation of the small outer shipping packages during delivery.

14. An article packaging system according to claim 13, wherein said pack production mechanism comprises:

a plurality of delivering lines for delivering one of the small outer shipping packages and the packs of small outer shipping package, and wherein said outer shipping package orientation changing means is provided on at least one delivering line on which each orientation of one of the small outer shipping packages and the packs of small outer shipping packages needs to be changed.

15. An article packaging system according to claim 14, wherein said pack production mechanism comprises a combining mechanism for combining one of the small outer shipping packages and the packs delivered along said delivering lines in a predetermined combining pattern when a plurality of delivering lines are selected, and wherein said outer shipping package orientation changing means changes each orientation of one of the small outer shipping packages and the packs delivered along said delivering lines to be adjusted depending on said predetermined combining pattern of one of the small outer shipping packages and the packs.

* * * * *